US011743626B2

(12) United States Patent
Igarashi et al.

(10) Patent No.: US 11,743,626 B2
(45) Date of Patent: Aug. 29, 2023

(54) SOUND DEVICE AND SOUND SYSTEM

(71) Applicant: SONY GROUP CORPORATION, Tokyo (JP)

(72) Inventors: Go Igarashi, Tokyo (JP); Naoki Shinmen, Tokyo (JP); Kohei Asada, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 142 days.

(21) Appl. No.: 17/311,119

(22) PCT Filed: Aug. 30, 2019

(86) PCT No.: PCT/JP2019/034286
§ 371 (c)(1),
(2) Date: Jun. 4, 2021

(87) PCT Pub. No.: WO2020/121608
PCT Pub. Date: Jun. 18, 2020

(65) Prior Publication Data

US 2021/0377643 A1 Dec. 2, 2021

(30) Foreign Application Priority Data

Dec. 14, 2018 (JP) ..... 2018-234939

(51) Int. Cl.
*H04R 1/10* (2006.01)
*H04R 1/38* (2006.01)
*H04R 1/42* (2006.01)

(52) U.S. Cl.
CPC ..... *H04R 1/1016* (2013.01); *H04R 1/1083* (2013.01); *H04R 1/38* (2013.01); *H04R 1/42* (2013.01)

(58) Field of Classification Search
CPC .... H04R 1/1016; H04R 1/105; H04R 1/1066; H04R 1/1075; H04R 25/02; H04R 25/607;
(Continued)

(56) References Cited

U.S. PATENT DOCUMENTS 3,702,123 A * 11/1972 Macken et al. ..... H04R 25/652 381/328
3,787,643 A * 1/1974 Nielsen ..... H04R 25/402 381/330
(Continued)

FOREIGN PATENT DOCUMENTS

CN 102972044 A 3/2013
CN 106412737 A 2/2017
(Continued)

OTHER PUBLICATIONS

Office Action for EP Patent Application No. 19896908.1, dated Jan. 5, 2022, 09 pages of Office Action.
(Continued)

*Primary Examiner* — Ryan Robinson
(74) *Attorney, Agent, or Firm* — Chip Law Group

(57) ABSTRACT

There is provided a sound device used while being worn on the listener's ears.
The sound device includes a main body installed on a medial surface of an auricle, a holding portion having an annular hollow structure arranged to be coupled to an intertragic notch of an ear near an entrance of an ear canal, a sound guide portion formed as a pipe structure having one end communicating with the main body and another end communicating with the holding portion, an open/close operation unit configured to open or close an earhole, and a control unit configured to control driving of the open/close operation unit. The earhole open/close state is set for each user. The earhole open/close state can be switched depend-
(Continued)

ing on the type of application or content to be played, ambient noise level, user behavior, position information, or the like.

20 Claims, 34 Drawing Sheets

(58) Field of Classification Search
CPC ..... H04R 2201/10; H04R 2225/0213; H04R 2460/09; H04R 2460/11
See application file for complete search history.

(56) References Cited

U.S. PATENT DOCUMENTS 3,800,101 A * 3/1974 Milani ..... H04R 25/659 381/328
4,834,211 A * 5/1989 Bibby ..... H04R 25/656 381/328
4,864,610 A * 9/1989 Stevens ..... H04M 1/05 381/381
6,009,183 A * 12/1999 Taenzer ..... H04R 1/105 181/129
6,094,494 A * 7/2000 Haroldson ..... H04R 25/652 381/328
6,307,943 B1 * 10/2001 Yamagishi ..... H04R 1/2857 381/322
6,819,770 B2 * 11/2004 Niederdrank ..... H04R 25/652 381/328
7,050,598 B1 * 5/2006 Ham ..... H04R 1/1058 381/381
7,227,968 B2 * 6/2007 van Halteren ..... H04R 25/656 381/328
7,425,196 B2 * 9/2008 Jorgensen ..... H04R 25/652 600/25
7,597,855 B2 * 10/2009 Trentacosta ..... B32B 5/26 422/50
8,090,134 B2 * 1/2012 Takigawa ..... H04R 1/1041 381/372
8,320,601 B2 * 11/2012 Takigawa ..... H04R 25/652 381/74
8,331,596 B2 * 12/2012 Topholm ..... H04R 25/02 381/328
8,391,527 B2 * 3/2013 Feucht ..... H04R 25/65 381/328
8,538,056 B2 * 9/2013 Ishibashi ..... H04R 25/652 381/381
8,548,181 B2 * 10/2013 Kraemer ..... H04R 25/65 381/322
8,553,917 B2 * 10/2013 Arndt ..... H04R 25/305 381/328
8,774,435 B2 * 7/2014 Ambrose ..... H04R 1/1091 381/328
8,891,796 B2 * 11/2014 van Halteren ..... H04R 25/65 381/330
8,923,543 B2 * 12/2014 Sacha ..... H04R 25/456 381/328
9,066,190 B2 * 6/2015 Lafort ..... H04R 25/656
9,167,328 B2 * 10/2015 Blendinger ..... H04R 1/1016
9,247,352 B2 * 1/2016 Puder ..... H04R 25/456
9,516,436 B2 * 12/2016 Nikles ..... H01Q 1/273
9,794,700 B2 * 10/2017 Saltykov ..... H04R 25/48
9,924,276 B2 * 3/2018 Wenzel ..... H04R 25/456
10,045,107 B2 * 8/2018 Kirsch ..... H04R 1/1041
10,206,051 B2 * 2/2019 Boley ..... H04R 25/652
10,511,901 B2 * 12/2019 Garrett ..... H04R 1/1041
11,294,619 B2 * 4/2022 Usher ..... G06F 3/04842
11,433,394 B2 * 9/2022 Pelssers ..... F16K 99/0015
11,477,560 B2 * 10/2022 Keady ..... H04R 1/1016
2002/0196958 A1 12/2002 Halteren et al.
2008/0123866 A1 * 5/2008 Rule ..... H04R 25/405 381/71.6
2012/0237068 A1 * 9/2012 Fretz ..... H04R 25/656 381/330
2013/0092470 A1 * 4/2013 Johnston ..... H04R 1/1016 181/129
2013/0101147 A1 4/2013 Kraemer
2013/0114839 A1 5/2013 Gebert
2013/0251172 A1 * 9/2013 Mosseri ..... H04R 1/1083 381/74
2014/0072165 A1 * 3/2014 Gebert ..... H04R 1/1058 381/380
2014/0146989 A1 5/2014 Goldstein
2014/0334652 A1 11/2014 Gebert
2014/0378191 A1 12/2014 Hosoi et al.
2015/0003655 A1 * 1/2015 Moller ..... H04R 25/654 381/329
2015/0215701 A1 * 7/2015 Usher ..... H04R 1/1041 381/71.6
2016/0050483 A1 * 2/2016 Kulavik ..... H04R 1/1016 381/380
2016/0323664 A1 11/2016 Kirsch
2016/0330537 A1 11/2016 Barrentine et al.
2017/0311070 A1 * 10/2017 Igarashi ..... H04R 1/1016
2019/0208301 A1 * 7/2019 Monti ..... H04R 1/1075
2020/0260197 A1 * 8/2020 Thomsen ..... H04R 25/48
2021/0322223 A1 * 10/2021 Goldstein ..... A61B 5/6817

FOREIGN PATENT DOCUMENTS

DE 4339899 A1 * 6/1995 ..... H04R 25/502
DE 102009010603 A1 * 5/2010 ..... H04R 25/656
DE 102019200372 A1 * 7/2020
DK 1272003 T3 1/2011
EP 1272003 A1 1/2003
EP 2594086 A1 5/2013
EP 2594091 A2 5/2013
EP 2806654 A1 11/2014
EP 3089474 A1 11/2016
EP 2835987 B1 * 8/2017 ..... H04R 25/456
EP 3214850 A1 9/2017
JP 2013-037381 A 2/2013
JP 2013-534779 A 9/2013
JP 2014-003479 A 1/2014
JP 2018-133830 A 8/2018
JP 2018-170810 A 8/2018
WO 2011/163565 A1 12/2011
WO 2012/007193 A1 1/2012
WO 2012/007508 A2 1/2012
WO WO-2012149970 A1 * 11/2012 ..... H04R 25/652
WO 2013/108426 A1 7/2013
WO WO-2015101505 A1 * 7/2015 ..... H04R 1/1041
WO 2016/067700 A1 5/2016
WO 2018/123210 A1 7/2018
WO WO-2021115603 A1 * 6/2021

OTHER PUBLICATIONS

International Search Report and Written Opinion of PCT Application No. PCT/JP2019/034286, dated Oct. 21, 2019, 11 pages of ISRWO.

* cited by examiner

SOUND DEVICE AND SOUND SYSTEM

CROSS REFERENCE TO RELATED APPLICATIONS

This application is a U.S. National Phase of International Patent Application No. PCT/JP2019/034286 filed on Aug. 30, 2019, which claims priority benefit of Japanese Patent Application No. JP 2018-234939 filed in the Japan Patent Office on Dec. 14, 2018. Each of the above-referenced applications is hereby incorporated herein by reference in its entirety.

TECHNICAL FIELD

The technology disclosed herein relates to a sound device and a sound system used while being worn on the listener's ears.

BACKGROUND ART

Sound devices used while being worn on the ears, such as an inner-ear type earphone hooked on the listener's ear auricle and a canal type earphone used by being deeply inserted into the earhole, are being now common or widespread. Such a sound device appears to block the earhole of the listener who wears it, giving the impression of difficulty to talk to the person wearing an earphone sometimes.

Nowadays, an "earhole open type" sound device that does not block the listener's earhole even while being worn also appears. The earhole open type sound device has features that enable the listener to hear as usual ambient sound even while wearing the sound device and have the outer configuration looking like it would be okay for other people to talk to the listener because it doesn't block the earhole.

The earhole open type sound device includes, for example, a sound generation portion, a sound guide portion, and a holding portion (see Patent Document 1). The sound generation portion is installed on the medial surface of the auricle. The sound guide portion has a pipe structure of a bent shape in which sound generated by the sound generation portion is curved along the earlobe from the medial surface of the auricle and is propagated to the sound output hole near the entrance of the ear canal. The holding portion is an annular hollow structure arranged to couple to the intertragic notch of the ear near the entrance of the ear canal.

Further, another type of earhole open type sound device includes, for example, a sound generation portion, a holding portion having an opening portion for holding the sound generation portion near the entrance of the user's ear canal. The holding portion is constructed as a ring body with an opening portion, and the housing of the sound generation portion is integrated with a part of the ring body. The sound generation portion includes a sound generation element having a dynamic type driver and has a hollow exhaust part joining with the rear surface of the housing of the sound generation portion. The exhaust part extends from the rear surface of the housing across the intertragic notch and has an exhaust hole outside the ear auricle (see Patent Document 2).

CITATION LIST

Patent Document

Patent Document 1: Japanese Patent Application Laid-Open No. 2018-133830

Patent Document 2: WO 2018/123210 A

Patent Document 3: Japanese Patent Application Laid-Open No. 2013-37381

SUMMARY OF THE INVENTION

Problems to be Solved by the Invention

The technology disclosed herein is intended to provide a sound device and a sound system that can be worn on the listener's ear for use.

Solutions to Problems

A first aspect of the present technology disclosed in this specification is a sound device including:

a main body installed on a medial surface of an auricle;

a holding portion having an annular hollow structure arranged to be coupled to an intertragic notch of an ear near an entrance of an ear canal;

a sound guide portion formed as a pipe structure having one end communicating with the main body and another end communicating with the holding portion;

an open/close operation unit configured to open or close an earhole; and a control unit configured to control driving of the open/close operation unit.

The sound guide portion propagates a regenerated sound wave generated by a sound generation portion housed in the main body to a sound output hole near the entrance of the ear canal. Further, the sound guide portion has a bent shape folded back by an earlobe from the main body installed on the medial surface of the auricle to achieve propagation to a sound output hole near the entrance of the ear canal. Furthermore, the holding portion performs positioning so that the sound output hole of the sound guide portion can emit the regenerated sound wave to an interior of the ear canal of the earhole by fixing the sound output hole of the sound guide portion to a vicinity of the entrance of the ear canal and has a structure that picks up ambient sound from an opening portion of the annular hollow structure to the entrance of the ear canal.

The control unit controls driving of the open/close operation unit on the basis of an open/close state of the earhole set for each user. In addition, the control unit controls driving of the open/close operation unit depending on the type of application or content being played, ambient noise level, user behavior, position information, or the like.

In addition, a second aspect of the present technology disclosed in this specification is a sound system including:

a sound device configured to open or close an earhole of a user; and a control device configured to control an open/close state of the earhole in the sound device, in which the sound device includes a main body, a holding portion, and a sound guide portion, the main body being installed on a medial surface of an auricle, the holding portion having an annular hollow structure arranged to be coupled to an intertragic notch of an ear near an entrance of an ear canal, and the sound guide portion being formed as a pipe structure having one end communicating with the main body and another end communicating with the holding portion.

Note that the term "system" used herein refers to a logical assembly of multiple devices (or function modules that realize specific functions), and does not particularly specify whether or not the devices or function modules are contained within a single housing.

Effects of the Invention

The technology disclosed herein provides a sound device and a sound system capable of controlling the earhole open/close state to change the way of hearing ambient sound or change the opening/closing of the earhole in a short time.

Note that the advantageous effects described in this specification are merely for the sake of example, and the advantageous effects of the present invention are not limited thereto. Furthermore, in some cases the present invention may also exhibit additional advantageous effects other than the advantageous effects given above.

Further objectives, features, and advantages of the technology disclosed in this specification will be clarified by a more detailed description based on the exemplary embodiments described hereinafter and the attached drawings.

MODE FOR CARRYING OUT THE INVENTION

Hereinafter, an embodiment of the technology disclosed in the present specification will be described in detail with reference to the drawings.

In an earhole open type sound device, the earhole is open even upon the attached state, so ambient sound can be heard intact, and even "reproduced sound" is likely to be superimposed on it. Any surrounding person looks at such an outer configuration where ambient sound is heard intact and recognizes a person wearing the device as an "icon that it's good to talk to" the person. Thus, it does not interfere with conversational communication. In addition, the earhole is kept open, so the person feels hearing the own sound of chewing something, heart sound, speech, and footstep, as usual, making the person feel hardly uncomfortable. Besides, the moisture in the ear canal evaporates as usual, so it has a feature suitable for long-term wearing. Such long-term use makes it possible to use usually a personal assistant by speech notification and an application by speech recognition.

On the other hand, the earhole open type sound device is difficult to hear the reproduced sound under high noise. Conversely, in a quiet environment, the reproduced sound can leak to the surroundings, so there is a possibility that the surrounding people can hear details of the content being played. Besides, there is a concern that the open type is relatively difficult to reproduce the sound of a low-frequency range due to its structure as compared with a hermetic type sound device.

Thus, the present disclosure provides a sound device capable of controlling how to hear the ambient sound and controlling the opening and closing of the earhole in a short time, as described below.

A. Outer Configuration

Figure 1:
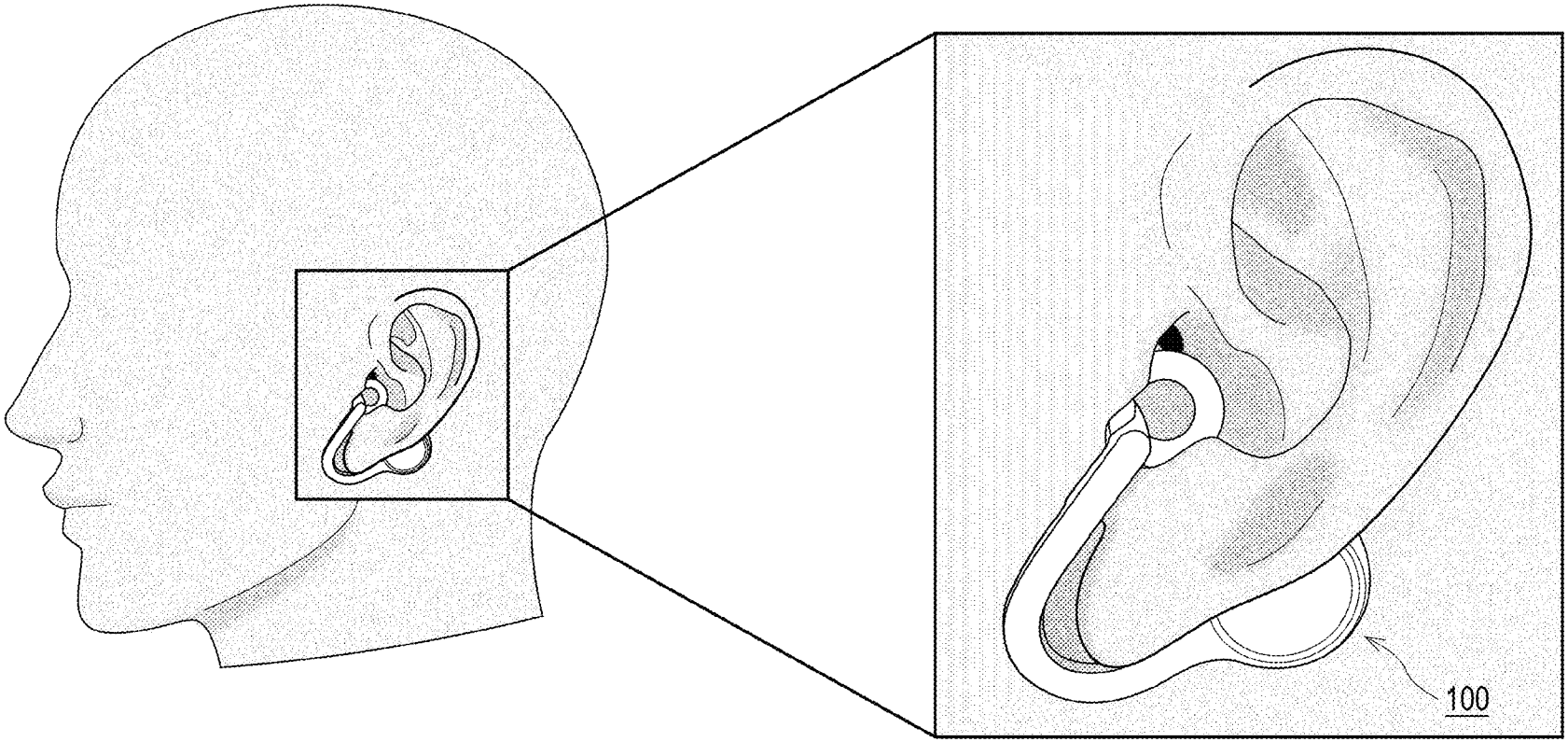
FIG. 1 is a view illustrating the outer configuration of a sound device 100 (with earhole open).
Figure 2:
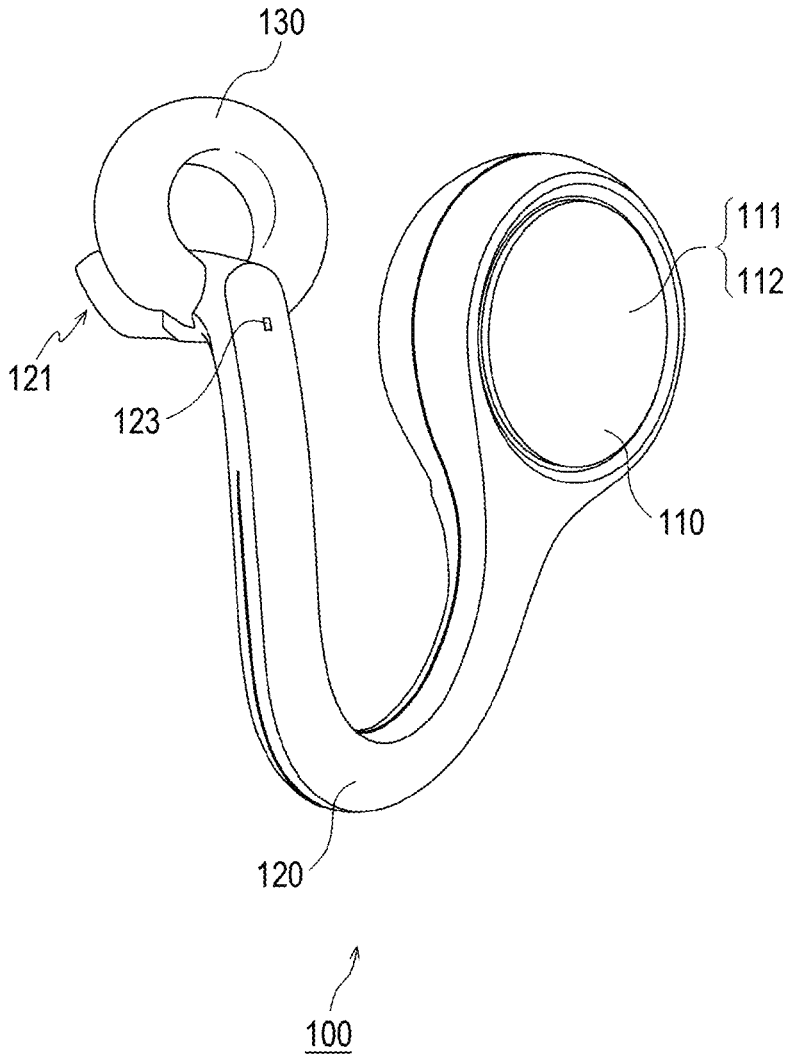
FIG. 2 is a view illustrating the appearance of the sound device 100 viewed from the side.
Figure 3:
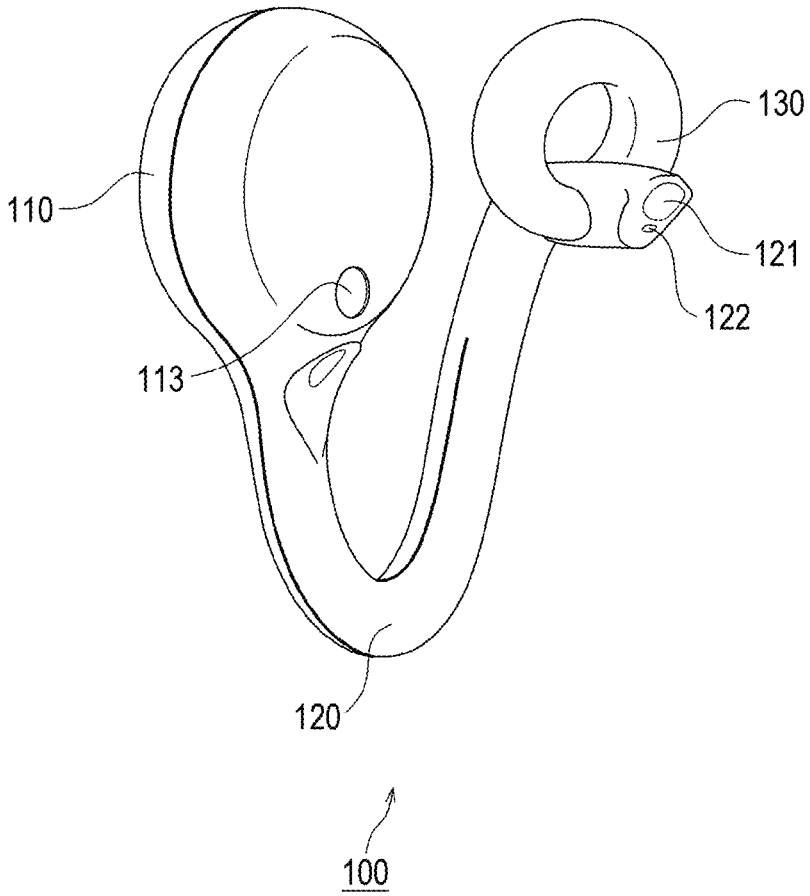
FIG. 3 is a view illustrating the appearance of the sound device 100 viewed from the side.

FIG. 1 illustrates how a sound device 100 provided herein is attached to the left ear of a listener. In addition, FIG. 2 illustrates the appearance of the sound device 100 viewed from an outer side surface (a side exposed to the outside upon being attached to the listener's ear). FIG. 3 illustrates the appearance of the sound device 100 viewed from an inner side surface (a side facing the listener's head upon being attached to the listener's ear). In addition, FIGS. 1 to 3 illustrate the structure for the left ear of the sound device 100, but it can be seen that the sound device 100 has a substantially symmetrical structure for the left and right.

The sound device 100 includes a main body 110, a sound guide portion 120, and a holding portion 130. The main body 110 has a built-in sound element, such as a micro-speaker. The sound guide portion 120 propagates the reproduced sound that is generated by the micro-speaker in the main body 110. The holding portion 130 supports a sound output hole 121 at the other end of the sound guide portion 120 to be kept near the entrance of the ear canal. As illustrated in FIG. 1, when the sound device 100 is attached to the listener's ear, the main body 110 is installed on the medial surface of the auricle. For this reason, the main body 110 is unnoticeable from the outside, and it seems to the surrounding people that the listener's earhole is not blocked.

The sound guide portion 120 has a pipe structure having an inner diameter of approximately 1 to 3 mm and has a bent shape that is curved along the earlobe from the medial surface of the auricle. The sound guide portion 120 picks up the sound generated from the main body 110 at one end and propagates it to the sound output hole 121 near the entrance of the ear canal. The sound guide portion 120 has at least the outer diameter near the sound output hole 121 to be smaller than the inner diameter of the earhole. Thus, even in the state where the sound output hole 121 at the other end of the sound guide portion 120 is kept near the entrance of the ear canal by the holding portion 130, the listener's earhole is not blocked. In other words, the earhole is kept open. The sound device 100 can be understood as an "earhole open type", unlike earphones in the related art.

The holding portion 130 is arranged to be coupled to the intertragic notch of the ear near the ear canal entrance. More preferably, the holding portion 130 supports the vicinity of the other end (the sound output hole 121) of the sound guide portion 120 so that the sound output hole 121 faces the inner side of the ear canal. In addition, the holding portion 130 is an annular structure provided with an opening portion that opens the entrance (earhole) of the ear canal to the outside. In the example illustrated in FIGS. 1 to 3, the holding portion 130 is configured in the form of a ring-shaped structure, and all the portions than the ring are opening portions, making the listener's earhole open to the outside. However, the holding portion 130 is not limited to the ring-shaped structure, and can have any shape other than the ring as long as the sound output hole 121 at the other end of the sound guide portion 120 can be supported to open the earhole. The holding portion 130 arranged to be coupled to the intertragic notch of the ear allows the other end of the sound guide portion 120 supported by the holding portion 130 to be prevented from falling due to gravity. In other words, the sound device 100 is prevented effectively from falling from the ear. Thus, this makes it unnecessary, for the prevention of the sound device 100 from falling from the ear, to have an earpiece structure arranged in the ear canal due to friction caused by contact with the inner wall of the ear canal or a hanger structure arranged to hang the sound device 100 from above the ear.

The holding portion 130 is arranged to be coupled to the intertragic notch of the ear near the entrance of the ear canal. Thus, the holding portion 130 is capable of fixing the sound output hole 121 of the sound guide portion 120 to the vicinity of the entrance of the ear canal. The holding portion 130 is capable of positioning the sound output hole 121 so that the sound output hole 121 can radiate sound to the inner side of the ear canal of the earhole. In addition, the holding portion 130 has a structure for picking up ambient sound from the ring-shaped opening to the entrance of the ear canal.

The sound guide portion 120 having a tubular shape, when picking up the sound generated by the micro-speaker in the main body 110 at one end thereof, propagates the air vibration. Then, the tubular sound guide portion 120 radiates it from the sound output hole 121 of the other end held by the holding portion 130 at the vicinity of the entrance of the ear canal toward the ear canal to reach the eardrum.

The holding portion 130 is capable of making the listener's earhole open to the outside even upon being coupled to the intertragic notch of the ear near the ear canal entrance. Thus, the listener is able to hear satisfactorily the ambient sound through the opening of the holding portion 130 even while listening to the sound generated from the internal of the main body 110 of the sound device 100 attached to the listener's ear, as illustrated in FIG. 1.

In the ear canal, an internal microphone 122 intended to pick up sound is installed near the sound output hole 121. In addition, an external microphone 123 intended to pick up ambient sound (or sound generated outside the earhole) is installed on a surface of the sound guide portion 120 near the ear canal facing the outside. In an earhole hermetic state described later, the internal microphone 122 is arranged on the side of the ear canal, and the external microphone 123 is arranged on the outside.

The internal and external microphones 122 and 123 are used for measuring acoustic characteristics. In one example, it is possible to use the internal microphone 122 for feedback noise cancellation and to use the external microphone 123 for feedforward noise cancellation (e.g., see Patent Document 3). A feedforward cancellation signal that cancels the ambient sound leaking into the ear canal is generated on the basis of the ambient sound picked up by the external microphone 123. In addition, the internal microphone 122 measures the leaking ambient sound that failed to be removed by the cancellation signal in the ear canal and generates a feedback cancellation signal on the basis of the measurement result. In one example, the feedforward and feedback cancellation signals are superimposed on the reproduced sound generated from the micro-speaker in the main body 110 and are output. In particular, in the earhole hermetic state, there is a high effect on the feedforward noise cancellation using the external microphone 123.

Further, the frequency responses of the internal microphone 122 and the external microphone 123 are handled separately depending on the earhole open/close state. This is because the internal and external microphones 122 and 123 pick up substantially the same sound in the earhole open state. However, in the earhole hermetic state, the internal microphone 122 easily picks up the reproduced sound in the closed space but fails to pick up most of the ambient sound. In contrast, the external microphone 123 still easily picks up the ambient sound but is difficult to pick up the reproduced sound. Thus, the frequency spectra of the sound picked up by the internal microphone 122 and the external microphone 123 in the earhole close state are clearly different. In particular, the difference in frequency responses between the internal microphone 122 and the external microphone 123 is remarkable in the noise level in the low-frequency range. It is possible to control the earhole close state of the sound device 100 on the basis of such a difference in frequency responses, but a detailed description thereof will be given later.

However, the internal microphone 122 and the external microphone 123 can be used for other purposes. In one example, they can be used to collect the wearer's utterance or record the ambient sound.

Further, the main body 110 has a relatively large accommodation space, so the main body 110 can include a device such as a sensor and an actuator, a signal processing circuit, a wireless module, or the like in addition to the micro-speaker as mentioned above. In one example, various sensors, such as biometric sensor including human body temperature sensors, perspiration sensors, and myoelectric sensors, can be disposed in the main body 110.

Further, in the examples illustrated in FIGS. 1 to 3, the main body 110 has a disk-like shape but has a relatively large surface area. The present embodiment is based on the assumption that a user interface (UI) operation unit 111 or a fingerprint authentication unit 112 using a touch sensor or the like is installed on the upper surface portion of the main body 110 or that a proximity sensor 113 is disposed on the bottom surface portion thereof. The proximity sensor 113 comes into contact with the wall surface of the auricle when the holding portion 130 is attached to the earhole, so the detection result obtained by the proximity sensor 113 can be used for attachment detection of the sound device 100 (described later).

In the state where the sound device 100 shown in FIGS. 1 to 3 is attached to the listener's ear, the sound device 100 has a feature that the main body 110 is hidden at the medial surface of the auricle to be unnoticeable. Thus, it seems to the people around the listener that the listener's earhole is not blocked (as mentioned above). By taking advantage of such features, the sound device 100 is applicable to various sports fields (such as during play or remote coaching) performed outdoor and indoor including walking, jogging, cycling, mountain climbing, skiing, and snowboarding. The sound device 100 is also applicable to the communication or presentation field that necessitates listening to ambient sound and presenting of speech information simultaneously (e.g., such as supplementary information upon theater performance, presentation of museum audio guide information, birdwatching (listening to birdcall)), driving or navigation, guards, newscasters, or the like.

B. Opening/Closing Mechanism of Earhole

B-1. Fundamental Structure

The sound device 100 illustrated in FIGS. 1 to 3 is fundamentally an earhole open type, but is difficult to hear the reproduced sound under high noise. Conversely, in a quiet environment, the reproduced sound can leak to the surroundings, so there is a possibility that the surrounding people can hear details of the content being played. Besides, there is a concern that the open type is relatively difficult to reproduce the sound of a low-frequency range due to its structure as compared with a hermetic type sound device.

Thus, the sound device 100 is further provided with a mechanism for adjusting the degree of opening or closing of the earhole in a short time and is configured to be able to control how the ambient sound is heard.

Specifically, the ring-shaped holding portion 130 is provided with an inflatable balloon configured as a flexible material such as an elastomer or silicon rubber, and the main body 110 is equipped with a micropump that produces the pressure by gas or liquid together with the micro-speaker. Then, in one example, by pumping or sucking air or liquid to or from the balloon described above through the sound guide portion 120 that functions both as a sound conduit and a pressure pipe, it is possible to increase or decrease the size of the opening at the center of the holding portion 130. Thus, it is possible to adjust the degree of opening or closing of the earhole in a short time.

Figure 4:
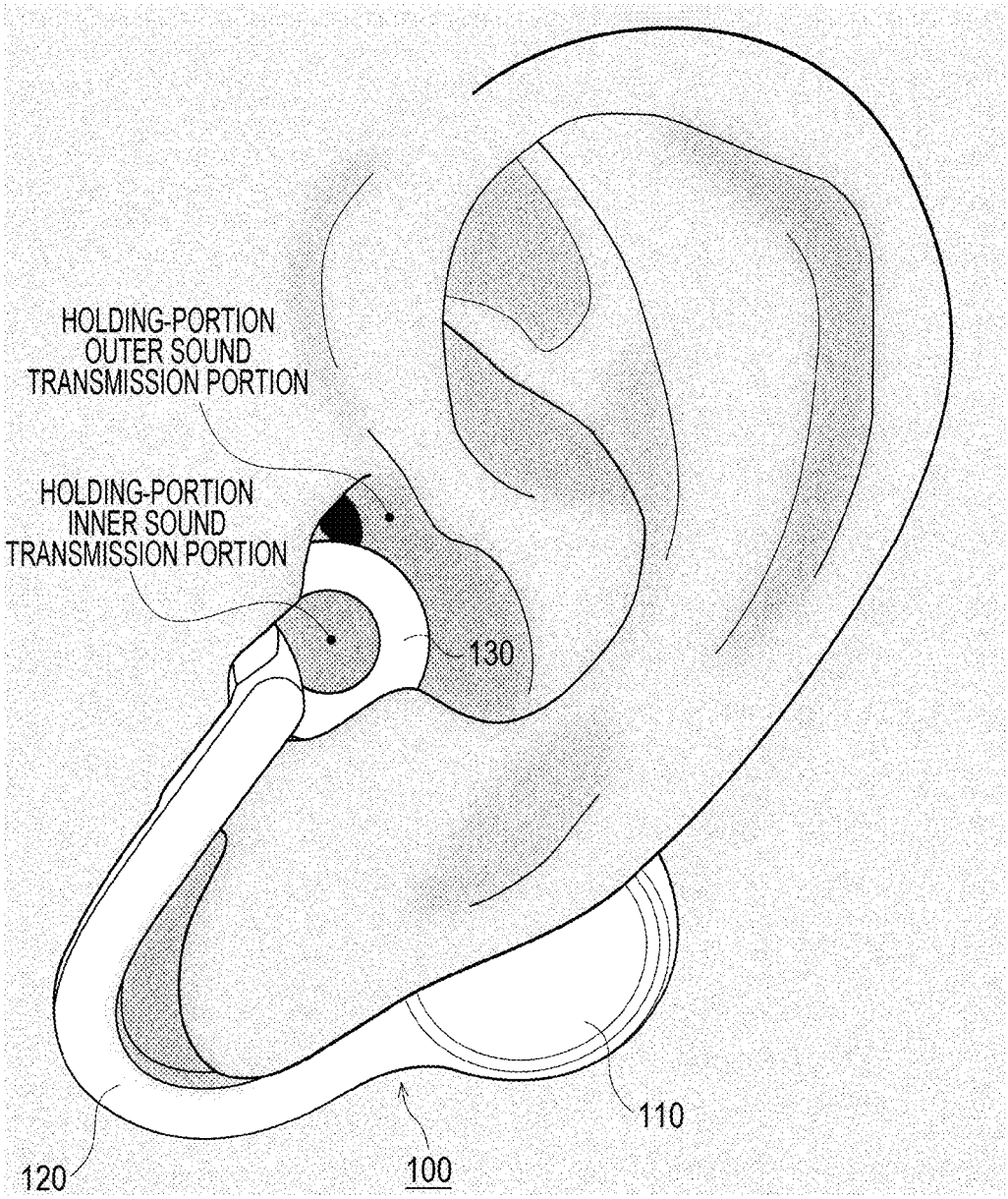
FIG. 4 is a view illustrating the appearance of the sound device 100 attached to the left ear of the listener in an earhole open state.
Figure 5:
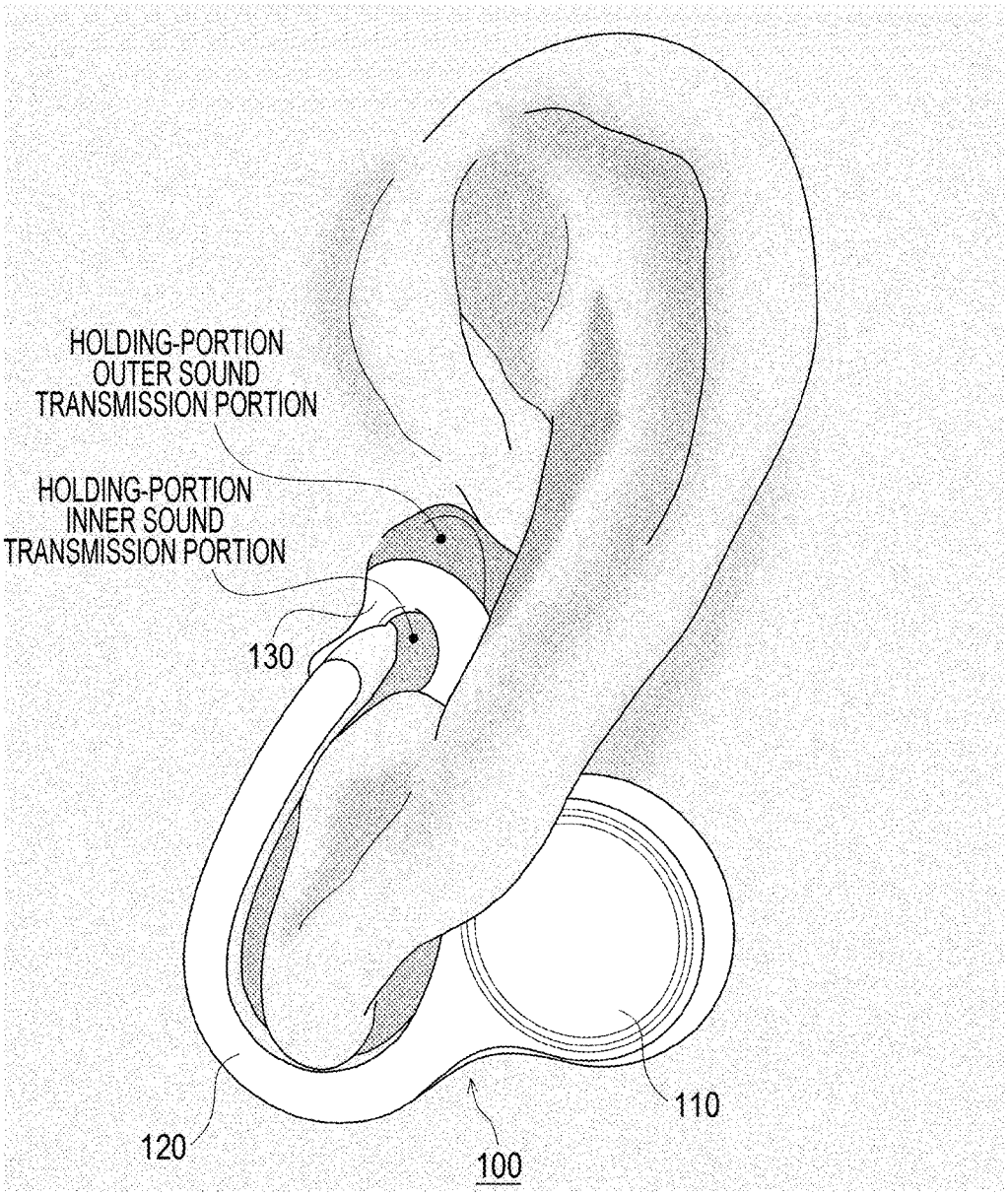
FIG. 5 is a view illustrating the appearance of the sound device 100 attached to the left ear of the listener in an earhole open state.
Figure 6:
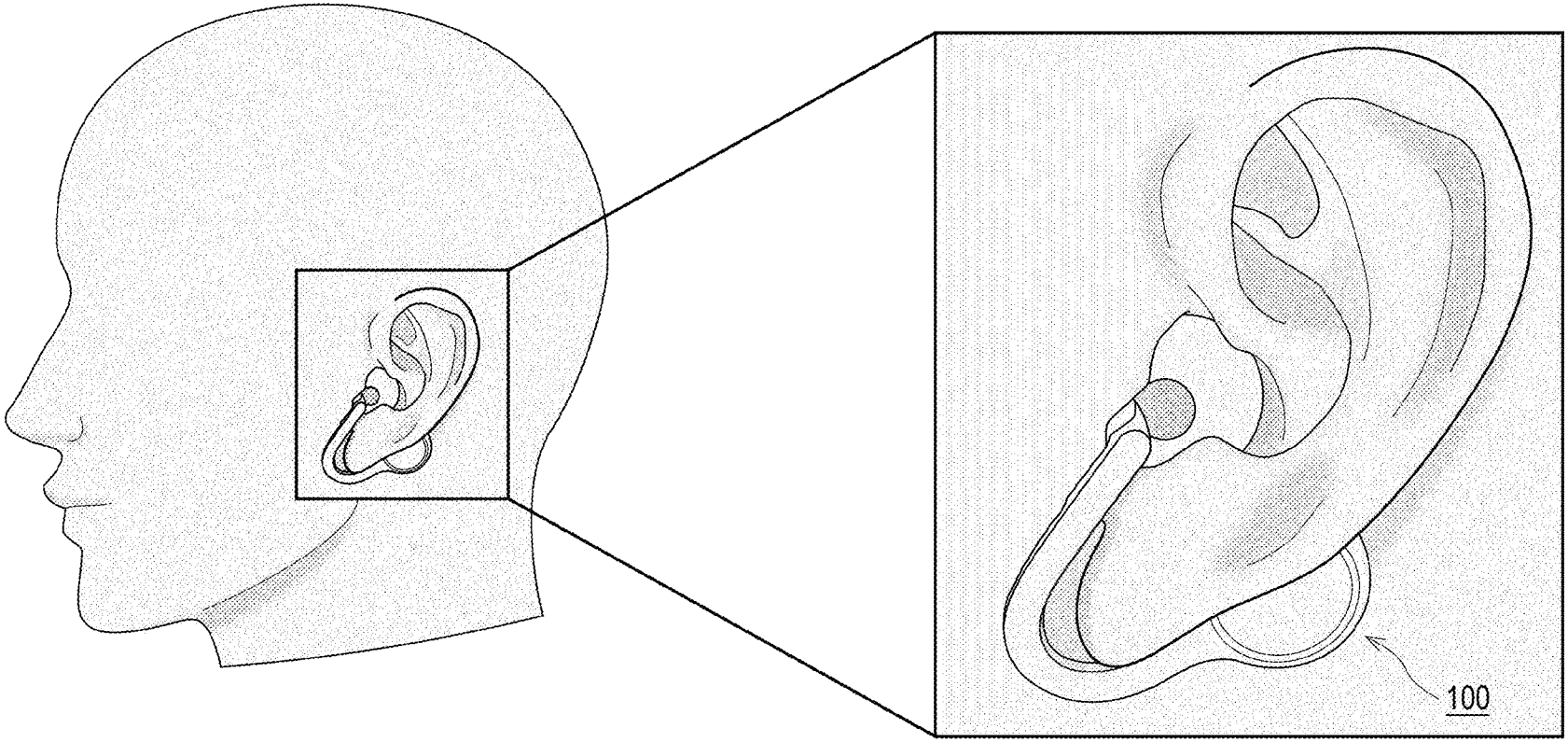
FIG. 6 is a view illustrating the outer configuration of the sound device 100 (intermediate state).

FIGS. 4 and 5 illustrate the outer configuration of the sound device 100 in a state where the holding portion 130 makes the earhole substantially open. On the other hand, FIG. 6 illustrates the outer configuration of the sound device 100 in a state in which the holding portion 130 is in a substantially intermediate state between opening and closing. In addition, FIG. 7 illustrates the outer configuration of the sound device 100 in a state where the holding portion 130 makes the earhole substantially close.

As illustrated in FIGS. 4 and 5, in the earhole open state, a "holding-portion inner acoustic transmission portion" that allows ambient sound to pass through the ear canal inside the ring-shaped holding portion 130 is formed. In addition, a "holding-portion outer acoustic transmission portion" that allows ambient sound to pass through the ear canal outside the holding portion 130 is formed. Thus, in the earhole open state, it is possible to achieve a feature that the ambient sound can be heard naturally even while wearing the sound device 100.

Figure 7:
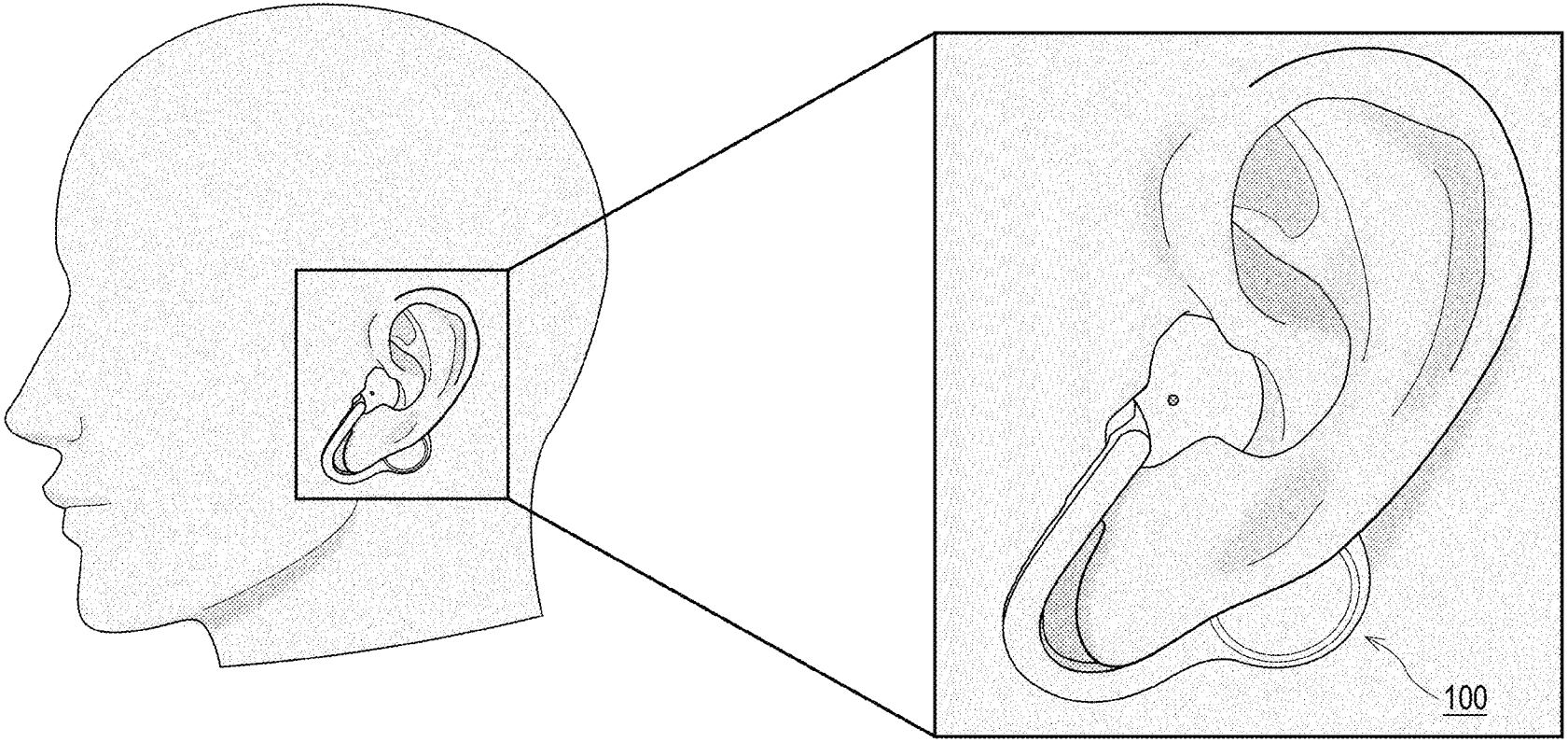
FIG. 7 is a view illustrating the outer configuration of the sound device 100 (earhole close state).

On the other hand, FIG. 7 illustrates the earhole close state where the holding-portion inner acoustic transmission portion and the holding-portion outer acoustic transmission portion substantially disappear. The sound device 100 in the earhole close state is capable of blocking ambient sound and making it easier to listen to the reproduced sound even under high noise, improving the reproduction performance in the low-frequency range. In addition, it is possible to prevent the reproduced sound in the earhole close state from leaking to the outside in a quiet environment. In addition, FIG. 6 illustrates an intermediate state where the holding-portion inner acoustic transmission portion and the holding-portion outer acoustic transmission portion are retracted to some extent. The sound device 100 in the intermediate state is capable of listening to the reproduced sound while blocking the ambient sound appropriately or listening to the reproduced sound while appropriately listening to the ambient sound.

A specific configuration example of the mechanism for opening and closing the earhole is now described.

Figure 8:
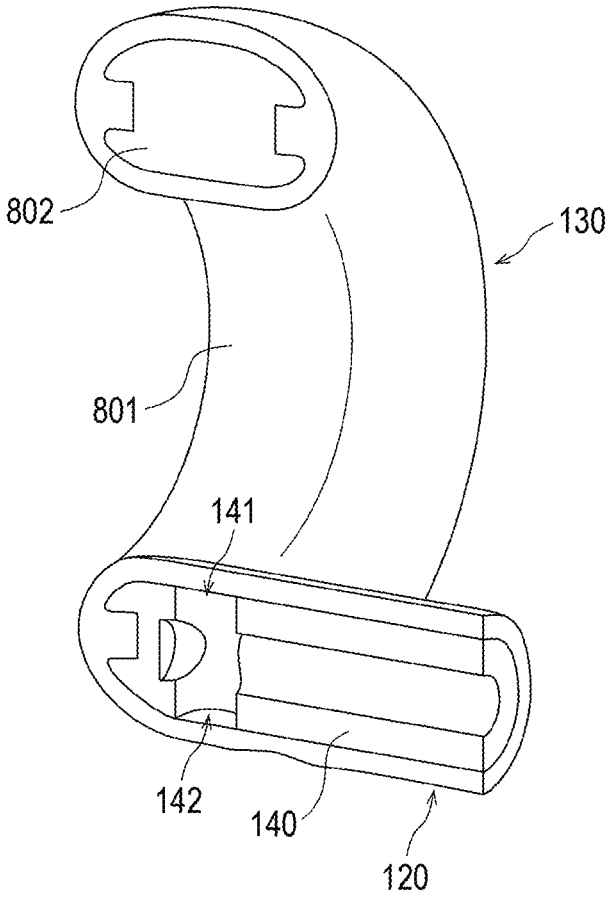
FIG. 8 is a view illustrating a cross-sectional configuration example (with earhole open) of a holding portion 130 and a pressure pipe 140.
Figure 9:
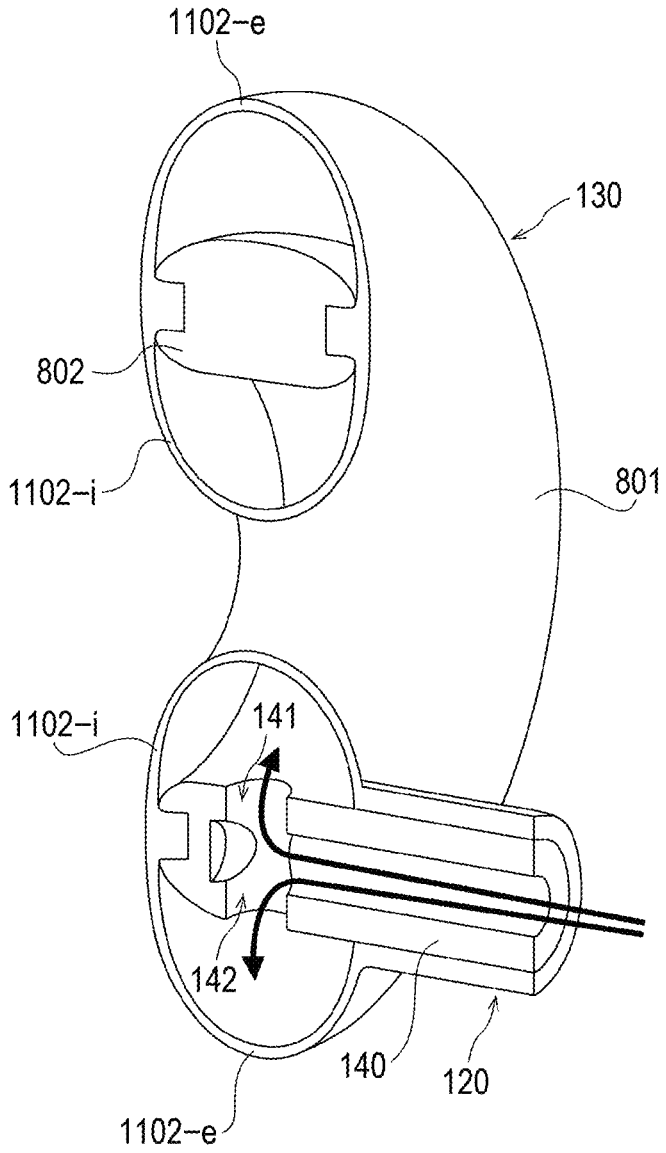
FIG. 9 is a view illustrating a cross-sectional configuration example (intermediate state) of the holding portion 130 and the pressure pipe 140.
Figure 10:
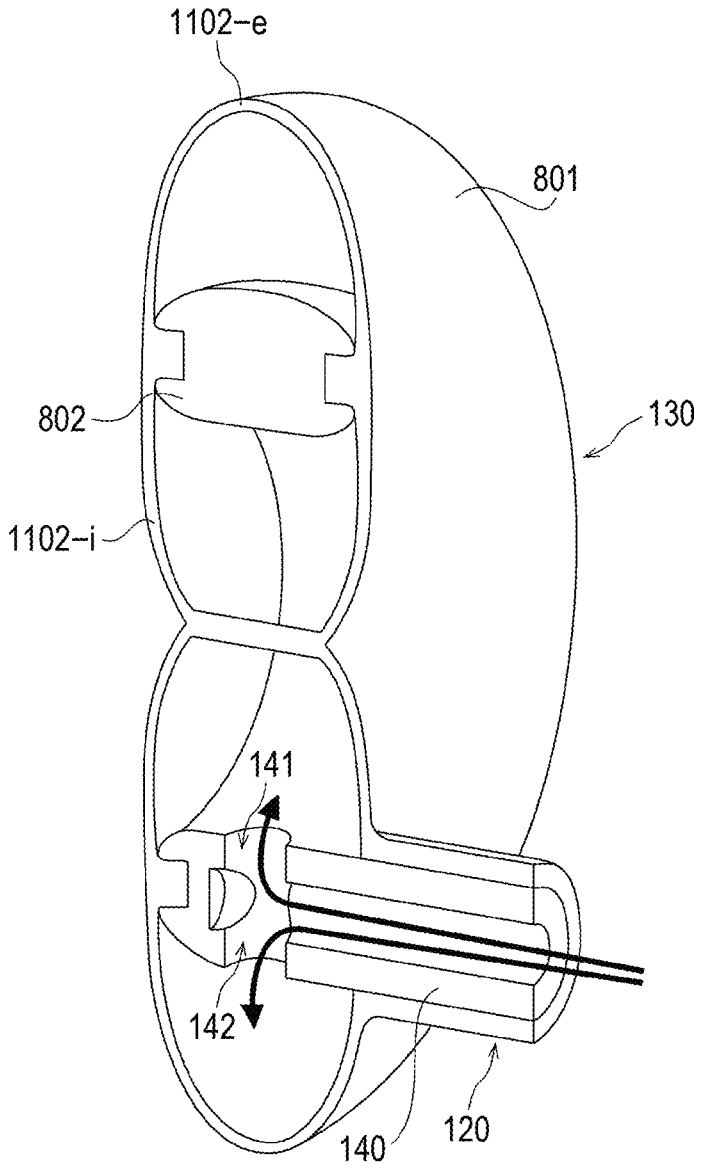
FIG. 10 is a view illustrating a cross-sectional configuration example (earhole Heisei state) of the holding portion 130 and the pressure pipe 140.

FIGS. 8 to 10 illustrate a cross-sectional configuration example of the holding portion 130 and the pressure pipe 140. Specifically, FIG. 8 illustrates a cross-sectional configuration of the holding portion 130 and the pressure pipe 140 in the state of making the earhole substantially open. FIG. 9 illustrates a cross-sectional configuration of the holding portion 130 and the pressure pipe 140 in the substantially intermediate state between opening and closing. FIG. 10 illustrates the cross-sectional configuration of the holding portion 130 and the pressure pipe 140 in the state of making the earhole substantially close.

The holding portion 130 includes a hollow and ring-shaped balloon portion 801 and a ring frame 802 inserted into the hollow and ring-shaped balloon portion 801. The balloon portion 801 includes a flexible and inflatable material such as an elastomer or silicone rubber. In addition, the ring frame 802 includes a highly rigid material such as plastic or high-hardness silicon rubber and maintains the ring-shaped shape of the holding portion 130.

Further, the end portion (output end) of the pressure pipe 140 penetrating in the sound guide portion 120 is coupled to the balloon portion 801. When the micropump in the main body 110 pumps or sucks air or liquid to or from the balloon portion 801 through the pressure pipe 140, the inflatable balloon portion 801 expands or contracts in a short time. Thus, the holding portion 130 is capable of making a reversible transition among the earhole open state illustrated in FIG. 8, the intermediate state illustrated in FIG. 9, and the earhole close state illustrated in FIG. 10 in a short time.

Figure 11:
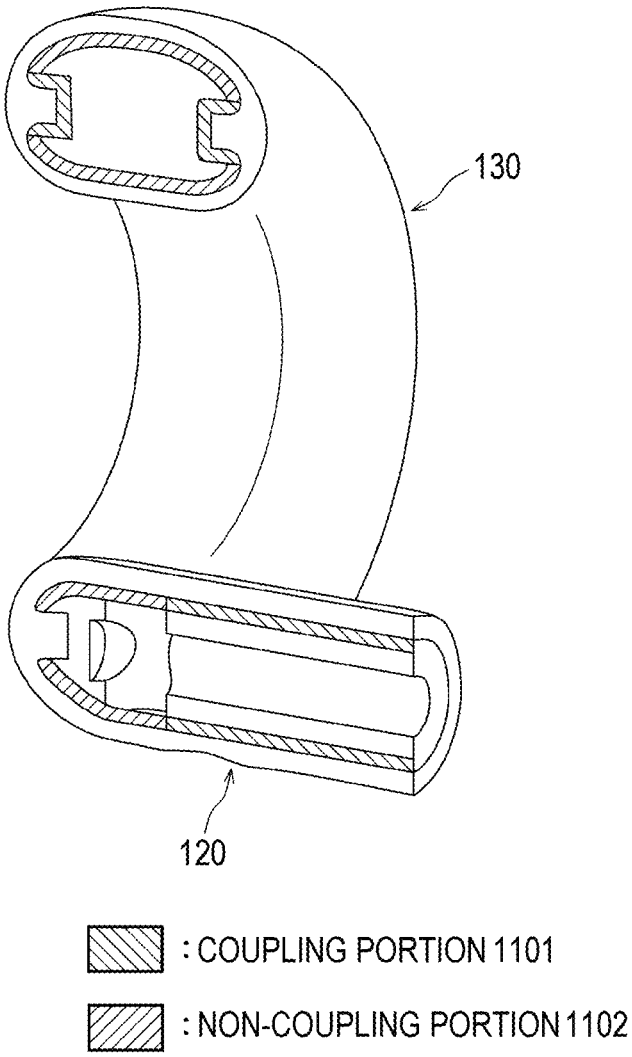
FIG. 11 is a view illustrating a coupling portion 1101 and a non-coupling portion 1102 between the inner circumference of a balloon portion 801 and the surface of a ring frame 802.

FIG. 11 illustrates a coupling portion 1101 and a non-coupling portion that are provided in the balloon portion 801 by using the cross sections of the holding portion 130 and the pressure pipe 140 in the earhole open state as in FIG. 8. The coupling portion 1101 is a portion in which the balloon portion 801 is fixed or adhered to the surface of the ring frame 802. In addition, the non-coupling portion 1102 is a portion in which the balloon portion 801 is not fixed to the surface of the ring frame 802. The non-coupling portion 1102 is divided into an inner side 1102-*i* and an outer side 1102-*e* of the ring frame 802. The coupling portion 1101 is formed at two positions in the middle of the non-coupling portions 1102 on both sides. At the end of one pressure pipe 140, two output holes 141 and 142 are bored to connect to the inner non-coupling portion 1102-*i* and the outer non-coupling portion 1102-*e*, respectively (refer to FIGS. 13 to 15).

In the coupling portion 1101, the inner circumference of the balloon portion 801 and the surface of the ring frame 802 are fixed or adhered to each other. Thus, the case where the micropump in the main body 110 pumps air or liquid to the balloon portion 801 through the pressure pipe 140 or the case where the micropump in the main body 110 sucks air from the balloon portion 801 through the pressure pipe 140 occurs. Even in these cases, the inner circumference of the balloon portion 801 and the surface of the ring frame 802 remain in close contact with each other, and so peeling does not occur in the coupling portion 1101. Thus, as can be seen from FIGS. 9 and 10, even if the micropump in the main body 110 pumps air or liquid through the pressure pipe 140, the balloon portion 801 remains fixed to the ring frame 802 in the coupling portion 1101. The holding portion 130 remains in its shape conforming to the contour shape of the ring frame 802.

On the other hand, in the non-coupling portion 1102, the inner circumference of the balloon portion 801 and the surface of the ring frame 802 are neither fixed nor adhered to. Thus, when the micropump in the main body 110 pumps air or liquid to the balloon portion 801 through the pressure pipe 140, in the non-coupling portion 1102, the balloon portion 801 detaches from the surface of the ring frame 802 and expands as can be seen from FIGS. 9 and 10. In addition, when the micropump in the main body 110 sucks air from the balloon portion 801 through the pressure pipe 140, in the non-coupling portion 1102, the balloon portion 801 contracts and comes into close contact with the surface of the ring frame 802, as can be seen from FIG. 8. Thus, the holding portion 130 retracts until it has substantially the shape identical to the contour of the ring frame 802.

Figure 13:
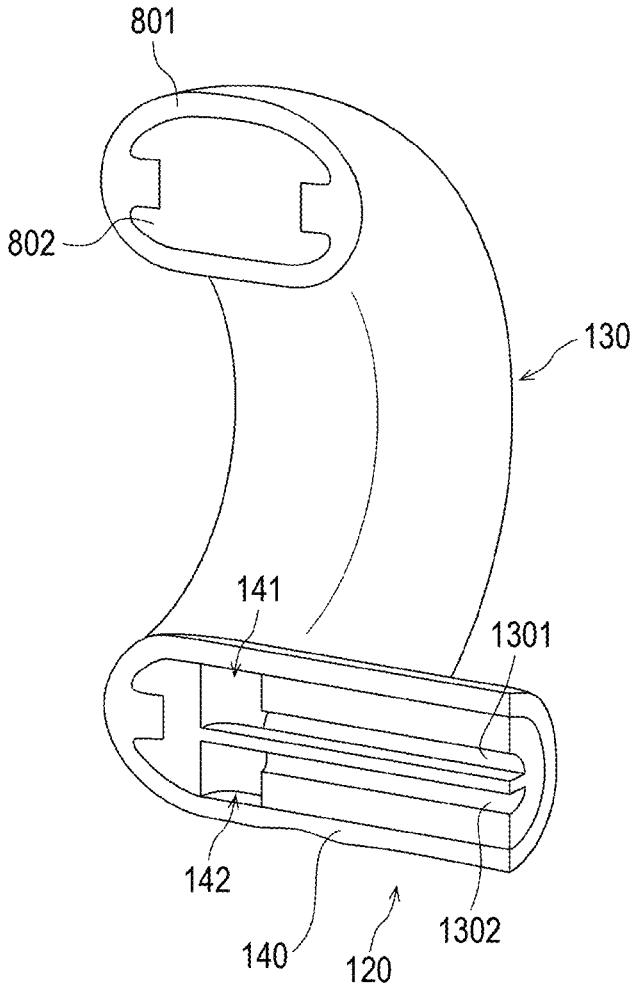
FIG. 13 is a view illustrating a configuration example of independently driving the inside and the outside of a ring by using two pressure pipes.
Figure 14:
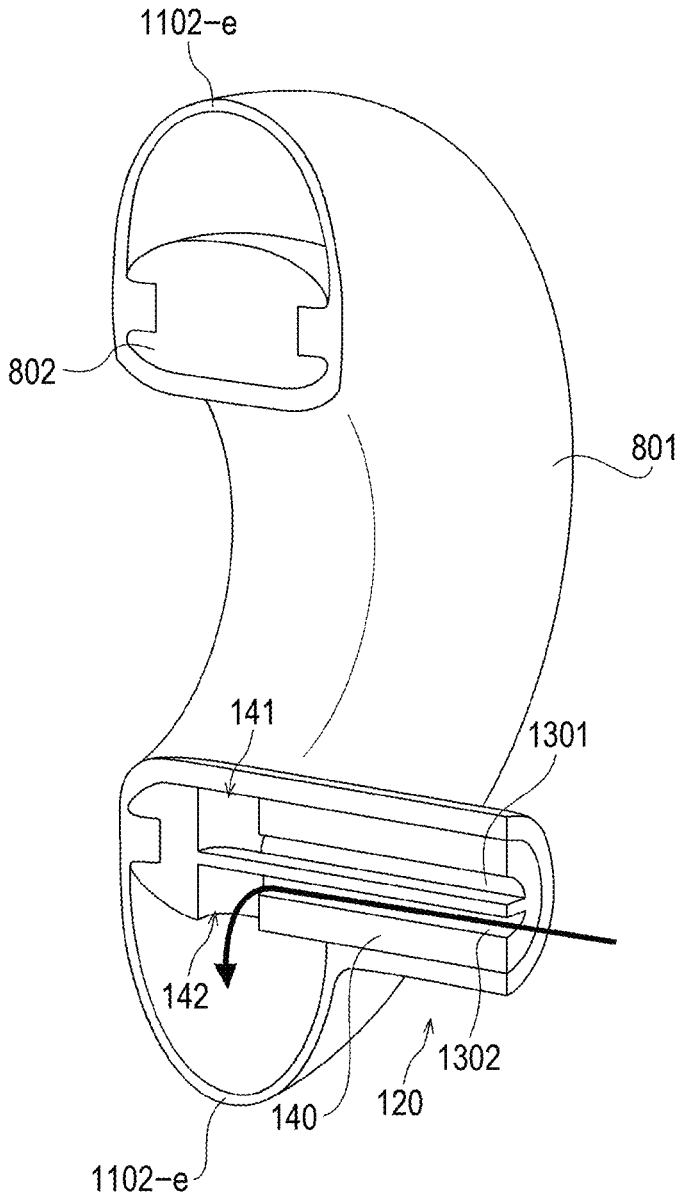
FIG. 14 is a view illustrating a configuration example of independently driving the inside and the outside of the ring (an example of expanding only the outside of the ring) by using two pressure pipes.
Figure 15:
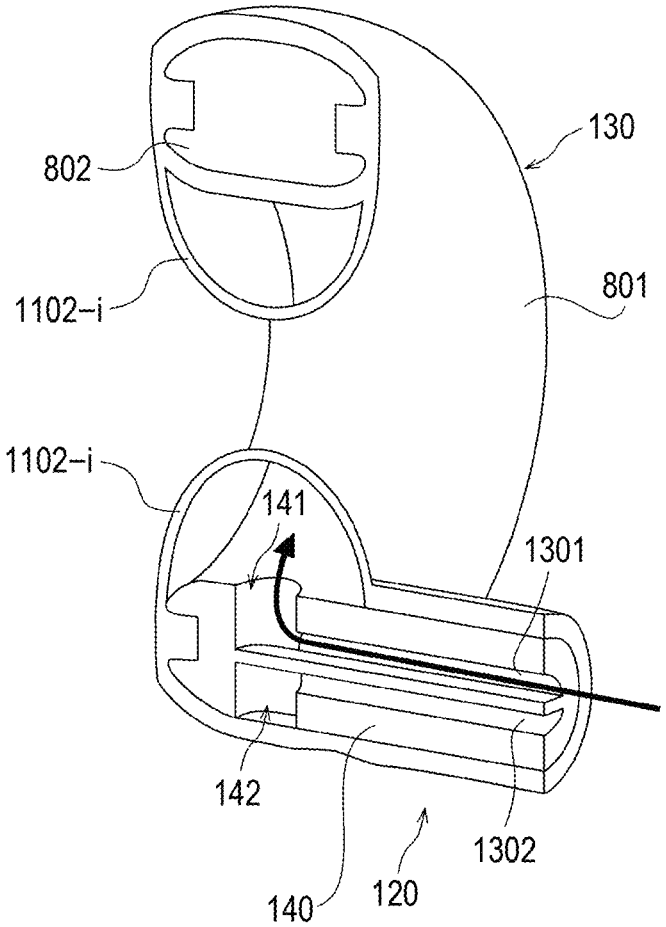
FIG. 15 is a view illustrating a configuration example of independently driving the inside and the outside of the ring (an example of expanding only the inside of the ring) by using two pressure pipes.

Further, in the examples illustrated in FIGS. 8 to 10, at the end of one pressure pipe 140, two output holes 141 and 142 are bored to connect to the inner non-coupling portion 1102-*i* and the outer non-coupling portion 1102-*e*, respectively (refer to FIGS. 13 to 15). The micropump applies pressure substantially evenly to the inner non-coupling portion 1102-*i* and the outer non-coupling portion 1102-*e*. Thus, when the micropump pumps or sucks air or liquid to or from the balloon portion 801 through the pressure pipe 140, the balloon portion 801 expands or contracts substantially evenly at the inner non-coupling portion 1102-*i* and the outer non-coupling portion 1102-*e*.

When the micropump in the main body 110 pumps air or liquid to the balloon portion 801 through the pressure pipe 140, the balloon portion 801 expands toward the center of the ring shape, inside the ring frame 802, as illustrated in FIGS. 9 and 10. Then, the "holding-portion inner acoustic transmission portion" retracts, and the balloon portion 801 expands in the radial direction of the ring shape on the outside of the ring frame 802, so the "holding-portion outer acoustic transmission portion" retracts.

In this regard, the micropump pumps a certain amount of air to the holding portion 130 illustrated in FIG. 9 through the pressure pipe 140, so the balloon portion 801 expands to some extent in the central direction and the radial direction of the ring. The holding portion 130 in this state corresponds to the intermediate state in which the "holding-portion inner acoustic transmission portion" and the "holding-portion outer acoustic transmission portion" retract, as illustrated in FIG. 6.

Further, the micropump pumps a large amount of air to the holding portion 130 illustrated in FIG. 10 through the pressure pipe 140, so the balloon portion 801 expands to the maximum in the central direction and the radial direction of the ring. The holding portion 130 in this state corresponds to the earhole close state in which the "holding-portion inner acoustic transmission portion" and the "holding-portion outer acoustic transmission portion" substantially disappear, as illustrated in FIG. 7.

Figure 12:
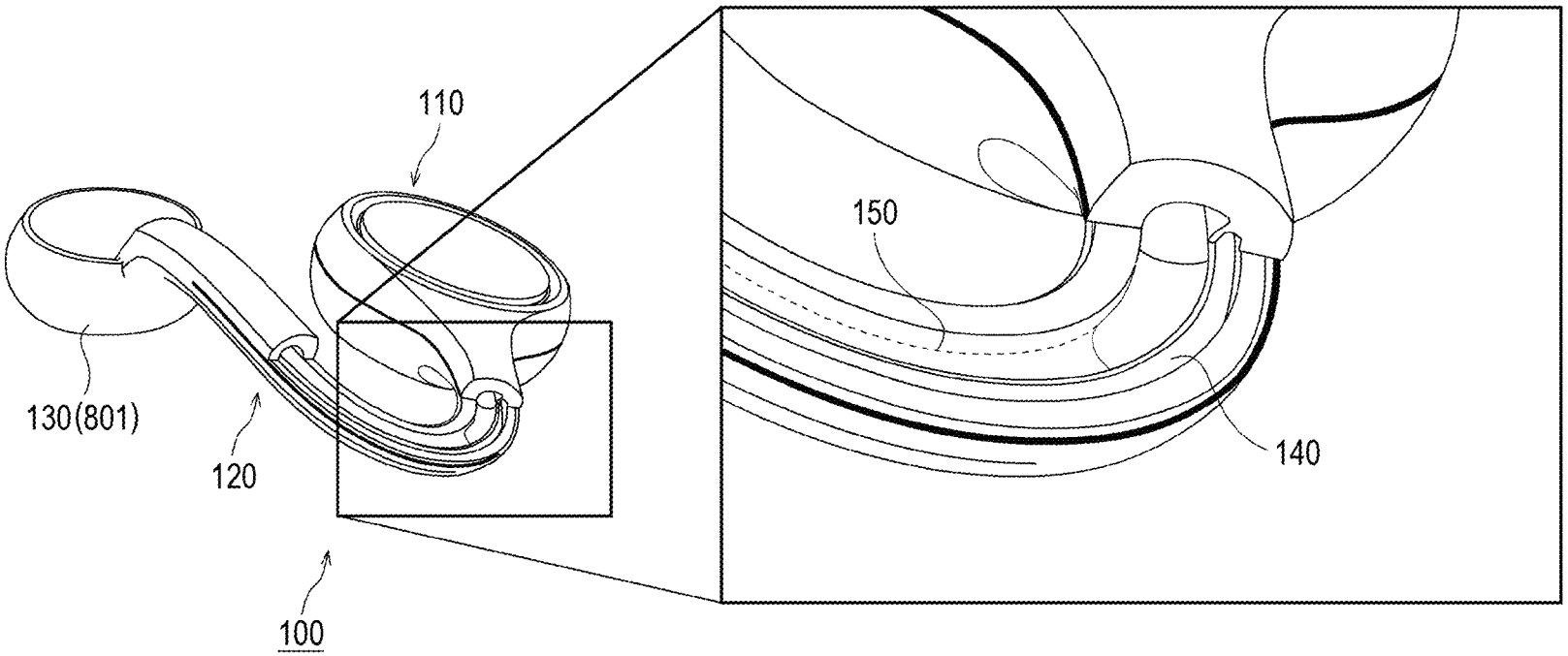
FIG. 12 is a view illustrating a cross-sectional configuration example of a sound guide portion 120.

The sound guide portion 120 also functions as a sound conduit for propagating the reproduced sound generated by the micro-speaker and a pressure pipe for pumping or sucking air or liquid by the action generated by the micropump (as described above). FIG. 12 illustrates a cross-sectional configuration example of the sound guide portion 120 near the main body 110. The sound conduit 150 and the pressure pipe 140 are provided penetratingly through the sound guide portion 120 in the longitudinal direction individually. The sound guide portion 120 has one end coupled to the main body 110 and the other end supported by the holding portion 130. The sound conduit 150 has one end coupled to an output portion of the micro-speaker (not shown) in the main body 110 and the other end having the sound output hole 121 formed thereon. In addition, the pressure pipe 140 has one end coupled to the output portion of the micropump (not shown) in the main body 110 and the other end coupled to the balloon portion 801 (see FIGS. 6 to 10).

B-2. Expansion Structure

In the configuration example illustrated in FIGS. 8 to 10, one pressure pipe 140 applies the same pressure to both the inner non-coupling portion 1102-*i* and the outer non-coupling portion 1102-*e* of the balloon portion 801. Thus, the balloon portion 801 expands toward the center inside the ring frame 802, and at the same time, expands in the radial direction outside the ring frame 802. In addition, in the balloon portion 801, when the inside of the ring frame 802 contracts, the outside of the ring frame 802 also contracts simultaneously. However, how to apply the action of pressure to the balloon portion 801 is not limited to this example.

FIGS. 13 to 15 illustrate a cross-sectional configuration example of the holding portion 130 and the sound guide portion 120 so that pressure is applied to the inner non-coupling portion 1102-*i* and the outer non-coupling portion 1102-*e* individually using two pressure pipes 1301 and 1302 penetrating through the sound guide portion 120.

The pressure pipe 1301 has the output hole 141 connected to the inner non-coupling portion 1102-*i* of the balloon portion 801 and applies pressure generated from the micropump to the non-coupling portion 1102-*i* (i.e., for the inside of the ring). In addition, the pressure pipe 1302 has the output hole 142 connected to the outer non-coupling portion 1102-*e* of the balloon portion 801 and applies pressure generated from the micropump to the non-coupling portion 1102-*e* (i.e., for the outside of the ring).

Such a configuration makes it possible to expand or contract the inner non-coupling portion 1102-*i* and the outer non-coupling portion 1102-*e* of the balloon portion 801 independently. It is also certainly possible to expand or contract the inner non-coupling portion 1102-*i* and the outer non-coupling portion 1102-*e* simultaneously by allowing the two pressure pipes 1301 and 1302 to exert the same pressure action.

FIG. 14 illustrates how the holding portion 130 expands only to the outside of the ring by pumping air or liquid from the micropump to only the outer non-coupling portion 1102-*e* of the balloon portion 801 using only the pressure pipe 1302 for the outside of the ring. This corresponds to the intermediate state in which only the holding-portion outer acoustic transmission portion of the "holding-portion inner acoustic transmission portion" and the "holding-portion outer acoustic transmission portion" retracts.

Further, FIG. 15 illustrates how the holding portion 130 expands only to the inside of the ring by pumping air or liquid from the micropump to only the inner non-coupling portion 1102-I of the balloon portion 801 using only the pressure pipe 1301 for the inside of the ring. This corresponds to the intermediate state in which only the holding-portion outer acoustic transmission portion of the "holding-portion inner acoustic transmission portion" and the "holding-portion outer acoustic transmission portion" retracts.

Figure 16:
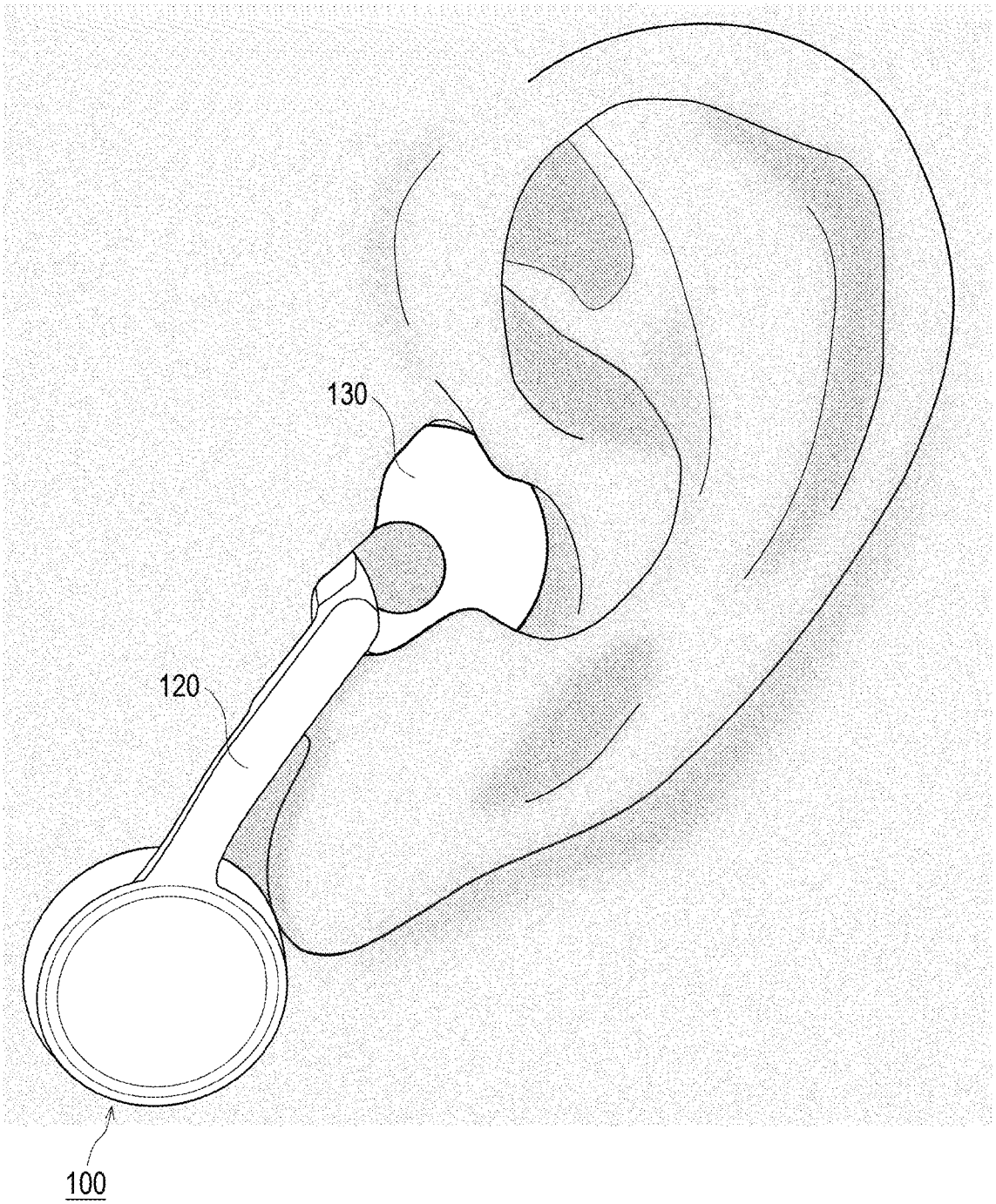
FIG. 16 is a view illustrating a modification of the sound device 100.

Moreover, expansion of the holding portion 130 to the outside of the ring, as illustrated in FIG. 14, allows it to be more securely fit into the cavity of concha from the helix leg to the intertragic notch, improving the listener's comfortability to wear. In addition, the holding portion 130 expanded to the outside of the ring is capable of engaging with the wall surface of the cavity of concha to receive a force sufficient to support the weight of the holding portion 130 from the surface of the auricle. The auricle is sandwiched between the sound guide portion 120, the main body 110, and the holding portion 130. The sound guide portion 120 has a bent shape as illustrated in FIG. 1 or other figures. The main body 110 and the holding portion 130 are positioned at both ends of the sound guide portion 120. Thus, even in this case, it is possible to support the sound device 100 not to fall off. In one example, as illustrated in FIG. 16, the sound device 100 can be configured so that the sound guide portion 120 has a substantially straight shape instead of the bent shape. By simply attaching the holding portion 130, which is expanded to the outside of the ring, to the cavity of concha, the sound device 100 can be attached to the auricle in a manner that it hangs from the intertragic notch.

B-3. Static Pressure Adjusting Mechanism

FIG. 10 illustrates the cross-sectional configuration of the holding portion 130 and the pressure pipe 140 in a state where the earhole is substantially closed. In such an earhole close state of the sound device 100, the ear canal is in the closed space, and in some cases, a barometric pressure difference will occur between the ear canal and the outside air. In addition, in the earhole close state, the low-frequency range of the reproduced sound emitted from the sound output hole 121 is strengthened. On the other hand, in the earhole open state as illustrated in FIG. 8, the low-frequency range of the reproduced sound emitted from the sound output hole 121 is weakened. Thus, it is preferable to equip a static pressure adjusting mechanism for making the static pressure in the ear canal and the outside air identical to each other in the earhole close state to equalize the reproduced sound.

Figure 17:
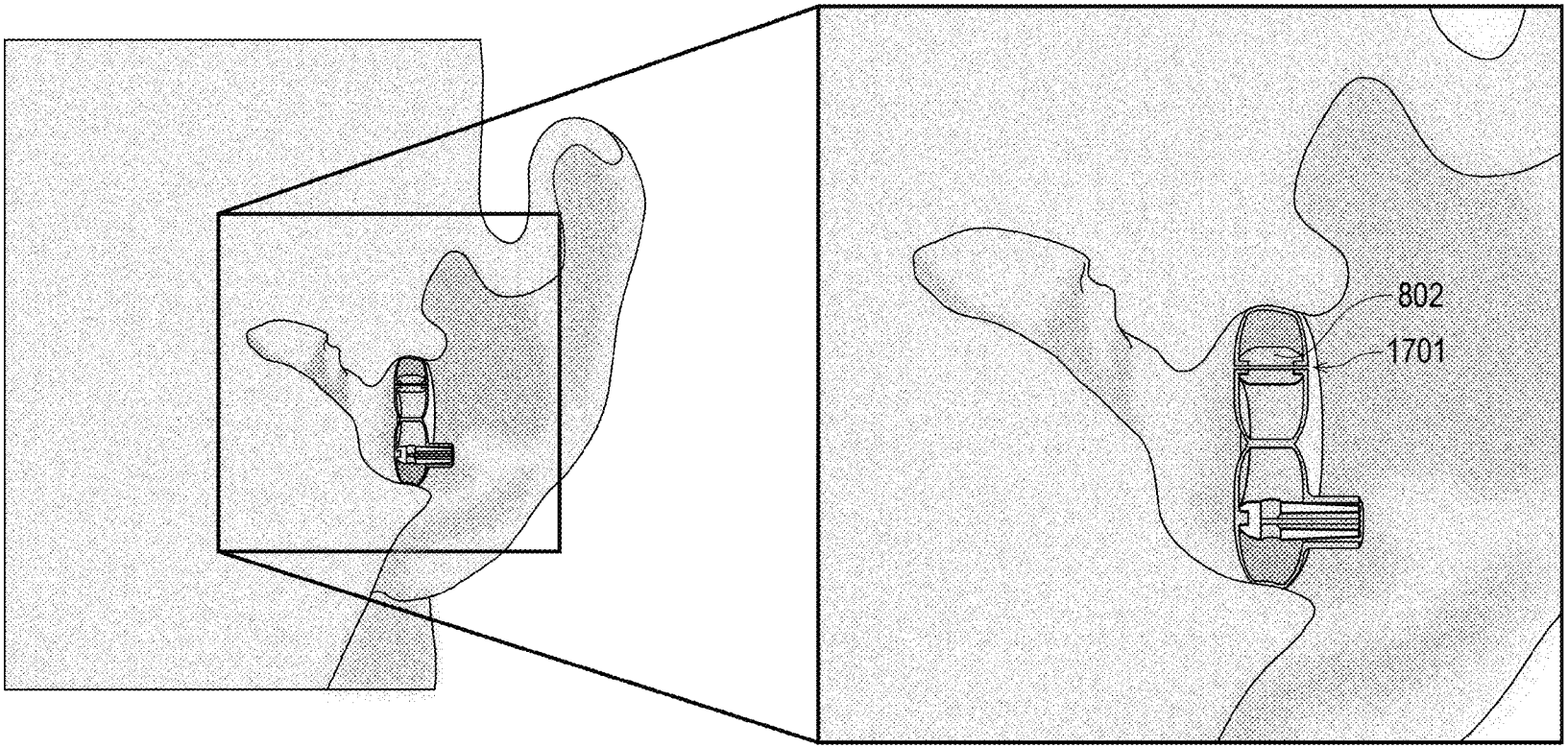
FIG. 17 is a view illustrating a cross-sectional configuration example of the holding portion 130 provided with a static pressure adjusting mechanism.

FIG. 17 illustrates a cross-sectional configuration example of the holding portion 130 equipped with the static pressure adjusting mechanism. In the illustrated example, the static pressure adjusting mechanism includes a thin tube 1701 bored in at least one location in the holding portion 130 (or the ring frame 802) to penetrate through the ear canal and the outside.

It is desirable that the thin tube 1701 is a transfer function that acoustically passes only (or greatly attenuates the audible range) the low-frequency range (20 Hz or less). In addition, it is preferable that the time constant of the fluctuation is not a too large value, so the thin tube 1701 can have the inner diameter of approximately 0.1 to 0.2 mm.

B-4. Other Earhole Opening/Closing Mechanisms

The description above is the earhole opening/closing mechanism that expands and contracts the balloon portion 801 by pumping or sucking air from the micropump to the balloon portion 801 attached to the outer circumference and the inner circumference of the ring-shaped holding portion 130, but not limited thereto.

Figure 18:
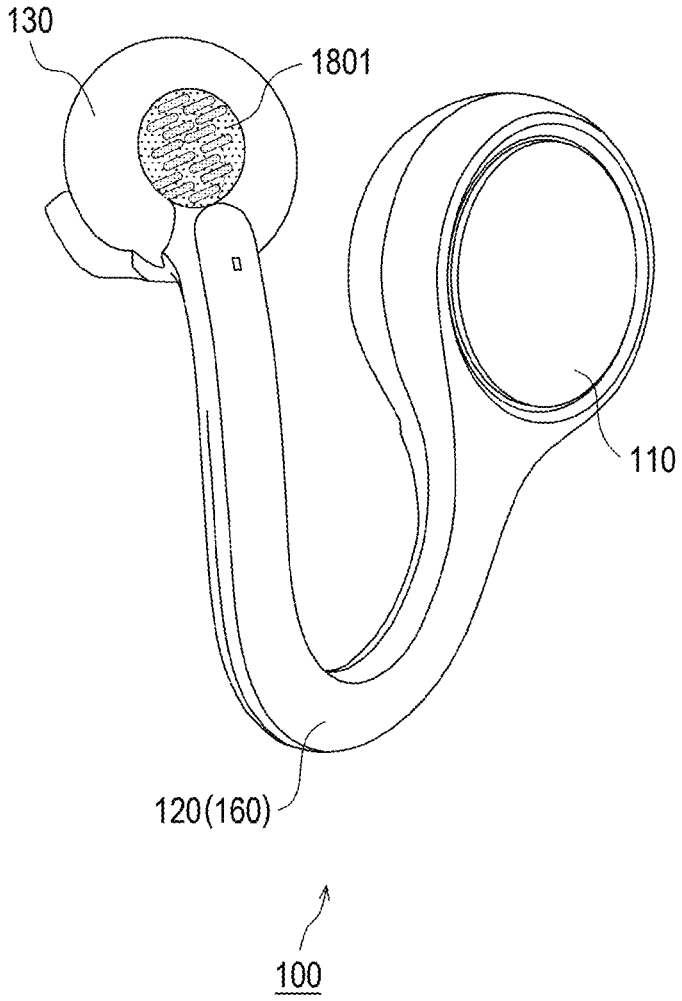
FIG. 18 is a view illustrating the outer configuration of an earhole open/close type sound device 100 using a piezoelectric porous membrane.

FIG. 18 illustrates the sound device 100 capable of opening and closing the earhole, which is configured by disposing a piezoelectric porous membrane 1801 capable of electrically controlling the acoustic transmittance inside a holding portion 130.

Figure 19:
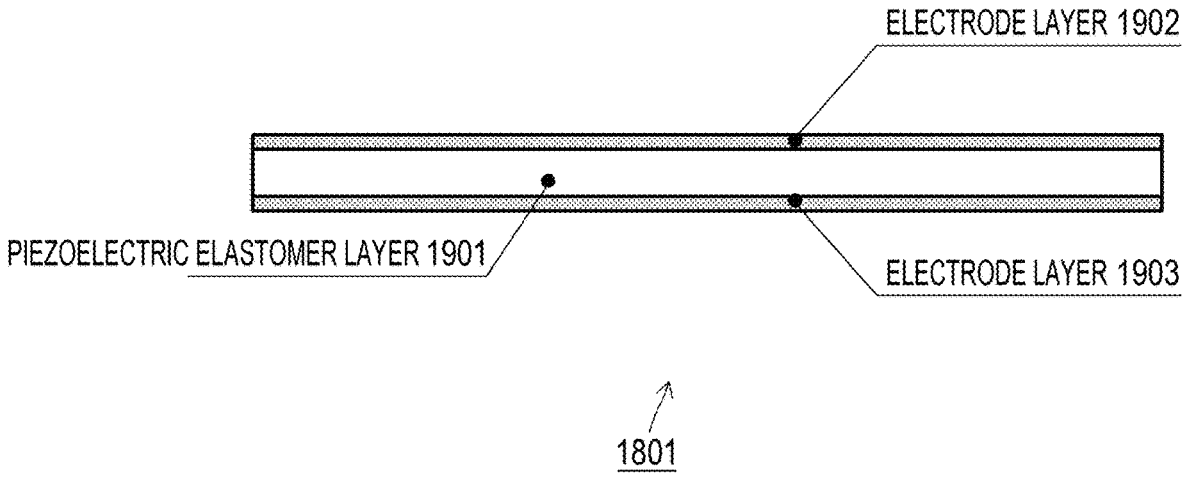
FIG. 19 is a diagram illustrating a cross-sectional configuration example of a piezoelectric porous membrane.

FIG. 19 illustrates a cross-sectional configuration example of the piezoelectric porous membrane 1801. The piezoelectric porous membrane 1801 is a multilayer film structure in which electrode layers 1902 and 1903 are respectively formed on both the front and back surfaces of a piezoelectric elastomer layer 1901 in which a large number of small holes (not shown) are bored. However, a large number of small holes are assumed to penetrate through all the layers 1901 to 1903 in the film thickness direction. In addition, each of the electrode layers 1902 and 1903 is assumed to be a flexible electrode capable of being deformed following the deformation of the piezoelectric elastomer layer 1901. As can be seen from FIG. 19, the piezoelectric porous membrane 1801 has a structure equivalent to a so-called condenser or capacitor.

In the main body 110, a high-voltage power supply unit (not shown) is disposed instead of the micropump, and a voltage supply line 160 is inserted into the sound guide portion 120 instead of the pressure pipe 140. The voltage from the high-voltage power supply unit is applied across the electrode layers 1902 and 1903 through the voltage supply line 160.

In a state where no voltage is applied across the electrode layers 1902 and 1903, a large number of small holes are opened, so the holding portion 130 (or the sound device 100) is in the earhole open state. On the other hand, when a high voltage is applied across the electrode layers 1902 and 1903, the accumulation of the positive and negative charges in each of the electrode layers 1902 and 1903 causes an attractive force. In this event, a force acts on the piezoelectric elastomer layer 1901 sandwiched between the electrode layers 1902 and 1903 in the direction in which the film is thinned in thickness, extending in the plane direction. Thus, a large number of small holes are closed, so the holding portion 130 (or the sound device 100) can be switched to the earhole close state.

Figure 20C:
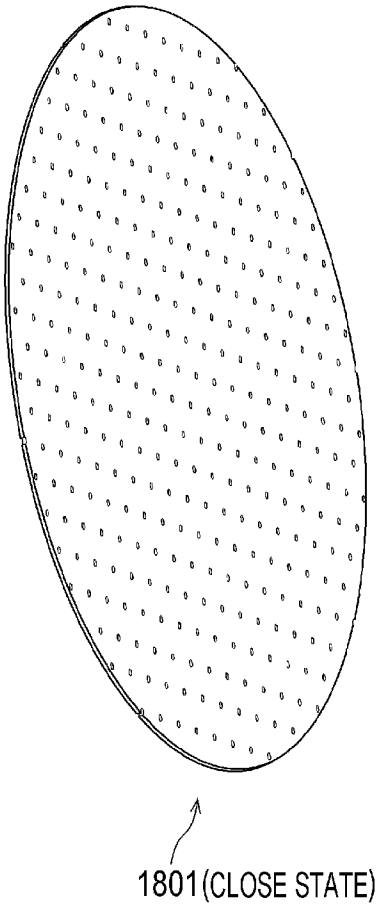
FIGS. 20A, 20B, and 20C are views illustrating how a piezoelectric porous film 1801 is deformed depending on a variation in the force acting in the film thickness direction.
Figure 20B:
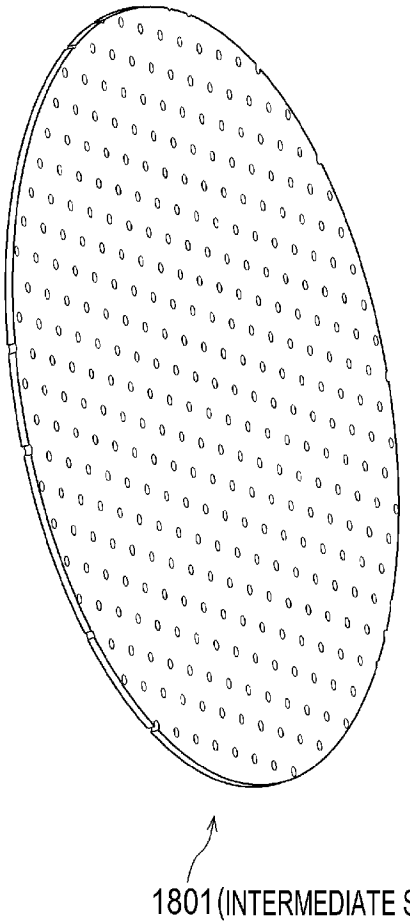
Figure 20A:
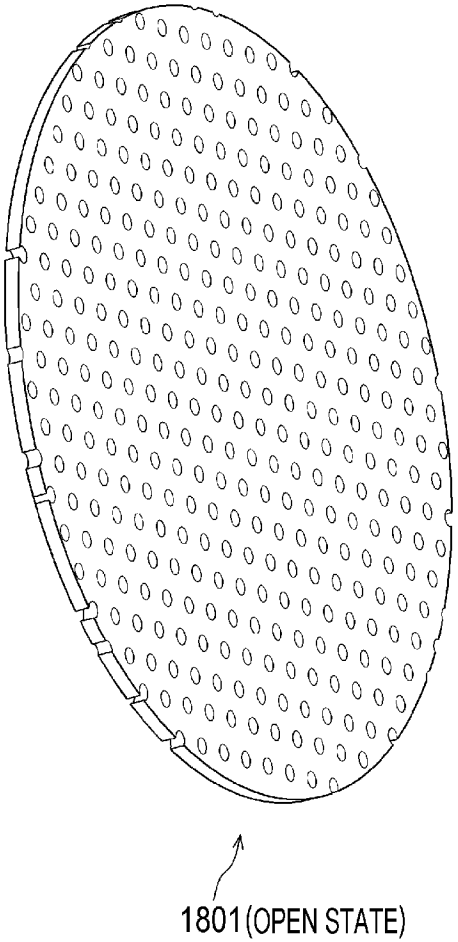

FIGS. 20A, 20B, and 20C illustrate how a piezoelectric porous film 1801 is deformed depending on a variation in the force acting in the film thickness direction.

FIG. 20A illustrates the state of a large number of small holes opened because no force is applied to the piezoelectric porous film 1801 in the film thickness direction in a state where no voltage is applied across the electrode layers 1902 and 1903 on the front and back sides of the piezoelectric elastomer layer 1901. In this case, the holding portion 130 (or the sound device 100) is brought into the earhole open state.

Further, FIG. 20B illustrates the state of a large number of small holes retracted by acting a force to the piezoelectric porous film 1801 in the direction in which the film is thinned in a state where a medium voltage is applied across the electrode layers 1902 and 1903 on the front and back sides of the piezoelectric elastomer layer 1901. In this case, the holding portion 130 (or the sound device 100) can be brought into the intermediate state of the earhole open/close state.

Further, FIG. 20C illustrates the state of a large number of small holes crushed and closed because of a strong force acting on the piezoelectric porous film 1801 in the direction in which the film is thinned in a state where a high voltage is applied across the electrode layers 1902 and 1903 on the front and back sides of the piezoelectric elastomer layer 1901. In this case, the holding portion 130 (or the sound device 100) can be brought into the earhole close state.

Thus, controlling the voltage applied across the electrode layers 1902 and 1903 by the high-voltage power supply unit enables the holding portion 130 (or the sound device 100) to make a transition into each state of the earhole open state, the intermediate state, and the earhole close state.

Moreover, the piezoelectric elastomer layer 1901 can be formed using a dielectric elastomer instead of the piezoelectric elastomer. In addition, instead of the piezoelectric porous membrane 1801, a piezoelectric membrane such as polyvinylidene difluoride (PVDF), an air pump membrane, a dielectric tube, or the like can be used to configure the opening of the ring-shaped holding portion 130 to be able to open and close.

The sound device 100 illustrated in FIGS. 18, 19, 20A, 20B, and 20C is capable of opening and closing the "holding-portion inner acoustic transmission portion" that allows ambient sound to pass into the ear canal inside the ring-shaped holding portion 130. However, the sound device 100 fails to open or close the "holding-portion outer acoustic transmission portion" formed on the outside of the holding portion 130. Thus, by preparing a plurality of types of holding portions 130 (ring earpieces) of different sizes and appropriately replacing them with the holding portions 130 having a size suitable for the size of the individuals' ear (cavity of concha), it can make it unnecessary to form the "holding-portion outer acoustic transmission portion".

Figure 21:
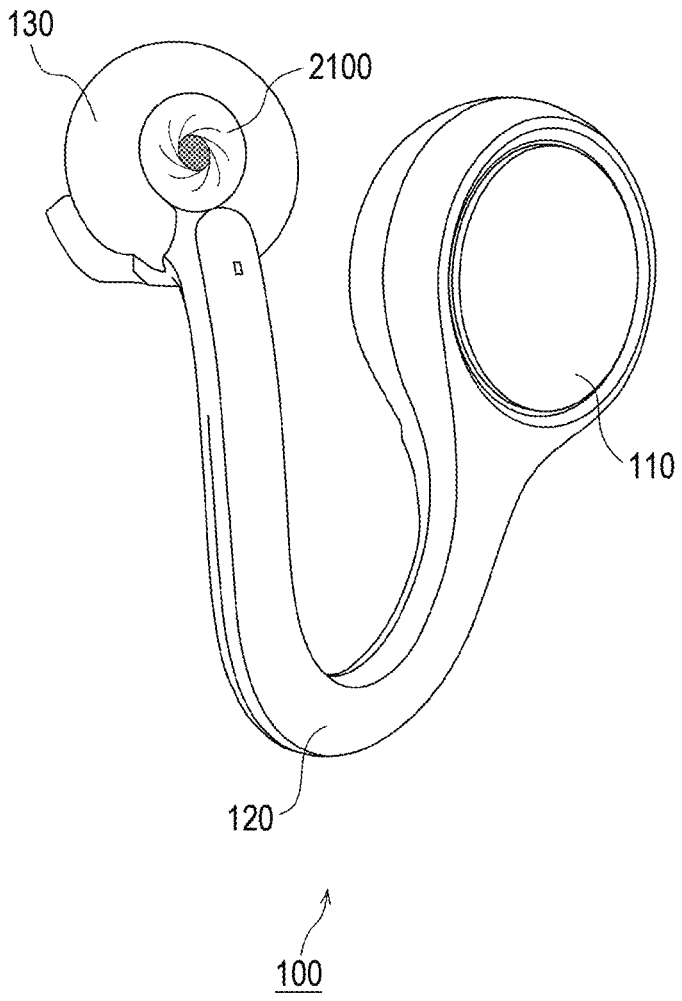
FIG. 21 is a view illustrating the outer configuration of an earhole open/close type sound device 100 using a throttle mechanism.

Further, FIG. 21 illustrates the sound device 100 capable of opening and closing the earhole, which is configured by disposing a throttle mechanism 2100 capable of adjusting the opening area inside the ring-shaped holding portion 130. In addition, FIGS. 22 and 23 respectively illustrate a top view and a side view of the throttle mechanism 2100.

The throttle mechanism 2100 includes a fixing ring 2101, a rotating ring 2102, and an elastic member 2103 including rubber or the like stretched between the rotating ring 2101 and the rotating ring 2102. The fixing ring 2101 and the rotating ring 2102 are arranged to be substantially coaxial with each other, and the rotating ring 2102 is rotatable with respect to the fixed ring 2101.

Figure 22:
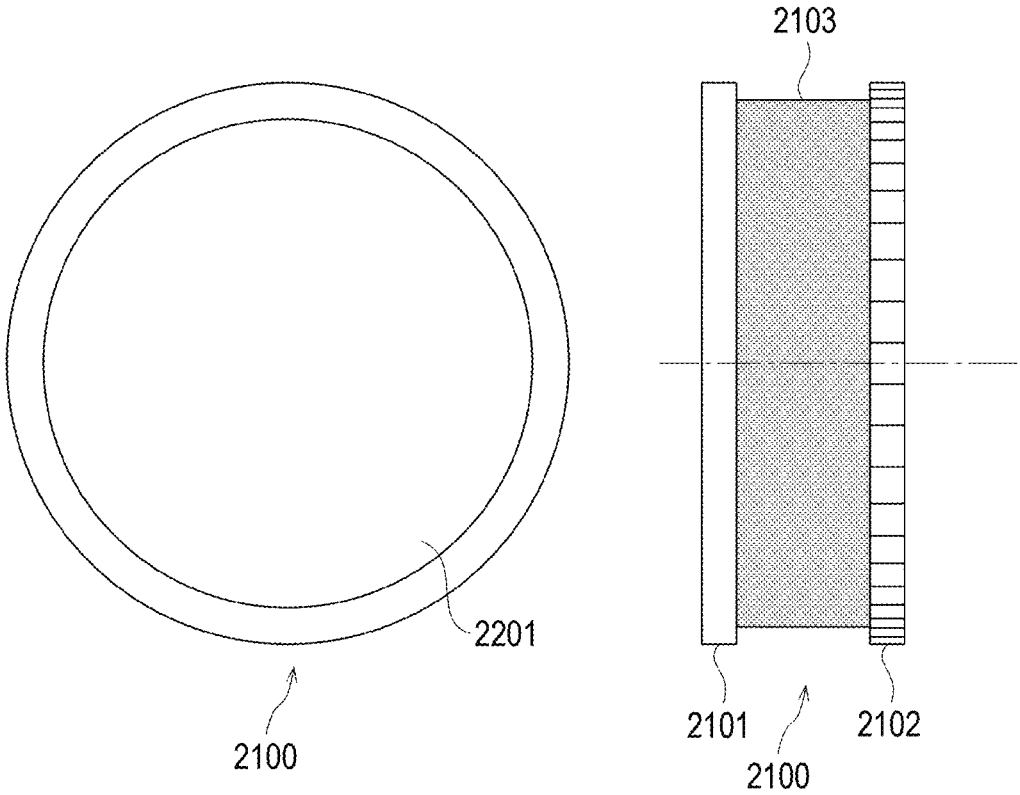
FIG. 22 is a view illustrating separately upper and side surfaces of a throttle mechanism 2100 (with a throttle open).
Figure 23:
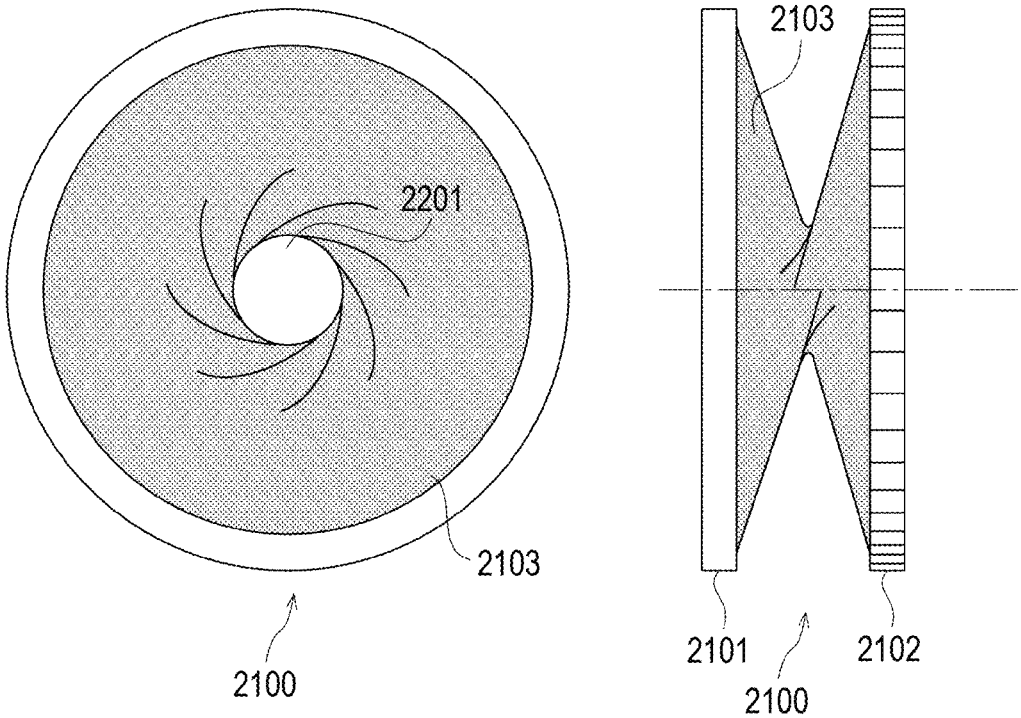
FIG. 23 is a view illustrating separately upper and side surfaces of the throttle mechanism 2100 (with a throttle closed).

As illustrated in FIG. 22, in the state where the rotating ring 2102 is not rotating, the elastic member 2103 is substantially cylindrical, and the opening area of a throttle hole 2201 is the largest, which corresponds to the earhole open state. Then, as illustrated in FIG. 23, when the rotating ring 2102 is rotated, the elastic member 2103 is twisted, and the throttle hole 2201 formed in the central portion of the cylinder becomes smaller depending on the rotation angle of the rotating ring 2102. In one example, in a state where the rotating ring 104 is rotated at 180 degrees, the throttle hole 2201 gradually retracts and approaches the earhole close state.

However, the sound device 100 using the throttle mechanism as illustrated in FIGS. 21 to 23 fails to open and close the "holding-portion outer acoustic transmission portion" formed on the outside of the ring-shaped holding portion 130. Thus, by preparing a plurality of types of holding portions 130 (ring earpieces) of different sizes and appropriately replacing them with the holding portions 130 having a size suitable for the size of the individuals' ear (cavity of concha), it can make it unnecessary to form the "holding-portion outer acoustic transmission portion" (same as above).

Moreover, it is also possible to employ other throttle mechanisms such as an iris throttle (blade throttle) and a water-gate throttle to open and close the opening of the ring-shaped holding portion 130.

Further, it is preferable that the sound device 100 described in Section B-4 above is also equipped with a static pressure adjusting mechanism such as a thin tube for adjusting the barometric pressure difference between the ear canal and the outside air in the earhole hermetic state.

C. Other Types of Sound Devices

Figure 30:
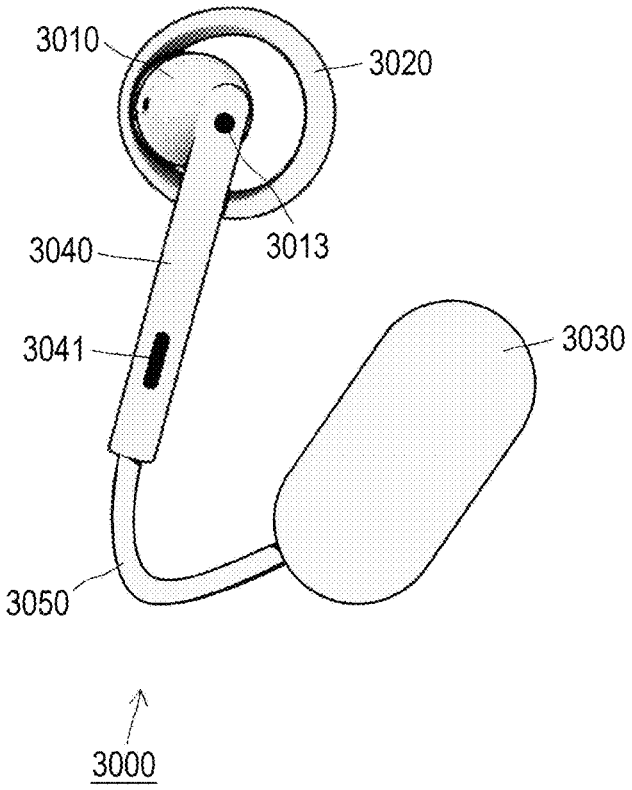
FIG. 30 is a view illustrating a configuration example of a sound device 3000.
Figure 31:
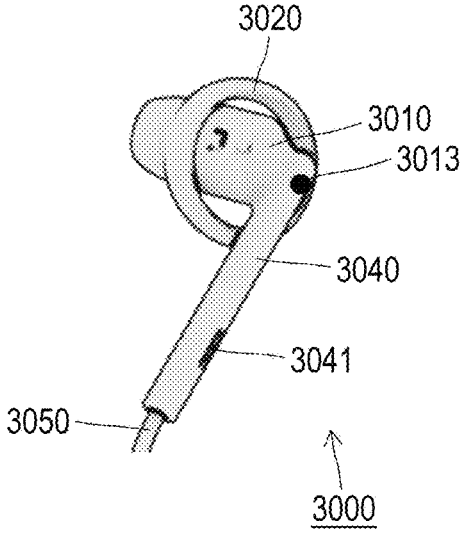
FIG. 31 is a view illustrating the outer configuration of a sound generation portion 3010 and a holding portion 3020.
Figure 32:
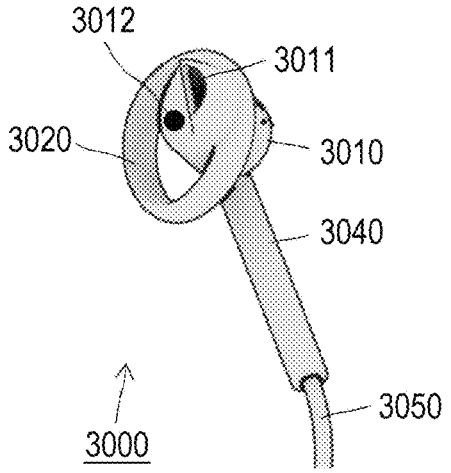
FIG. 32 is a view illustrating the outer configuration of a sound generation portion 3010 and a holding portion 3020.
Figure 33:
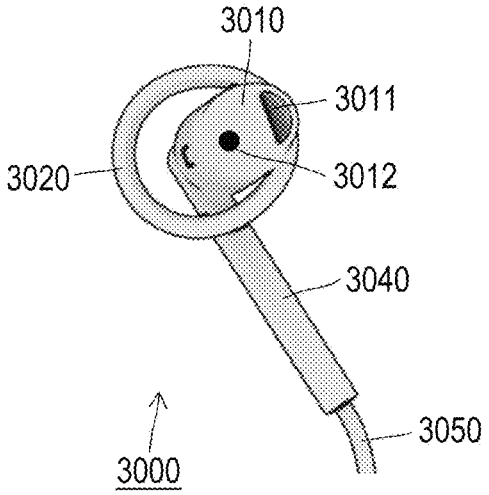
FIG. 33 is a view illustrating the outer configuration of a sound generation portion 3010 and a holding portion 3020.

FIG. 30 illustrates a view from the outer side surface of another type of a sound device 3000 (the side surface that is the outside when it is worn on the listener's ear). The sound device 3000 includes a sound generation portion 3010, a holding portion 3020 for supporting the sound generation portion 3010, and a main body 3030. In addition, FIGS. 31 to 33 illustrate the outer configuration of the sound generation portion 3010 and the holding portion 3020 as viewed from different viewing directions. Moreover, although only one of the left and right sound devices 3000 is illustrated in FIGS. 30 to 33, it is understood that a pair of left and right sound devices 3000 can be attached to the respective corresponding user's left and right ears to achieve stereophonic reproduction or the like.

The sound generation portion 3010 has a built-in sound generation element that generates sound in its housing, and a crescent-shaped sound output hole 3011 that outputs the generated sound is bored in the front surface of the housing (the side surface that faces the entrance of the ear canal when attached to the auricle).

The sound generation portion 3010 includes a sound generation element that causes a variation in sound pressure, such as a dynamic driver having the diameter of approximately 6 mm, and its housing is integrated with a part of the holding portion 3020. The dynamic driver is fundamentally used as the sound generation element, but an electrostatic driver of a similar type that causes a variation in sound pressure can also be used. Alternatively, a sound generation element of a completely different type such as balanced armature or piezoelectric can be used, or a hybrid type in which a plurality of types of sound generation elements is combined can be used.

In the example illustrated in FIG. 30, the housing of the sound generation portion 3010 is coupled to the inner surface of the holding portion 3020. However, due to its small size, a design in which it is coupled to the outer surface of the holding portion 3020 or a design in which it is coupled to the holding portion 3020 near the center of the housing of the sound generation portion 3010 is also conceivable.

Further, a duct 3040 through which a signal line 3050 for speech signals, power supply, or the like is inserted communicates with the back side of the housing of the sound generation portion 3010. When a sound generation element that causes a variation in barometric pressure, such as a dynamic driver or an electrostatic driver, is used in the sound generation portion 3010, it is necessary to let the sound of the opposite phase to the front cavity generated inside the housing (back cavity) release to the outside of the housing. In this case, the duct 3040 can also be used as an exhaust portion. An exhaust hole 3041 for emitting the sound is bored at a location of the duct 3040 away from the holding portion 3020. The exhaust hole 3041 is sufficiently separated from the sound output hole 3011, so the air discharged from the exhaust hole 3041 does not become noise of the reproduced sound of the sound generation portion 3010.

Figure 34:
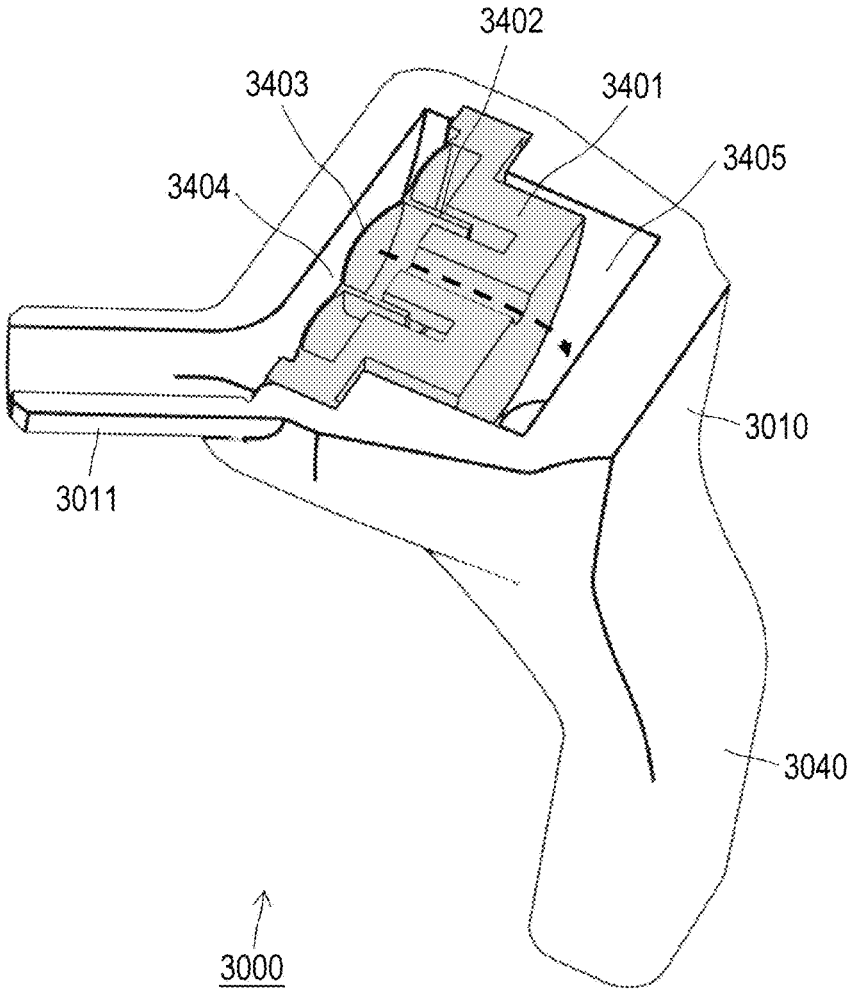
FIG. 34 is a view illustrating a cross-section of the sound generation portion 3010.
Figure 35:
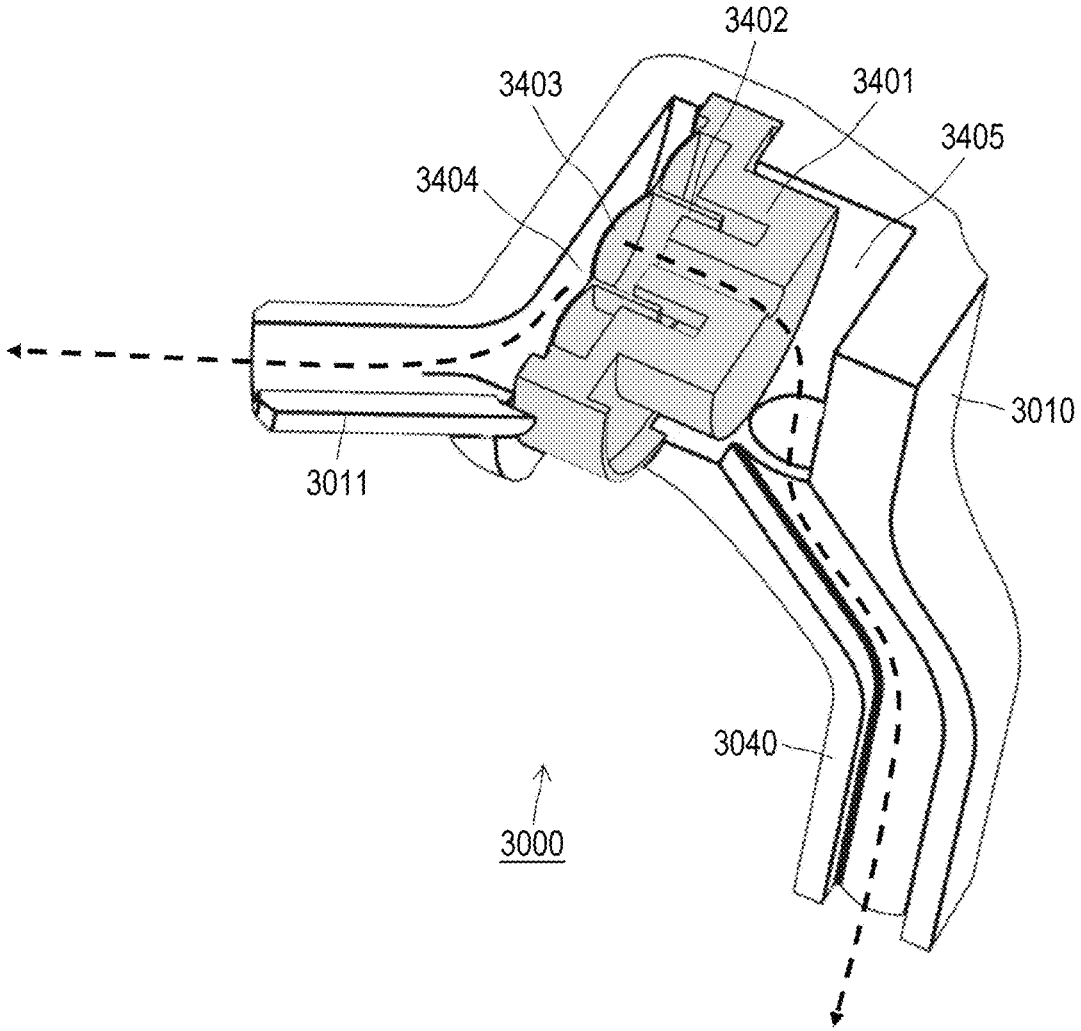
FIG. 35 is a view illustrating a cross-section of the sound generation portion 3010.

FIGS. 34 and 35 are cross-sectional views of the sound generation portion 3010 and illustrate the internal configuration of the housing thereof. Moreover, FIG. 34 mainly illustrates a cross-section of the sound generation element, and FIG. 35 illustrates a cross-section including the duct 3040. In addition, for the sake of simplification of the drawings, the illustration of the holding portion 3020 is omitted.

The sound generation portion 3010 includes a diaphragm 3403 arranged inside the sound generation portion 3010 to face a magnetic circuit configured as a magnet 3401. The diaphragm 3403 has a voice coil 3402. In addition, the inside of the sound generation portion 3010 is partitioned by the diaphragm 3403 into a diaphragm front-face space (a front cavity) 3404 and a diaphragm back-face space 3405 (a back cavity). Then, when the magnetic field varies depending on the speech signal input to the voice coil 3402 via the signal line (not shown), the diaphragm 3403 operates in the front-back direction (winding direction of the voice coil 3402) due to the magnetic force of the magnet 3401. This operation causes a variation in pressure between the diaphragm front-face space 3404 and the diaphragm back-face space 3405, which becomes sound. The sound generated in the diaphragm front-face space 3404 is emitted from the sound output hole 3011 toward the inner side of the ear canal and then reaches the eardrum.

On the other hand, an exhaust hole is necessary for emitting the sound generated in the diaphragm back-face space 3405 (sound of the opposite phase to the diaphragm front-face space 3404) to the outside of the housing of the sound generation portion 3010. This is to prevent the sound generated in the diaphragm back-face space 3405 from interfering with the vibration of the diaphragm 3403. The sound generation portion 3010 is assumed to be supported by the holding portion 3020 and is attached to the user's cavity of concha for use. If the exhaust hole is bored in the back surface or the like of the housing of the sound generation portion 3010, the sound generated in the diaphragm back-face space 3405 is emitted in the cavity of concha, so this sound becomes a large noise against the regenerated sound wave generated by the sound generation portion 3010.

Thus, as illustrated in FIGS. 34 and 35, the duct 3040 for discharging the sound having the opposite phase to the outside of the auricle is disposed on the back side of the sound generation portion 3010 (the diaphragm 3403). The duct 3040 includes a hollow tube material having a sufficient length from the back side of the housing of the sound generation portion 3010 to reach the outside of the auricle through the intertragic notch. The duct 3040 is provided with an exhaust hole 3041 bored therein for discharging the sound generated in the diaphragm back-face space 3405 (see FIGS. 30 and 31). Such a configuration enables the sound generated in the diaphragm back-face space 3405 to pass through the duct 3040 and then to be emitted through the exhaust hole 3401 to the outside of the auricle, thereby suppressing the influence of sound leakage. In addition, the signal line 3050 for a reproduced sound signal used to drive the sound generation element, a driving power source, or the like is inserted into the duct 3040.

In addition, the sound generation elements illustrated in FIGS. 34 and 35 are the dynamic drivers, but an electrostatic driver of a similar type that causes a variation in sound pressure can also be used. Alternatively, a sound generation element of a completely different type such as balanced armature or piezoelectric can be used, or a hybrid type in which a plurality of types of sound generation elements is combined can be used.

With referring back to FIGS. 30 to 33, the structure of the sound device 3000 is described.

The holding portion 3020 is arranged to be coupled to the intertragic notch of the ear near the entrance of the ear canal. More preferably, the holding portion 3020 supports the sound generation portion 3010 so that the sound output hole 3011 of the sound generation portion 3010 faces the inner side of the ear canal. In other words, the holding portion 3020 fixes the sound output hole 3011 of the sound generation portion 3010 to the vicinity of the entrance of the ear canal, so the positioning is performed so that the sound output hole 3011 can emit the sound to the interior of the ear canal of the earhole.

Further, the holding portion 3020 is an annular structure provided with an opening portion through which the entrance of the ear canal (earhole) opens to the outside. In the example illustrated in FIGS. 30 to 33, the holding portion 3020 has a ring-shaped structure and other portions than the ring are the opening portion, making the listener's earhole open to the outside. In other words, the holding portion 3020 has a structure that picks up the ambient sound from the ring-shaped opening portion to the entrance of the ear canal even in the state where it is coupled to the intertragic notch of the ear near the entrance of the ear canal. However, the holding portion 3020 is not limited to the ring-shaped structure, and can have any shape other than the ring as long as the sound generation portion 3010 can be supported to open the earhole.

In the ear canal, an internal microphone 3012 intended to pick up sound is installed near the sound output hole 3011 of the sound generation portion 3010. In addition, an external microphone 3013 intended to pick up ambient sound (or sound generated outside the earhole) is installed on a surface of the housing of the sound generation portion 3010 facing the outside. In an earhole hermetic state described later, the internal microphone 3012 is arranged on the side of the ear canal, and the external microphone 3013 is arranged on the outside.

The internal and external microphones 3012 and 3013 are used for measuring acoustic characteristics. In one example, it is possible to use the internal microphone 3012 for feedback noise cancellation and to use the external microphone 3013 for feedforward noise cancellation (e.g., see Patent Document 3). A feedforward cancellation signal that cancels the ambient sound leaking into the ear canal is generated on the basis of the ambient sound picked up by the external microphone 3013. In addition, the internal microphone 3012 measures the leaking ambient sound that failed to be removed by the cancellation signal in the ear canal and generates a feedback cancellation signal on the basis of the measurement result. In one example, the feedforward and feedback cancellation signals are superimposed on the reproduced sound generated from the sound generation portion 3010 and are output. In particular, in the earhole hermetic state, there is a high effect on the feedforward noise cancellation using the external microphone 3013. The internal microphone 3012 and the external microphone 3013 can also be used for applications such as the collection of the uttered speech of the wearer or recording of the ambient sound. Besides, it is possible to control the earhole close state of the sound device 3000 by utilizing the feature that the frequency responses of the internal microphone 3012 and the external microphone 3013 are separated depending on the earhole open/close state. Details thereof will be given later.

The main body 3030 has a relatively large accommodation space. Thus, the main body 3030 can include a device such as sensors or actuators, a wireless module that receive reproduced sound signals from smartphones and other audio reproduction devices, a signal processing circuit that performs signal processing such as reproduced sound signals, noise cancellation, or noise reduction or the like, in addition to the micro-speakers mentioned above. In one example, various sensors, such as biometric sensor including human body temperature sensors, perspiration sensors, and myoelectric sensors, can be disposed in the main body 3030.

In the examples illustrated in FIG. 30, the main body 3030 has a square shape having four round corners but has a relatively large surface area. It is assumed that an UI operation unit or a fingerprint authentication unit using a touch sensor or the like is installed on the upper surface portion of the main body 3010 or that a proximity sensor is disposed on the bottom surface portion thereof. The proximity sensor comes into contact with the wall surface of the auricle when the holding portion 3020 is attached to the earhole, so the detection result obtained by the proximity sensor can be used for attachment detection of the sound device 3000 (described later). Besides, in the state where the sound device 3000 is attached to the listener's ear, the main body 3030 is hidden at the medial surface of the auricle and is unnoticeable, and it seems to the surrounding people that the listener's earhole is not blocked (same as above).

Further, the sound device 3000 is further provided with a mechanism for adjusting the degree of opening or closing of the earhole in a short time and is configured to be able to control how the ambient sound is heard. Specifically, the ring-shaped holding portion 3020 is provided with an inflatable balloon configured as a flexible material such as an elastomer or silicon rubber along each of the outer circumference and the inner circumference of the ring, and the main body 3030 is equipped with a micropump that produces the pressure by gas or liquid together with the micro-speaker. Then, in one example, by pumping or sucking air or liquid to or from the balloon described above through the pressure pipe that functions the signal line 3050, it is possible to increase or decrease the size of the opening at the center of the holding portion 130. Thus, it is possible to adjust the degree of opening or closing of the earhole in a short time.

Figure 36:
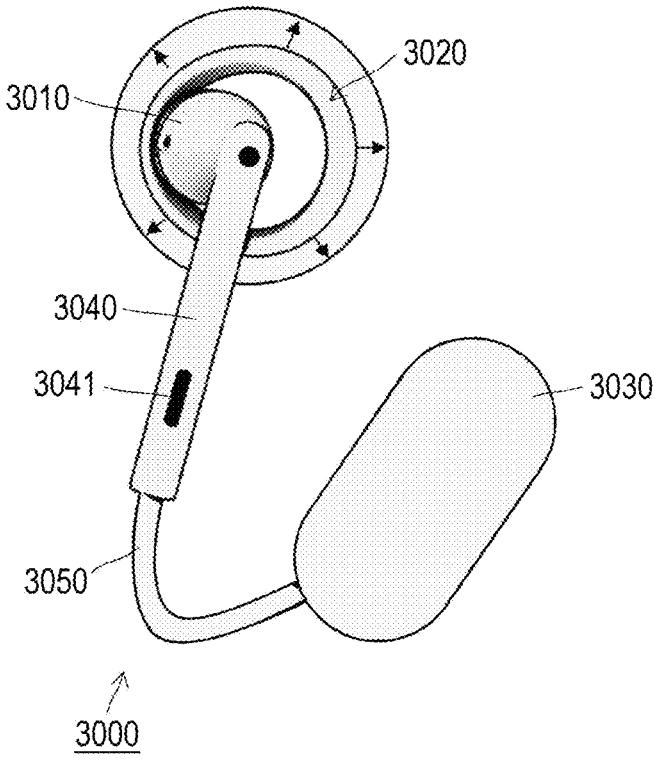
FIG. 36 is a view illustrating the intermediate state of the sound device 3000.
Figure 37:
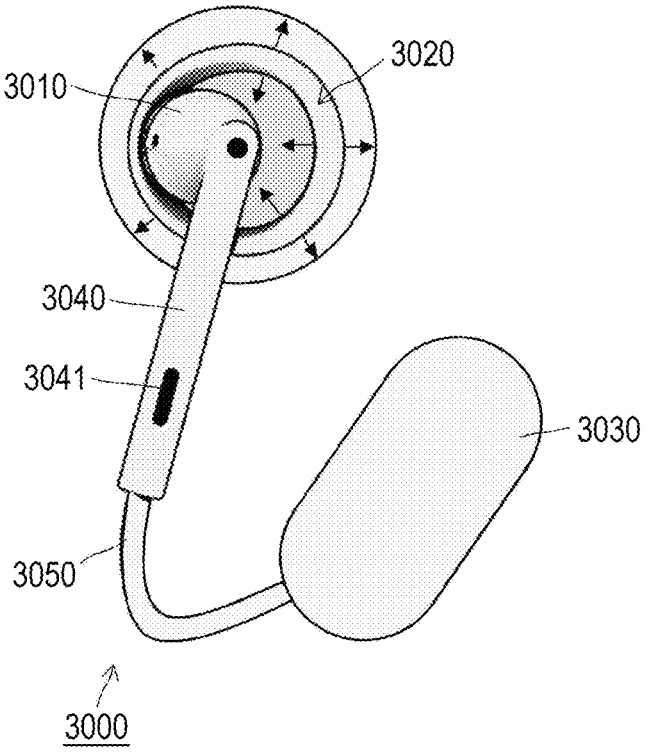
FIG. 37 is a view illustrating the earhole close state of the sound device 3000.

The mechanism for adjusting the sizes of the "holding-portion inner acoustic transmission portion" and the "holding-portion outer acoustic transmission portion" by expanding and contracting the balloon is as described in Section B-2 above. FIG. 36 illustrates an intermediate state in which only the outside of the ring-shaped holding portion 3020 expands and the "holding-portion outer acoustic transmission portion" disappears. In addition, FIG. 37 illustrates an earhole close state in which the "holding-portion inner acoustic transmission portion" and the "holding-portion outer acoustic transmission portion" substantially disappear by simultaneously expanding the outside and the inside of the holding portion 3020.

Moreover, the sound device 3000 can be configured to open and close the earhole by using a device other than the balloon, such as the piezoelectric porous membrane and the throttle mechanism. In addition, in the case where the sound device 3000 is configured as the earhole open/close type, the sound device 3000 is also preferably equipped with the static pressure adjusting mechanism (described above) for reducing the barometric pressure difference between the ear canal and the outside air in the state where the earhole is closed.

Figure 38:
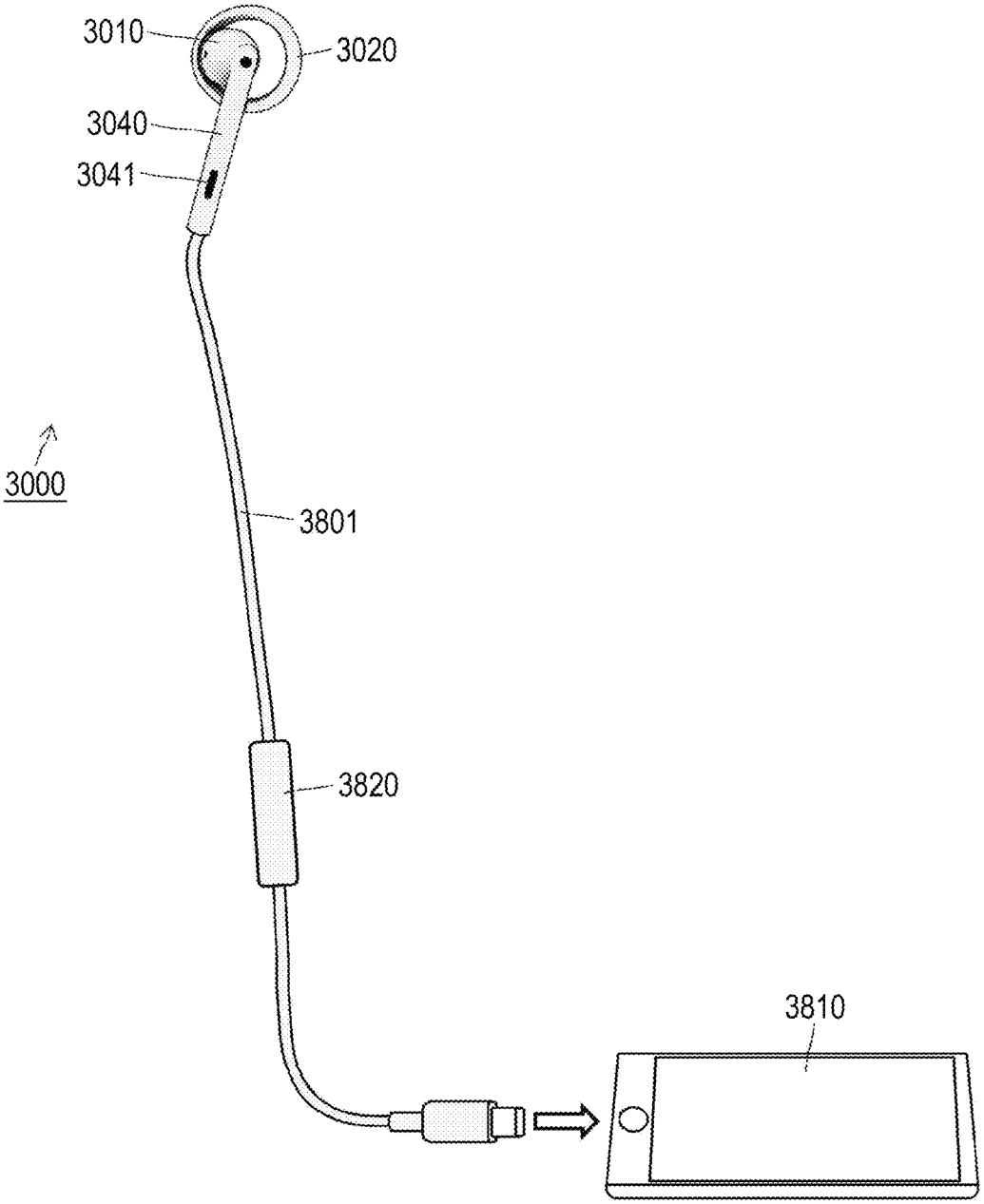
FIG. 38 is a diagram illustrating a modification of the sound device 3000.

Further, the sound device 3000 illustrated in FIGS. 30 to 37 is a wireless type and is configured so that the reproduced sound is supplied from the main body 3030, but even if it is a wired type, it is certainly possible to implement the earhole open/close structure. FIG. 38 illustrates a configuration example of the sound device 3000 that reproduces and outputs a reproduced sound signal from an external audio reproduction device 3810 such as a smartphone by a wired connection. In the illustrated example, a controller 3820 is disposed on the way of a wire 3801 that transmits the reproduced sound signal from the audio reproduction device 3810 such as a smartphone to the sound device 3000. The controller 3820 includes a built-in micropump that produces the action of gas pressure, as well as a processing circuit that adjusts the volume and processes the reproduced sound signal (can include noise cancellation or noise reduction). In addition, the wire 3801 between the controller 3820 and the sound device 3000 includes a pressure pipe for propagating the action of the pressure by the micropump to the balloon disposed in the holding portion 3020 of the sound device 3000. Then, the micropump in the controller 3820 is driven to produce a pressure action and pumps or sucks air through the pressure pipe to expand or contract the balloon provided in the holding portion 3020. Thus, it is possible to achieve the opening and closing of the earhole.

D. Control System Configuration

Figure 24:
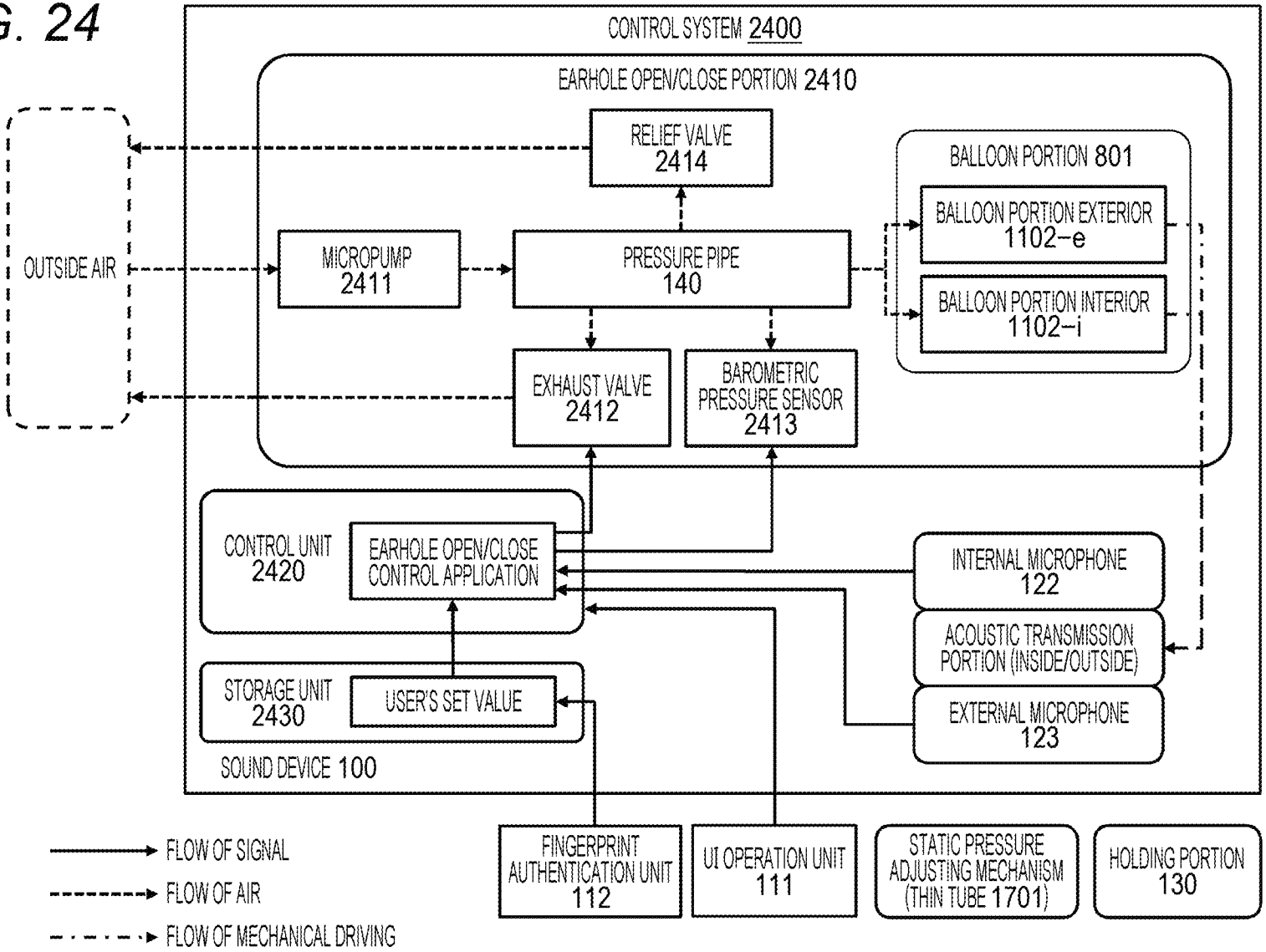
FIG. 24 is a diagram illustrating a configuration example of a control system 2400 that controls the opening and closing of the earhole of the sound device 100.

FIG. 24 illustrates a configuration example of a control system 2400 of the sound device 100, which mainly focuses on the open/close control of the earhole. The control system 2400 illustrated includes an earhole opening/closing unit 2410, a control unit 2420, and a storage unit 2430. Moreover, although only one sound device 100 is illustrated in FIG. 24, it can be understood that the listener wears a pair of sound devices 100 on the left and right ears to appreciate the reproduced sound. In addition, it can be fully understood that the earhole open/close control system 2400 is similarly applicable to other types of sound device 3000.

The earhole opening/closing unit 2410 includes a micropump 2411 housed in the main body 110, the pressure pipe 140 penetrating through the sound guide portion 120, and the balloon portion 801.

The micropump 2411 is a compact air pump that produces the action of pressure. The micropump 2411 is capable of producing the action of pressure using either gas or liquid as a medium, but herein it is assumed that gas is used. The control unit 2420 described later controls the driving of the micropump 2411.

The pressure pipe 140 transmits the action of the pressure generated by the micropump 2411 to the balloon portion 801. Then, the balloon portion 801 expands and contracts by pumping and sucking air from the micropump 2311 through the pressure pipe 140.

The pressure pipe 140 is provided with an exhaust valve 2412, a barometric pressure sensor 2413, and a relief valve 2414. The exhaust valve 2412 is a valve that opens when the air pumped to the balloon portion 801 is discharged to the outside, and the open/close operation is controlled by a control unit 2420 described later. In addition, the barometric pressure sensor 1813 is a sensor that detects the barometric pressure in the pressure pipe 140 (i.e., in the balloon portion 801). The control unit 2420 monitors the detection result obtained by the barometric pressure sensor 2413. In addition, the relief valve 2414 opens, when a pressure equal to or higher than a predetermined value is applied to the pressure portion 140, to prevent the burst of the balloon portion 801 or excessive compression on the listener's ear (cavity of concha) due to the expansion of the balloon portion 801. In addition, the balloon portion 801 having a strength equal to or higher than the maximum pressurization limit of the micropump makes it possible to prevent excessive compression on the listener's ear (cavity of concha).

The configuration example illustrated in FIG. 24 is based on the assumption that the inside and outside of the ring-shaped holding portion 130 are independently driven to control the opening and closing of the earhole as illustrated in FIG. 11. In other words, the balloon portion 801 includes the inner non-coupling portion (inside the balloon portion) 1102-*i* and the outer non-coupling portion (outside the balloon portion) 1102-*e*. In addition, the pressure pipe 140 includes two pressure pipes 1301 and 1302 used to individually apply the action of pressure by the micropump 2411 to the balloon portion interior 1102-*i* and the balloon portion exterior 1102-*e* (e.g., refer to FIG. 13). Moreover, each of the pressure pipes 1301 and 1302 is assumed to be equipped with the exhaust valve 2412, the barometric pressure sensor 2413, and the relief valve 2414.

The pressure pipe 1301 for the inside of the ring can be used to pump or suck air from the micropump 2411 to the inner non-coupling portion 1102-*i* of the balloon portion 801 to expand or contract (see FIG. 15). Such expansion or contraction allows the holding-portion inner acoustic transmission portion (see FIGS. 4 and 5) to retract or extend.

Further, the pressure pipe 1302 for the outside of the ring can be used to pump or suck air from the micropump 2411 to the outer non-coupling portion 1102-*e* of the balloon portion 801 to expand or contract (see FIG. 14). Such expansion or contraction allows the holding-portion outer acoustic transmission portion (see FIGS. 4 and 5) to retract or extend.

The earhole open/close state varies as the holding-portion inner acoustic transmission portion or the holding-portion outer acoustic transmission portion retracts or extends. Further, the frequency responses of the internal microphone 122 and the external microphone 123 are handled separately depending on the earhole open/close state. This is because the frequency response of the sound picked up between the internal microphone 122 and the external microphone 123 differs as the earhole approaches the hermetic state. When the earhole approaches the hermetic state, the internal microphone 122 can easily collect the reproduced sound but hardly collect the ambient sound, while the external microphone 123 can easily collect the ambient sound but is difficult to collect the reproduced sound (as described above).

The control unit 2420 includes, for example, a central processing unit (CPU) and a working memory used during CPU operation (memory temporarily used by CPU upon executing applications such as random-access memory (RAM), cache memory, or register). The control unit 2420 integrally controls the operations of the entire control system 2400 by executing a predetermined program. The control unit 2420 is housed in, for example, the main body 110. In this example, the control unit 2420 executes an earhole open/close control application used to control the opening/closing of the earhole, controls the drive of the micropump 2411, and pumps or sucks air to or from the balloon portion 801.

The control unit 2420 monitors the collected sound signal from each of the internal and external microphones 122 and 123 and determines the earhole open/close state on the basis of the difference in frequency responses between the two microphones. Then, when the determined earhole open/close state is different from the desired earhole open/close state, the control unit 2420 controls the driving of the micropump 2411 to open or close the exhaust valve 2412 of the pressure pipe 140. This allows the balloon portion 801 to further expand or contract, thereby approaching the desired earhole open/close state.

When the earhole is open more than the desired open/close state, the control unit 2420 drives the micropump 2411 to pump air to the balloon portion 801, causing at least one of holding-portion inner acoustic transmission portion or the holding-portion outer acoustic transmission portion to expand. In addition, when the earhole is closed more than the desired open/close state, the control unit 2420 opens the exhaust valve 2412 to reduce the barometric pressure inside the balloon portion 801 to reduce the barometric pressure inside the holding portion. This causes at least one of the holding-portion inner acoustic transmission portion or the holding-portion outer acoustic transmission portion to contract.

The storage unit 2430 stores information used by the control unit 2420. The storage unit 2430 includes a semiconductor memory such as read-only memory (ROM) or solid-state drive (SSD), and is housed in, for example, the main body 110. In one example, in the case where one sound device 100 is shared by a plurality of users, the earhole open/close state set for each user is stored in the storage unit 2430 in association with the user's identification information. In one example, the earhole open/close state set when the user previously used the sound device 100 or the barometric pressure in the pressure pipe 140 when the earhole open/close state is reached is linked to the user's identification information as a user's set value and stored in the storage unit 2430.

The control unit 2420 reads the earhole open/close state or the barometric pressure in the pressure pipe 140 set for the user identified by the authentication result obtained by the fingerprint authentication unit 112 from the storage unit 2430. Then, the control unit 2420 controls the driving of the micropump 2411 to implement the earhole open/close state being read. Moreover, the user can be identified on the basis of biological information other than fingerprint (e.g., such as vein pattern or iris information). Besides, the user can be identified on the basis of information other than biological information (e.g., such as personal information (such as an identifier (ID)) read from other devices by a near field communication (NFC) reader, speech (voiceprint) information, facial information, identifiable personal information specified by gestures or the like). In addition, the user can enter the user's own identification information through the UI operation unit 111.

Moreover, the control unit 2420 is capable of controlling opening/closing of the earhole in accordance with various control rules in addition to the earhole open/close state set for each user. The control unit 2420 can control the earhole opening/closing unit 2410 to change the open/close state of the earhole on the basis of an instruction from the user. In addition, the control unit 2420 is also capable of executing the earhole open/close control application to control the opening/closing of the earhole automatically, but details thereof will be described later.

FIG. 24 illustrates a system configuration example in which the opening control of the earhole is performed only by the sound device 100. On the other hand, a system configuration for controlling the opening of the earhole in the sound device 100 by cooperating with an external device is also conceivable. Examples of the external device herein can include an information terminal such as a cloud or a smartphone held by a user.

Figure 25:
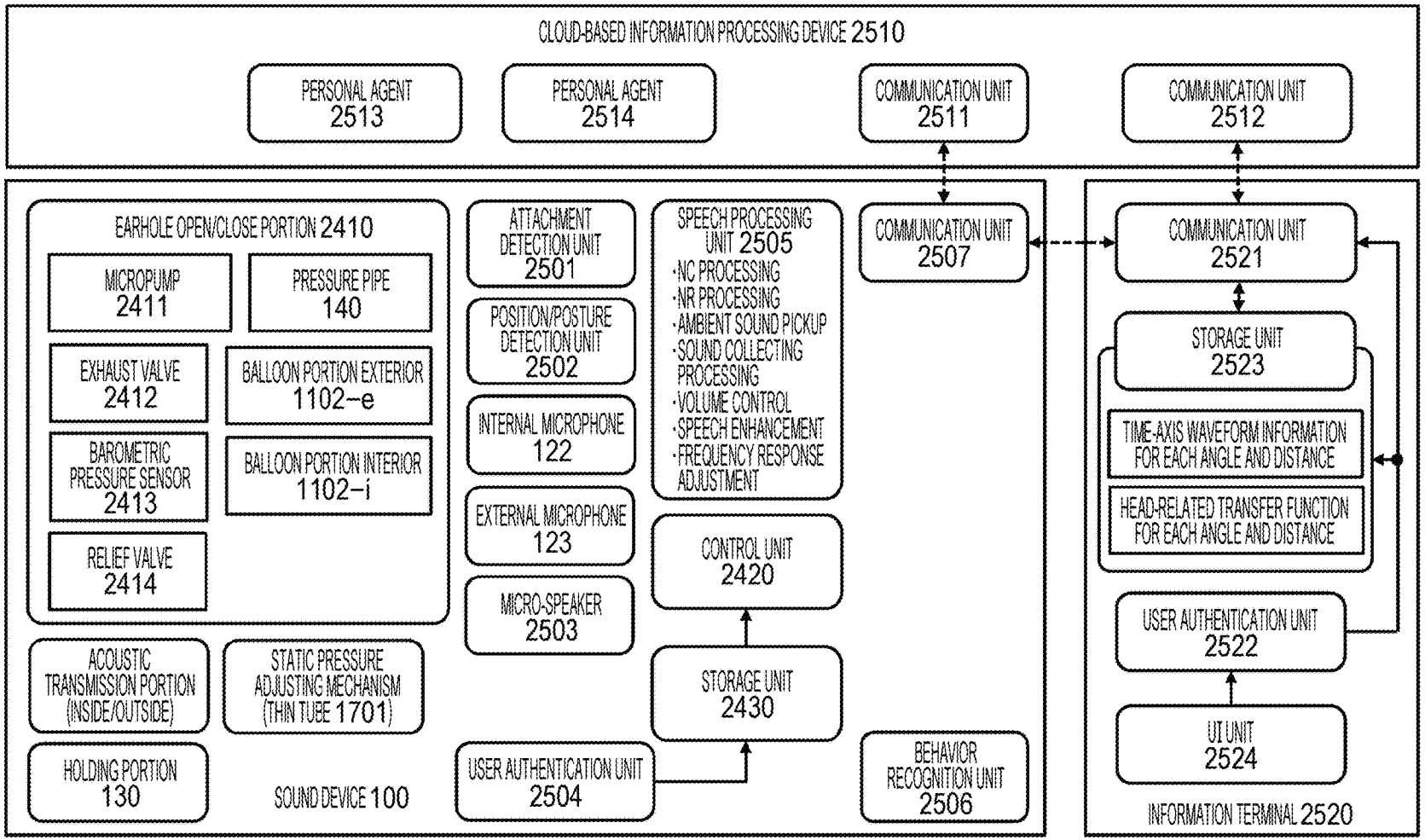
FIG. 25 is a diagram illustrating a configuration example of an earhole open/close control system 2500 configured by cooperation between the sound device 100 and an external device.

FIG. 25 illustrates a configuration example of an earhole open/close control system 2500 including the sound device 100, a cloud-based information processing device 2510, and an information terminal 2520 held by a user. The sound device 100 is fundamentally equipped with the same functional configuration as that illustrated in FIG. 24. Moreover, although only one sound device 100 is illustrated in FIG. 25, it can be understood that the listener wears a pair of sound devices 100 on the left and right ears to appreciate the reproduced sound. In addition, it can be fully understood that the earhole open/close control system 2500 is similarly applicable to other types of sound device 3000.

The sound device 100 includes, as the earhole opening/closing unit 2410, the micropump 2411, the exhaust valve 2412, the barometric pressure sensor 2413, the relief valve 2414, the pressure pipe 140, the balloon portion interior 1102-I, and the balloon portion exterior 1102-*e*. The configuration and function of the earhole opening/closing unit 2410 are as described above with reference to FIG. 24, and so a detailed description thereof will be omitted.

Further, the sound device 100 includes an acoustic transmission portion (inside/outside), the holding portion 130, and the static pressure adjusting mechanism (the thin tube 1701). The configuration and function of them are as described above, and so a detailed description thereof will be omitted.

Further, the sound device 100 includes an attachment detection unit 2501, a user position/posture detection unit 2502, the internal microphone 122, the external microphone 123, a micro-speaker 2503, and a user authentication unit 2504.

The configuration and function of the internal and external microphones 122 and 123 are as described above, and a detailed description thereof will be omitted. In addition, the micro-speaker 2503 is a sound element housed in the main body 110 and mainly acoustically outputs reproduced sound such as music. A dynamic driver is used for the micro-speaker 2503, but an electrostatic driver can also be used. Alternatively, the micro-speaker 2503 can employ a sound generation element of completely different type such as balanced armature or piezoelectric, or a hybrid type in which a plurality of types of sound generation elements is combined can be used.

The attachment detection unit 2501 is a functional module that detects whether the sound device 100 is worn on the user's ear. The attachment detection unit 2501 can be, for example, the proximity sensor 113 (described above) disposed on the bottom surface portion of the main body 110. Keeping the earhole opening/closing unit 2410 such as the micropump 2411 driving or keeping the reproduced sound outputting from the micro-speaker 2503 even when the user is not wearing the sound device 100 is useless, causing a waste of electricity. Thus, the driving of the earhole opening/closing unit 2410 and the micro-speaker 2503 can be caused to be stopped on the basis of the detection result obtained by the attachment detection unit 2401.

The user position/posture detection unit 2502 includes a device that detects the position and posture of the head of a listener wearing the sound device 100 on the listener's ear. The user position/posture detection unit 2502 can be, for example, an inertial measurement unit (IMU) configured as a three-axis gyroscope and a three-direction accelerometer. It is possible to identify the user and recognize the user's behavior. This is achieved by learning the neural network using deep learning and inputting the detection result obtained by the user position/posture detection unit 2502 into the learned neural network. The deep learning of the neural network is performed so that the user's position/posture pattern and user's behavior pattern are previously associated with the user (although not shown, it can be stored in any storage device such as the storage unit 2430 in the sound device 100, a storage unit 2523 of the information terminal 2520, or a storage device accessible by the cloud-based information processing device 2510). In addition, it is assumed that the listener wears a pair of sound devices 100 on the left and right ears to appreciate the reproduced sound. In such an arrangement, it is possible to recognize the usage pattern of the sound device 100 (whether being unused or whether being used in what situation or environment) on the basis of the detection result obtained by the user position/posture detection units 2502 on the left and right.

The user authentication unit 2504 is a functional module that performs user authentication for a listener wearing the sound device 100. In one example, the user authentication unit 2504 can be configured as the fingerprint authentication unit 112 disposed on the upper surface of the main body 110. Alternatively, the user authentication unit 2504 can be configured using a biometric sensor incorporated in the main body 110 or the like. In addition, the user authentication unit 2504 can perform voiceprint authentication for the utterance of the listener collected by the external microphone 123. In addition, the user authentication unit 2504 can authenticate the identification information input by the user via the UI operation unit 111.

Further, the sound device 100 includes a speech processing unit 2505, the control unit 2420, the storage unit 2430, and a behavior recognition unit 2506.

The control unit 2420 executes an earhole open/close control application to control the driving of the micropump 2411 for pumping or sucking air to or from the balloon portion 801. In addition, the control unit 2420 monitors the collected sound signals from each of the internal microphone 122 and the external microphone 123 to determine the earhole open/close state on the basis of the difference in frequency responses between them for performing feedback control of the driving of the micropump 2411.

The storage unit 2430 stores information used by the control unit 2420. In addition, the storage unit 2430 stores the earhole open/close state set for each user in association with the user's identification information. Then, the control unit 2420 reads out the earhole open/close state set for the user identified by the user authentication unit 2504 from the storage unit 2430 to control the driving of the micropump 2411 for achieving the read earhole open/close state of the micropump 2411.

The behavior recognition unit 2506 is a functional module that recognizes the user's behavior. The behavior recognition unit 2506 processes behavior recognition, for example, by learning the neural network using deep learning and inputting the detection result obtained by the user position/posture detection unit 2502 into the learned neural network. The deep learning of the neural network is performed so that the user's position/posture pattern and user's behavior pattern are previously associated with the user (although not shown, it can be stored in any storage device such as the storage unit 2430 in the sound device 100, a storage unit 2523 of the information terminal 2520, or a storage device accessible by the cloud-based information processing device 2510). In addition, the behavior recognition unit 2506 can recognize the user's behavior on the basis of the listener's schedule information and the estimated schedule information managed by the information terminal 2520 held by the user, the cloud-based information processing terminal, or the like. The control unit 2420 can control the driving of the earhole opening/closing unit 2410 to adapt to the user's current behavior on the basis of the recognition result obtained by the behavior recognition unit 2506.

The speech processing unit 2505 performs speech processing such as noise cancellation (NC) processing, noise reduction (NR) processing, external sound pickup, sound collecting processing, volume control, speech enhancement, and frequency response adjustment on the reproduced sound being played by the micro-speaker 2503. Moreover, the noise cancellation processing is the processing of generating a sound wave having a phase opposite to that of the noise (ambient sound) to offset the noise. The noise reduction processing is the processing of removing the noise using signal processing or software. A feedforward cancellation signal that cancels the ambient sound leaking into the ear canal is generated on the basis of the ambient sound picked up by the external microphone 123. In addition, the internal microphone 122 measures the leaking ambient sound that failed to be removed by the cancellation signal in the ear canal and generates a feedback cancellation signal on the basis of the measurement result. In one example, the feedforward and feedback cancellation signals are superimposed on the reproduced sound generated from the micro-speaker in the main body 110 and are output.

The control unit 2420 can control the speech processing unit 2505 to perform speech processing for adaptation to the user's current behavior on the basis of the recognition result obtained by the behavior recognition unit 2506.

A communication unit 2507 is a functional module that communicates with the cloud-based information processing device 2510 and the information terminal 2520 held by the user. The communication unit 2507 can be interconnected with the cloud-based information processing device 2510 or the information terminal 2520 using wired communication such as Ethernet (registered trademark) or wireless communication such as Wi-Fi (registered trademark). In addition, the communication unit 2507 can be connected to the cloud-based information processing device 2510 or the information terminal 2520 by using a different communication scheme. In one example, it can be connected to the cloud-based information processing device 2510 over the Internet via an access point, while it can be connected to the information terminal 2520 using short-range wireless communication such as Bluetooth (registered trademark). The sound device 100 is assumed to be paired with the information terminal 2520 capable of communicating via the communication unit 2507.

The cloud-based information processing device 2510 includes, for example, a personal computer connected as a server on the Internet. The cloud-based information processing device 2510 includes a communication unit 2511 that communicates with the sound device 100 and a communication unit 2512 that communicates with the information terminal 2520.

Further, on the cloud-based information processing device 2510, personal agents 2513, 2514, and so on corresponding to each of one or more users including a user who wears the sound device 100 are activated. The personal agents 2513, 2514, and so on are each a dialogue engine or dialogue engine backend that implements dialogue services such as an audio agent or a voice assistant. The personal agent 2513 corresponding to the sound device 100 provides a dialogue service for a user who wears the sound device 100 on the ear. In addition, the personal agent 2513 can execute the processing for automatically controlling the opening/closing of the earhole or a part of the processing operations (e.g., the behavior recognition processing) in the sound device 100. The resultant processing result is transmitted to the sound device 100 via the communication unit 2511.

The information terminal 2520 includes a communication unit 2521, a user authentication unit 2522, a storage unit 2523, and a user interface (UI) unit 2524. The information terminal 2520 corresponds to, for example, a smartphone or tablet held by a user who wears the sound device 100 on the ear and includes various other components, but the illustration and detailed description thereof will be omitted.

The communication unit 2521 is a functional module that communicates with the sound device 100 and the cloud-based information processing device 2510. The information terminal 2520 is assumed to be paired with the sound device 100 (being attached to each of the user's left and right ears) capable of communicating via the communication unit 2521 (same as above).

Various applications including an application that plays back music or the like are executed in the information terminal 2520. In addition, the reproduced sound such as music is transmitted to the sound device 100 via the communication unit 2521 and is acoustically output from the micro-speaker 2503 on the side of the sound device 100. In addition, the information terminal 2520 can execute the processing for automatically controlling the opening and closing of the earhole or a part of the processing operations in the sound device 100. The resultant processing result is transmitted to the sound device 100 via the communication unit 2521.

The user authentication unit 2522 is a functional module that authenticates a user who holds the information terminal 2520. The user authentication unit 2522 can use, for example, the UI unit 2524 to perform the fingerprint authentication for the user, or can use a biometric sensor (not shown) to perform the user authentication. Alternatively, the user authentication unit 2522 can use the UI unit 2524 to enter a password, a pattern specified by individuals, facial image information, or the like to perform the authentication.

Moreover, assuming that a single user uses both the sound device 100 and the information terminal 2520 simultaneously, the user authentication unit 2522 can also function as the user authentication 2504 on the side of the sound device 100. In this case, the information of the user authenticated or identified by the user authentication unit 2522 can be transmitted to the side of the sound device 100 via the communication unit 2521.

The storage unit 2523 stores a set value of the earhole open/close state for each user of the sound device 100. In addition, the storage unit 2523 can store a head-related transfer function (HRTF) for each user calculated on the basis of the time-axis waveform information for each user collecting signals for measuring HRTF for each angle and distance in the sound device 100 or the time-axis waveform information for each angle and distance. Then, the user authentication unit 2522 reads out, from the storage unit 2523, the time-axis waveform information or HRTF for each of the angles and distances corresponding to the authenticated or identified user and transmits it to the side of the sound device 100 via the communication unit 2521. The sound device 100 can convolve the HRTF calculated from the time-axis waveform information for each received angle and distance, or the received HRTF into the reproduced sound of the micro-speaker 2503.

The UI unit 2524 includes, for example, a combination of a display panel and a touch panel superimposed on the surface of the display panel. The UI unit 2524 is also used as a substitute for the UI of the sound device 100. In this case, the result of the user's input operation to the UI unit 2524 is transmitted to the sound device 100 via the communication unit 2521. In one example, the user manually operates the opening/closing adjustment of the earhole in the sound device 100 through the UI operation on the side of the information terminal 2520.

D. System operation

D-1. Set Value Update Operation

Figure 26:
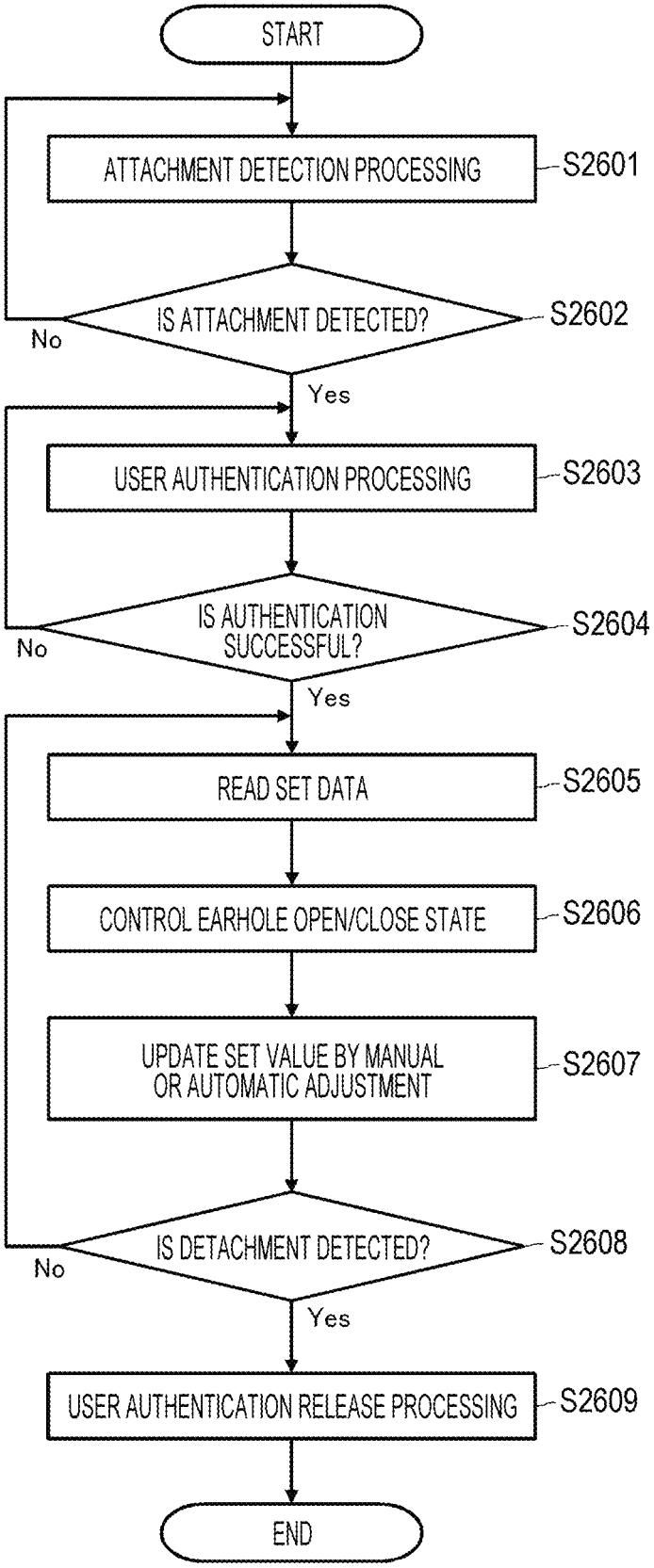
FIG. 26 is a flowchart illustrating a fundamental operation procedure of the earhole open/close control system 2500.

FIG. 26 illustrates an example of the fundamental operation procedure of the earhole open/close control system 2500 illustrated in FIG. 25 in the form of a flowchart.

The attachment detection processing for detecting whether or not the sound device 100 is worn on the user's ear is performed on the basis of the detection result obtained by the attachment detection unit 2501 in the sound device 100 (step S2601). The assumption is given that the listener wears a pair of sound devices 100 on the left and right ears to appreciate the reproduced sound, so the detection result obtained by the position/posture detection unit 2502 in a pair of sound devices 100 can be used as supplementary information to perform the attachment detection processing.

Then, if the sound device 100 is detected to be attached to the user's ear (Yes in step S2602), the user authentication processing is subsequently performed (step S2603). The user authentication processing is performed by at least one of the user authentication unit 2504 in the sound device 100 or the user authentication unit 2522 in the information terminal 2520 paired with the sound device 100.

The user authentication processing is repeated until the authentication of the registered user is successful (No in step S2604). In addition, although not shown, if the user authentication fails a predetermined number of times (No in step S2604), this processing can be terminated, causing the open/close control of the earhole not to be performed.

In one example, for a user with small-sized ears, if the balloon portion 801 expands on the basis of the earhole open/close state set with the large ears, an excessive load is likely to be applied to the user's ears. The user authentication processing makes it possible to prevent an inappropriate earhole open/close state from being applied to a user who does not match.

If the authentication of the registered user is successful (Yes in step S2604), the control unit 2420 reads the set value of the earhole open/close state stored in association with the authenticated user from the storage unit 2430 (step S2605). In one example, the earhole open/close state previously set when the user used the sound device 100 or the barometric pressure in the pressure pipe 140 in the earhole open/close state is stored as a user's set value in the storage unit 2430 in association with the user's identification information, and reads the set value.

Further, if the user authentication is successful (Yes in step S2604), the information terminal 2520 can read out the time-axis waveform information or HRTF for each of the angles and distances corresponding to the user authenticated or identified by the user authentication unit 2522 from the storage unit 2523. Then, the information terminal 2520 can transmit the read data to the side of the sound device 100 via the communication unit 2521. This processing is performed in parallel with the processing of step S2605.

Then, the control unit 2420 drives the micropump 2411 on the basis of the user's set value read from the storage unit 2430 to expand the balloon portion 801 for starting the control of the earhole open/close state (step S2606).

Subsequently, the control unit 2420 executes update processing on the set value of the earhole open/close state for the user by manual adjustment or automatic adjustment (step S2607).

For the manual adjustment, when the user gives an instruction on the opening/closing of the earhole (e.g., more open or more close) to be adjusted by operating the UI unit 2524 on the side of the information terminal 2520, notification of the details of the instruction are provided from the information terminal 2520 via the communication unit 2521. Then, in accordance with the instruction from the user notification of which is provided from the information terminal 2520, the control unit 2420 pumps air supplied from the micropump 2411 to the balloon portion 801 through the pressure pipe 140 to further close the earhole or discharges air through the exhaust valve 2412 to further open the earhole. Thus, the control unit 2420 updates the set value of the earhole open/close state for the user.

Further, for the automatic adjustment, the control unit 2420 acquires the current barometric pressure and the current pressure in the pressure pipe 140 from the barometric pressure sensor 2413 and drives the micropump 2411 to pump air to the balloon portion 801 until the earhole open/close state set to the user authenticated in step S2604 is reached. During that time, the control unit 2420 monitors the barometric pressure sensor 2413 so that an abnormal barometric pressure is not detected. Then, the control unit 2420 monitors whether or not the difference in frequency responses exceeds a given threshold while comparing between the noise levels in the low-frequency range of the internal microphone 122 and the external microphone 123. In the case where the difference exceeds the threshold, it is estimated that the earhole is closed regardless of the earhole open/close state set for the user, the set value of the earhole open/close state for the user is updated, and the inside of the balloon portion 801 is not pressurized any more.

When the desired earhole open/close state is reached, the sound device 100 starts outputting the reproduced sound, such as music from the micro-speaker 2503. The reproduced sound emitted from the micro-speaker 2503 propagates in the sound conduit 150 penetrating through the sound guide portion 120 and travels from the sound output hole 121 at the end toward the ear canal. In this event, the HRTF calculated from the time-axis waveform information for each angle and distance received from the information terminal 2520 or the received HRTF can be convoluted into the audio signal supplied to the micro-speaker 2503. In addition, while the reproduced sound is output from the micro-speaker 2503, the acoustic characteristics are measured using the internal microphone 122 and the external microphone 123.

Until the sound device 100 is detached from the user's ear (No in step S2608), returning to step S2605, the sound device 100 reads the set value, controls the earhole open/close state on the basis of the set value, and executes the update processing repetitively on the set value by manual adjustment or automatic adjustment.

Then, when the attachment detection unit 2501 or the like detects that the sound device 100 is detached from the user's ear (Yes in step S2608), the authentication state of the user authenticated in step S2604 is released (step S2609) and this processing ends. Then, the sound device 100 can return and execute the attachment detection processing (step S2601).

Moreover, in step S2608, in addition to the detection result obtained by the attachment detection unit 2501, it can be determined that the device is detached from the user's ear on the basis of the fact that a certain correlation (e.g., left and right ears) is no longer observed in the posture information detected by the position/posture detection unit 2502 between the left and right sound devices 100 being paired. In addition, for example, the determination can be made by detecting an instruction by an operation such as pressing a touch sensor or a button of the UI operation unit 111 or an instruction by the UI unit 2524 of the information terminal 2520.

Figure 27:
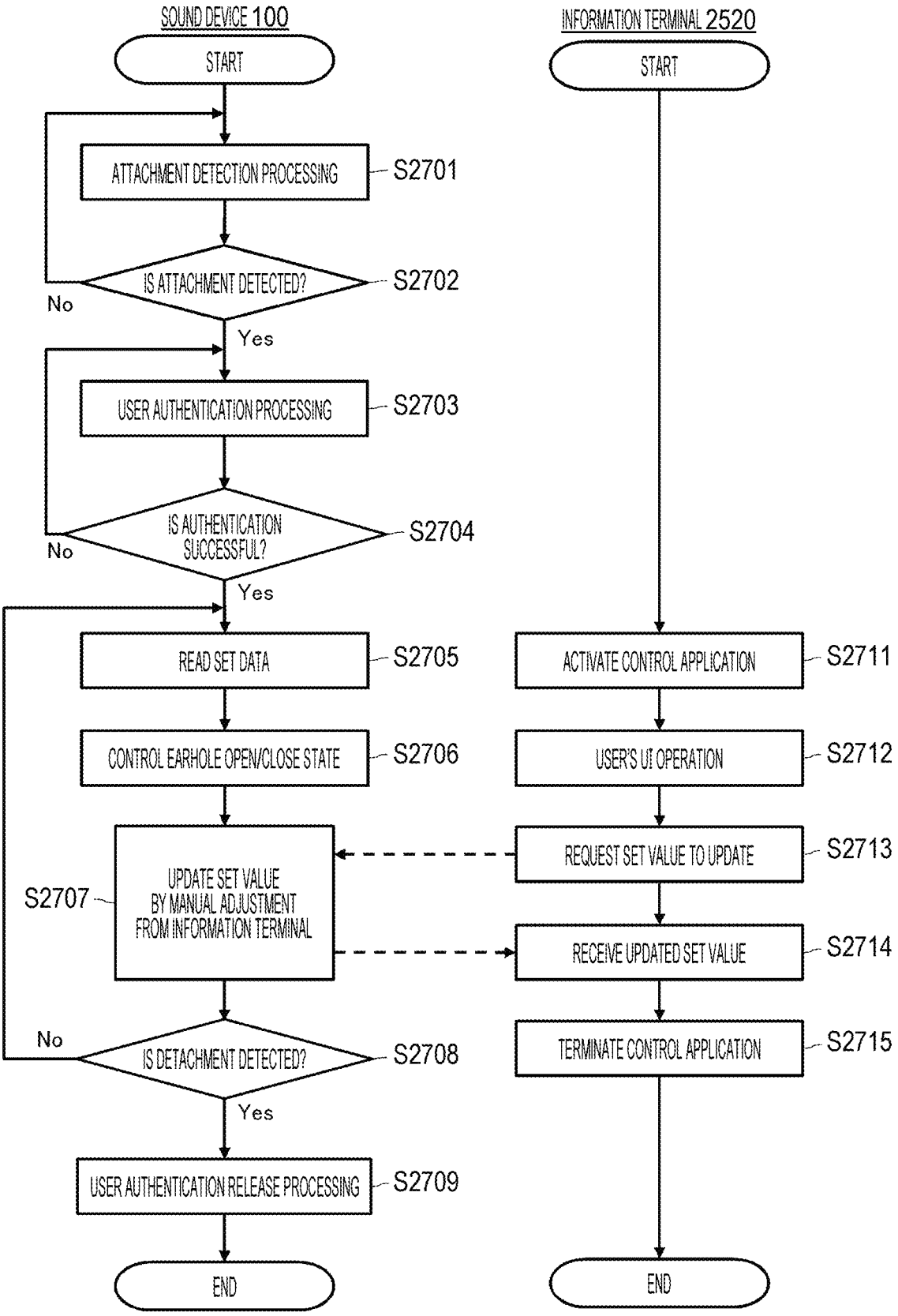
FIG. 27 is a flowchart illustrating a fundamental operation procedure for manually adjusting the earhole open/close state in the earhole open/close control system 2500.

FIG. 27 illustrates an example of a fundamental operation procedure for manually adjusting the earhole open/close state by the sound device 100 in cooperation with the information terminal 2520 in the earhole open/close control system 2500 illustrated in FIG. 25 in the form of a flowchart. However, it is assumed that the information terminal 2520 is a smartphone or the like held by a user who wears the sound device 100 on the ear and has already been paired with the sound device 100 before performing the processing procedure.

The attachment detection processing for detecting whether or not the sound device 100 is worn on the user's ear is performed on the basis of the detection result obtained by the attachment detection unit 2501 in the sound device 100 (step S2701). The assumption is given that the listener wears a pair of sound devices 100 on the left and right ears to appreciate the reproduced sound, so the detection result obtained by the position/posture detection unit 2502 in a pair of sound devices 100 can be used as supplementary information to perform the attachment detection processing.

Then, if the sound device 100 is detected to be attached to the user's ear (Yes in step S2702), the user authentication processing is subsequently performed (step S2703). The user authentication processing is performed by at least one of the user authentication unit 2504 in the sound device 100 or the user authentication unit 2522 in the information terminal 2520 paired with the sound device 100.

The user authentication processing is repeated until the authentication of the registered user is successful (No in step S2704). In addition, although not shown, if the user authentication fails a predetermined number of times (No in step S2704), this processing can be terminated, causing the open/close control of the earhole not to be performed.

In one example, for a user with small-sized ears, if the balloon portion 801 expands on the basis of the earhole open/close state set with the large ears, an excessive load is likely to be applied to the user's ears. The user authentication processing makes it possible to prevent an inappropriate earhole open/close state from being applied to a user who does not match.

If the authentication of the registered user is successful (Yes in step S2704), the control unit 2420 reads the earhole open/close state stored in association with the authenticated user from the storage unit 2430 (step S2705). In one example, the earhole open/close state previously set when the user used the sound device 100 or the barometric pressure in the pressure pipe 140 in the earhole open/close state is stored as a user's set value in the storage unit 2430 in association with the user's identification information.

Further, responding to success of the user authentication (Yes in step S2704), the information terminal 2520 reads out the time-axis waveform information or HRTF for each of the angles and distances corresponding to the user authenticated or identified by the user authentication unit 2522 from the storage unit 2523. Then, the information terminal 2520 transmits the read data to the side of the sound device 100 via the communication unit 2521 (step S2705).

Then, the control unit 2420 controls the earhole open state by driving the micropump 2411 to expand the balloon portion 801 on the basis of the set value of the user read from the storage unit 2430 (step S2706).

On the other hand, on the side of the information terminal 2520, a control application for operating the sound device 100 is activated (step S2711), and the user is able to operate the UI unit 2524, such as a touch panel (step S2712). In one example, the user can give an instruction on the earhole open/close state to be changed by the operation of sliding the fingertip on the touch panel or can cause the change amount of the earhole open/close state to be expressed by the degree of the slide. Alternatively, the information terminal 2520 can recognize, in the form of speech, an instruction to change the earhole open/close state by the user's utterance.

Then, in the case where the user wants to close or open the earhole more than the set value, the user requests the opening/closing adjustment of the earhole by operating the UI unit 2524 on the side of the information terminal 2520 (step S2713). The information terminal 2520 notifies the sound device 100 of this request via the communication unit 2521.

On the side of the sound device 100, the control unit 2420 updates the set value of the earhole open/close state for the user (step S2707). Specifically, the control unit 2420 further closes the earhole by pumping air from the micropump 2411 to the balloon portion 801 through the pressure pipe 140 in accordance with the instruction from the user notification of which is provided from the information terminal 2520, or further opens the earhole by discharging air from the exhaust valve 2412. In addition, the sound device 100 notifies the information terminal 2520 of the updated set value via the communication unit 2507. Then, the information terminal 2520 receives the set value updated on the side of the sound device 100 (step S2714) and stores it in the storage unit 2523. Then, on the side of the information terminal 2520, the execution of the control application for operating the sound device 100 is terminated (step S2715).

Thus, when the desired earhole open/close state is reached, the sound device 100 starts outputting the reproduced sound, such as music from the micro-speaker 2503. The reproduced sound emitted from the micro-speaker 2503 propagates in the sound conduit 150 penetrating through the sound guide portion 120 and travels from the sound output hole 121 at the end toward the ear canal. At this time, while the reproduced sound is output from the micro-speaker 2503, the acoustic characteristics are measured using the internal microphone 122 and the external microphone 123.

Until the sound device 100 is detached from the user's ear (No in step S2708), returning to step S2705, the sound device 100 reads the set value, controls the earhole open/close state on the basis of the set value, and executes the update processing repetitively on the set value by manual adjustment of the information terminal 2520.

Then, when the attachment detection unit 2501 or the like detects that the sound device 100 is detached from the user's ear (Yes in step S2708), the authentication state of the user authenticated in step S2704 is released (step S2709) and this processing ends. Then, the sound device 100 can return and execute the attachment detection processing (step S2701).

Moreover, in step S2708, in addition to the detection result obtained by the attachment detection unit 2501, it can be determined that the device is detached from the user's ear on the basis of the fact that a certain correlation (e.g., left and right ears) is no longer observed in the posture information detected by the position/posture detection unit 2502 between the left and right sound devices 100 being paired.

D-2. Operation to Detach

Figure 28:
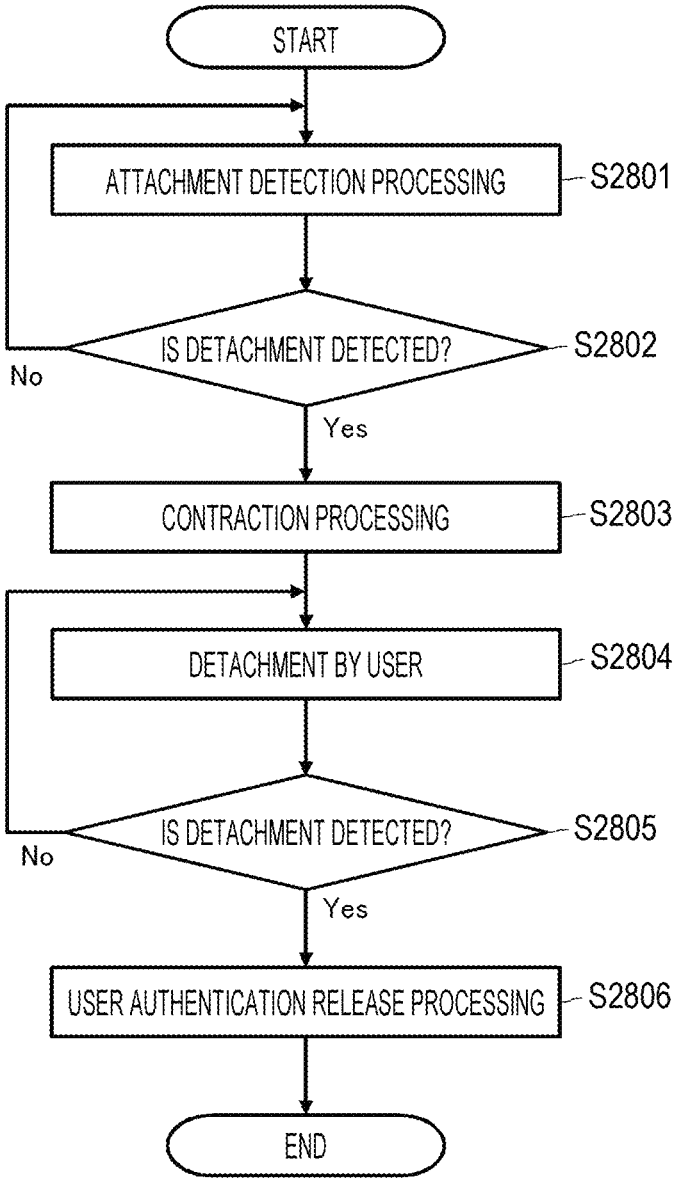
FIG. 28 is a flowchart illustrating a fundamental operation procedure upon detaching the sound device 100 from the ear.

FIG. 28 illustrates an example of a fundamental operation procedure when the sound device 100 is detached from the ear in the earhole open/close control system 2500 illustrated in FIG. 25 in the form of a flowchart.

The attachment detection processing as to whether or not the sound device 100 is worn on the user's ear is performed on the basis of the detection result obtained by the attachment detection unit 2501 in the sound device 100 (step S2801).

The assumption is given that the listener wears a pair of sound devices 100 on the left and right ears to appreciate the reproduced sound, so the detection result obtained by the position/posture detection unit 2502 in a pair of sound devices 100 can be used as supplementary information to perform the attachment detection processing. Moreover, it can be detected that the device is detached from the user's ear on the basis of the fact that a certain correlation (e.g., left and right ears) is no longer observed in the posture information detected by the position/posture detection unit 2502 between the left and right sound devices 100 being paired.

Then, if it is detected that the user detaches the sound device 100 from the user's own ear (Yes in step S2802), the sound device 100 performs contraction processing on the expanded balloon portion 801 (step S2803). This is because, if the user attempts to detach the holding portion 130 from the ear with the earhole closed, the eardrum will be pulled at the negative pressure or the wall surface of the cavity of concha will be rubbed with the holding portion 130, which may cause pain to the user. Moreover, the detachment detection can be performed by detecting an instruction by, for example, an operation such as pressing a touch sensor or a button of the UI operation unit 111.

After contracting the balloon portion 801, the waiting state for detachment detection (No in step S2805) remains until the user detaches the sound device 100 from the ear (step S2804).

Then, if it is detected that the user detaches the sound device 100 from the ear (Yes in step S2805), the user's authentication state is released (step S2806), and this processing ends. Then, the sound device 100 can return to the attachment detection processing (as described above).

D-3. Automatic Adjusting Earhole Open/Close State

Figure 29:
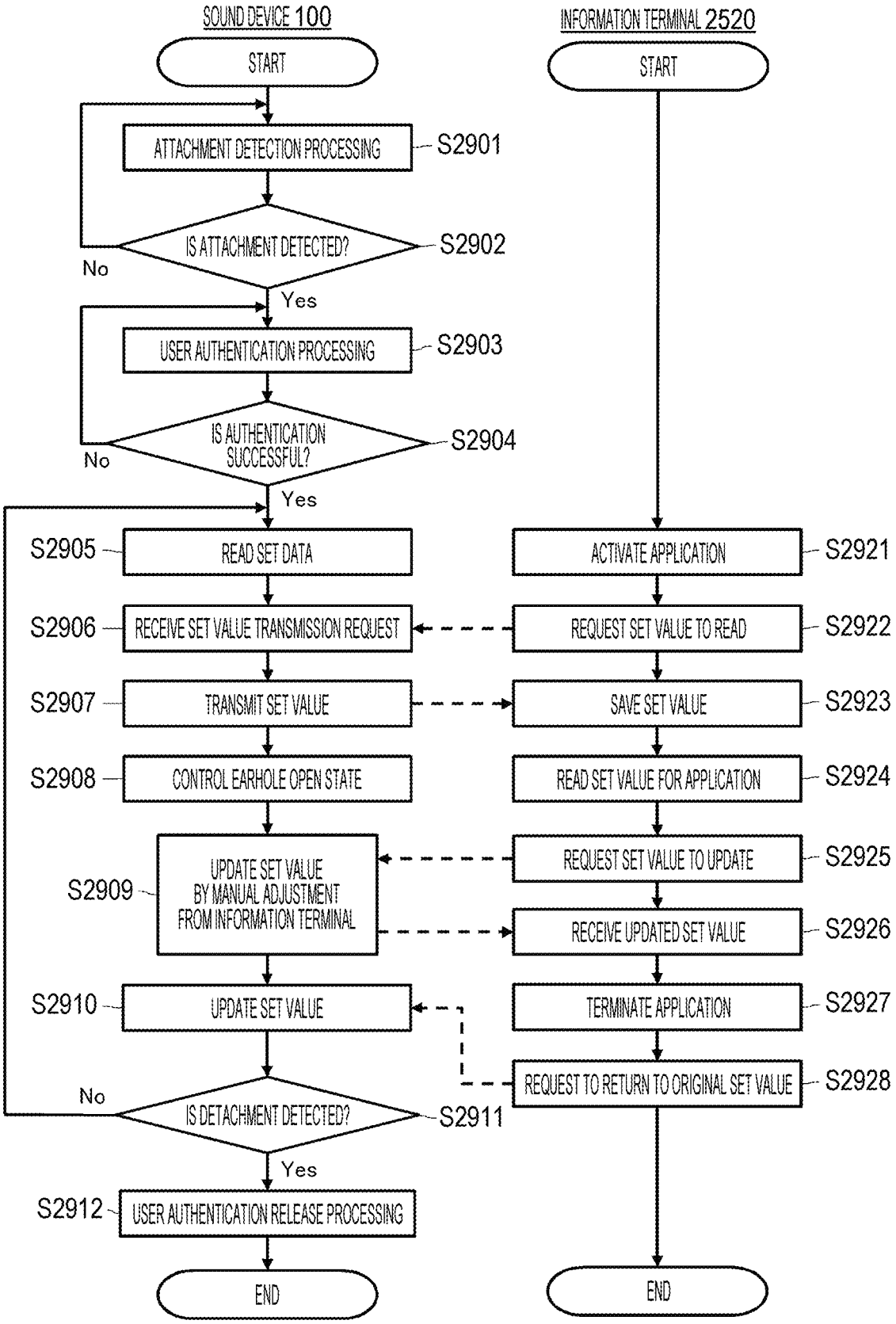
FIG. 29 is a flowchart illustrating a fundamental operation procedure for automatically adjusting the earhole open/close state in the earhole open/close control system 2500.

FIG. 29 illustrates an example of a fundamental operation procedure for automatically adjusting the earhole open/close state by the sound device 100 in cooperation with the information terminal 2520 in the earhole open/close control system 2500 illustrated in FIG. 25 in the form of a flowchart. However, it is assumed that the information terminal 2520 is a smartphone or the like held by a user who wears the sound device 100 on the ear and has already been paired with the sound device 100 before performing the processing procedure.

The attachment detection processing for detecting whether or not the sound device 100 is worn on the user's ear is performed on the basis of the detection result obtained by the attachment detection unit 2501 in the sound device 100 (step S2901). The assumption is given that the listener wears a pair of sound devices 100 on the left and right ears to appreciate the reproduced sound, so the detection result obtained by the position/posture detection unit 2502 in a pair of sound devices 100 can be used as supplementary information to perform the attachment detection processing.

Then, if the sound device 100 is detected to be attached to the user's ear (Yes in step S2902), the user authentication processing is subsequently performed (step S2903). The user authentication processing is performed by at least one of the user authentication unit 2504 in the sound device 100 or the user authentication unit 2522 in the information terminal 2520 paired with the sound device 100.

The user authentication processing is repeated until the authentication of the registered user is successful (No in step S2904). In addition, although not shown, if the user authentication fails a predetermined number of times (No in step S2904), this processing can be terminated, causing the open/close control of the earhole not to be performed.

In one example, for a user with small-sized ears, if the balloon portion 801 expands on the basis of the earhole open/close state set with the large ears, an excessive load is likely to be applied to the user's ears. The user authentication processing makes it possible to prevent an inappropriate earhole open/close state from being applied to a user who does not match.

If the authentication of the registered user is successful (Yes in step S2904), the control unit 2420 reads the earhole open/close state stored in association with the authenticated user from the storage unit 2430 (step S2905). In one example, the earhole open/close state previously set when the user used the sound device 100 or the barometric pressure in the pressure pipe 140 in the earhole open/close state is stored as a user's set value in the storage unit 2430 in association with the user's identification information.

On the other hand, on the side of the information terminal 2520, an application for automatically controlling the earhole open/close state is activated (step S2921). An example of an application that automatically controls the earhole open/close state is, but is not limited to, a music reproduction application for supplying data of reproduced sound such as music to the sound device 100.

Then, on the side of the information terminal 2520, the running application requests the sound device 100 to read the set value of the earhole open/close state (step S2922). The sound device 100 receives the request from the information terminal 2520 (step S2906) and sends, as a reply, the set value read from the storage unit 2430 in step S2905 back to the information terminal 2520 (step S2907). Subsequently, the control unit 2420 drives the micropump 2411 on the basis of the user's set value read from the storage unit 2430 to expand the balloon portion 801 (step S2908).

The information terminal 2520 saves the set value received from the sound device 100 in the storage unit 2523 (step S2923). Then, the information terminal 2520 reads the set value for the running application from the storage unit 2523 (step S2924). If the running application requests the earhole opening/closing adjustment, the information terminal 2520 requests the sound device 100 to update the set value (step S2925).

On the side of the sound device 100, the control unit 2420 updates the set value into a set value of the earhole open/close state depending on the request from the running application on the side of the information terminal 2520 (step S2909). The control unit 2420 further closes the earhole by pumping air from the micropump 2411 to the balloon portion 801 through the pressure pipe 140 in accordance with the set value update request from the information terminal 2520 or further opens the earhole by discharging air from the exhaust valve 2412. In addition, the sound device 100 notifies the information terminal 2520 of the updated set value via the communication unit 2507, and the information terminal 2520 receives the updated set value (step S2926) and stores the updated set value in the storage unit 2523.

Thus, when the desired earhole open/close state is reached, the sound device 100 starts outputting the reproduced sound, such as music reproduction application from the micro-speaker 2503. The reproduced sound emitted from the micro-speaker 2503 propagates in the sound conduit 150 penetrating through the sound guide portion 120 and travels from the sound output hole 121 at the end toward the ear canal. At this time, while the reproduced sound is output from the micro-speaker 2503, the acoustic characteristics are measured using the internal microphone 122 and the external microphone 123.

Then, if the information terminal 2520 terminates the application activated in step S2921, such as the music playback application (step S2927), the information terminal 2520 requests the sound device 100 to return to the original set value (a set value before the application's request to update) (step S2928), and the processing ends.

The sound device 100, when receiving the return request from the information terminal 2520, updates the set value of the earhole open/close state (step S2910).

Then, when the attachment detection unit 2501 or the like detects that the sound device 100 is detached from the user's ear (Yes in step S2911), the authentication state of the user authenticated in step S2904 is released (step S2912) and this processing ends. Then, the sound device 100 can return and execute the attachment detection processing (step S2901).

Moreover, in step S2911, in addition to the detection result obtained by the attachment detection unit 2501, it can be determined that the device is detached from the user's ear on the basis of the fact that a certain correlation (e.g., left and right ears) is no longer observed in the posture information detected by the position/posture detection unit 2502 between the left and right sound devices 100 being paired. In addition, for example, the determination can be made by detecting an instruction by an operation such as pressing a touch sensor or a button of the UI operation unit 111.

In the operation procedure illustrated in FIG. 29, it can be said that the application running on the side of the information terminal 2520 (or the application that supplies the sound device 100 with the reproduced sound) is the trigger for the automatic control of the earhole open/close state. In addition to the application, it is also conceivable to automatically control the earhole open/close state using, as a trigger, an ambient noise level of the user wearing the sound device 100, a user's behavior recognition result, position information, the details of content being played, the presence/absence of the user's utterance, the remaining amount of the battery driving the sound device 100, the presence/absence of surrounding people, altitude, or the like.

In the case where the application is used as a trigger to automatically control the earhole open/close state, the earhole open/close state can be set for each application. In one example, in the case of a music playback application, the earhole can be set to the close state to block ambient sounds and increase the immersive feeling. On the other hand, in the case of an application such as news and news reports, the earhole can be set to the open state.

In the case where the ambient noise level is used as a trigger to automatically control the earhole open/close state, the earhole is caused to be the hermetic state in a quiet environment with a low ambient noise level to prevent the reproduced sound from leaking to the surroundings. In addition, the earhole is caused to be in the open state at a certain noise level, but the earhole is caused to be in the hermetic state under high noise so that the reproduced sound is not difficult to hear.

In the case where the user's behavior recognition result is used as a trigger to automatically control the earhole open/close state, the earhole is caused to be in the hermetic state so that the reproduced sound does not leak and disturb the surroundings when entering a public enclosed space such as a train car, bus, or elevator. In addition, upon riding in a private vehicle, there is no need to worry about making other uncomfortable, so the earhole is caused to be in the open state. In addition, when the user is walking or riding a bicycle, the earhole is caused to be in the open state because it is necessary to hear the ambient sound to detect the danger.

In the case where the user's position information is used as a trigger to automatically control the earhole open/close state, the earhole is caused to be in the open state because it is necessary to respond to questions from a boss or colleagues at work. In addition, the earhole can be caused to be in the open state at home. On the other hand, in the library, the earhole is caused to be in the hermetic state so that the reproduced sound does not leak and disturb the surroundings.

In the case where the details of the content to be played are used as a trigger to automatically control the earhole open/close state by the sound device 100, the earhole can be set as hermetic to block ambient sounds and increase the immersive feeling, for example, upon listening to music. On the other hand, upon listening to a voice, such as reading a paperback through an audio agent, the earhole can be set to the open state.

In the case where the presence/absence of the user's utterance is used as a trigger to automatically control the earhole open/close state, the earhole can be caused to be in the open state during chatting, but the earhole can be caused to be in the hermetic state only for listening at a web conference or the like.

In the case where the remaining battery level is used as a trigger to automatically control the earhole open/close state, it is preferable that the earhole is caused to be in the hermetic state to make it easier to hear even at a low volume and improve power efficiency when the remaining battery level is low.

In the case where the presence/absence of the surrounding people is used as a trigger to automatically control the earhole open/close state, the earhole can be caused to be in the hermetic state so that the reproduced sound does not leak and disturb the surroundings when there are surrounding people. On the other hand, when there are no surrounding people, the earhole can be caused to be in the open state.

In the case where the altitude is used as a trigger to automatically control the earhole open/close state, for example, upon boarding an elevator or an airplane in a high-rise building, it is advisable that the earhole can be caused to be in the hermetic state so that the ear canal is not affected by external pressure.

D-4. Speech Processing Depending on Earhole Open/Close State

The speech processing unit 2505 performs speech processing such as noise cancellation (NC) processing, noise reduction (NR) processing, external sound pickup, sound collecting processing, volume control, speech enhancement, and frequency response adjustment (described above) for the reproduced sound being played back by the micro-speaker 2503.

The speech processing unit 2505 can switch the speech processing method depending on the earhole open/close state.

In one example, in the earhole hermetic state, the low-frequency range of the reproduced sound is likely to be produced, but in the earhole open state, the low-frequency range is weakened. Thus, even if the same reproduced sound is used, there is a problem that the way to hear by the user will vary depending on the earhole open/close state. Thus, the speech processing unit 2505 can perform the equalization processing of the reproduced sound depending on the earhole open/close state so that the user normally hears the same sound.

Further, even if the same volume is output from the micro-speaker 2503, the listening is satisfactory in the earhole hermetic state. However, in the earhole open state, the ambient sound can enter or a part of the reproduced sound can leak to the outside, so there is a problem that the volume that the user actually listens to is lowered. Thus, the speech processing unit 2505 can adaptively control the volume of the reproduced sound depending on the earhole open/close state so that the user can normally listen to the reproduced sound at the same volume.

INDUSTRIAL APPLICABILITY

The foregoing thus describes the technology disclosed in this specification in detail and with reference to specific embodiments. However, it is obvious that persons skilled in the art may make modifications and substitutions to these embodiments without departing from the spirit of the technology disclosed in this specification.

The sound device to which the technology disclosed herein is applied is used by being worn on the listener's ear like a so-called earphone, but it is provided with the mechanism for adjusting the earhole open/close state. Thus, even in the wearing state, it is possible to achieve the same listening characteristics of ambient sound as in the non-wearing state. In addition, it is possible to block ambient sound as necessary to make it easier to hear the reproduced sound and improve the reproduction performance in the low-frequency range.

In the state where the sound device disclosed in this specification is attached to the listener's ear, the sound device has a feature that the main body is installed on the medial surface of the auricle. Thus, it seems to the people around the listener that the listener's earhole is not blocked. By taking advantage of such features, the sound device to which the technology disclosed in this specification is applied is applicable to various sports fields (such as during play or remote coaching) performed outdoor and indoor including walking, jogging, cycling, mountain climbing, skiing, and snowboarding. The sound device is also applicable to the communication or presentation field that necessitates listening to ambient sound and presenting of speech information simultaneously (e.g., such as supplementary information upon theater performance, presentation of museum audio guide information, birdwatching (listening to birdcall)), driving or navigation, guards, newscasters, or the like.

Essentially, the technology disclosed in this specification has been described by way of example, and the stated content of this specification should not be interpreted as being limiting. The spirit of the technology disclosed in this specification should be determined in consideration of the claims.

Additionally, the technology disclosed in the present specification can also be configured as below.

(1) A sound device including:

a main body installed on a medial surface of an auricle;

a holding portion having an annular hollow structure arranged to be coupled to an intertragic notch of an ear near an entrance of an ear canal;

a sound guide portion formed as a pipe structure having one end communicating with the main body and another end communicating with the holding portion;

an open/close operation unit configured to open or close an earhole; and a control unit configured to control driving of the open/close operation unit.

(2) The sound device according to (1), in which the sound guide portion propagates a regenerated sound wave generated by a sound generation portion housed in the main body to a sound output hole near the entrance of the ear canal.

(3) The sound device according to (1) or (2), in which the sound guide portion has a bent shape folded back by an earlobe from the main body installed on the medial surface of the auricle to achieve propagation to a sound output hole near the entrance of the ear canal.

(4) The sound device according to (2) or (3), in which the holding portion performs positioning so that the sound output hole of the sound guide portion can emit the regenerated sound wave to an interior of the ear canal of the earhole by fixing the sound output hole of the sound guide portion to a vicinity of the entrance of the ear canal and has a structure that picks up ambient sound from an opening portion of the annular hollow structure to the entrance of the ear canal.

(5) The sound device according to any one of (1) to (4), in which the open/close operation unit opens and closes the earhole by expanding and contracting the annular hollow structure of the holding portion inward and outward, respectively.

(6) The sound device according to any one of (1) to (5), in which the open/close operation unit includes a balloon portion being expandable or contractable and being arranged inside and outside the annular hollow structure of the holding portion, the balloon portion expands or contracts by applying an action of pressure from a micropump housed in the main body to the balloon portion via the sound guide portion.

(7) The sound device according to (6), in which the balloon portions inside and outside the annular hollow structure are operated independently by being individually applied with the action of pressure from the micropump housed in the main body.

(8) The sound device according to any one of (1) to (4), in which the open/close operation unit includes a porous membrane having an elastomer layer and an electrode layer, the elastomer layer being disposed inside the annular hollow structure of the holding portion, the electrode layer being stacked individually on front and back surfaces of the elastomer layer, and the porous membrane having a large number of small pores penetrating all the layers, and the large number of small pores open or close by applying a voltage from a power supply unit housed in the main body to each of the electrode layers on the front and back surfaces.

(9) The sound device according to any one of (1) to (4), in which the open/close operation unit includes a throttle mechanism disposed inside the annular hollow structure of the holding portion, and the earhole opens or closes on the basis of a throttle amount of the throttle mechanism.

(10) The sound device according to any one of (1) to (9), further including:

a static pressure adjusting portion configured to keep a static pressure in the ear canal and an outside barometric pressure identical when the earhole is hermetic by the open/close operation unit.

(11) The sound device according to (10), in which the static pressure adjusting portion includes a thin tube bored in the holding portion to penetrate the ear canal and an exterior.

(12) The sound device according to (11), in which the thin tube has a transfer function that significantly attenuates a low-frequency range.

(13) The sound device according to any one of (1) to (12), in which the control unit controls driving of the open/close operation unit on the basis of an open/close state of the earhole set for each user.

(14) The sound device according to (2), in which the control unit controls driving of the open/close operation unit on the basis of at least one of a setting of an application that supplies the reproduced sound or details of content being played.

(15) The sound device according to any one of (1) to (14), in which the control unit controls driving of the open/close operation unit on the basis of a noise level around a user.

(16) The sound device according to any one of (1) to (15), in which the control unit controls driving of the open/close operation unit on the basis of at least one of a user's behavior recognition result, position information, presence/absence of a user's utterance, presence/absence of surrounding people, or an altitude.

(17) The sound device according to any one of (1) to (16), in which the control unit controls driving of the open/close operation unit on the basis of a remaining amount of a battery used to drive the sound device.

(18) The sound device according to (2), further including:

a speech processing unit configured to perform speech processing of at least one of noise cancellation processing, noise reduction processing, external sound pickup, sound collecting processing, volume control, speech enhancement, or frequency response adjustment on a reproduced sound generated by the sound generation portion.

(19) The sound device according to (18), in which the speech processing unit adjusts the speech processing depending on an earhole open state.

(20) A sound system including:

a sound device configured to open or close an earhole of a user; and a control device configured to control an open/close state of the earhole in the sound device, in which the sound device includes a main body, a holding unit, and a sound guide portion, the main body being installed on a medial surface of an auricle, the holding portion having an annular hollow structure arranged to be coupled to an intertragic notch of an ear near an entrance of an ear canal, and the sound guide portion being formed as a pipe structure having one end communicating with the main body and another end communicating with the holding portion.

(21) The sound device according to (20) above, in which the control device controls the earhole open/close state on the basis of the earhole open/close state set for each user of the sound device.

(22) The sound device according to (20) above, in which the control device controls the earhole open/close state on the basis of at least one of a setting of an application that supplies the reproduced sound for output by the sound device and details of content being played.

(23) The sound device according to (20) above, in which the control device controls the earhole open/close state on the basis of a noise level around the user of the sound device.

(24) The sound device according to (20) above, in which the control device controls the earhole open/close state on the basis of at least one of a user's behavior recognition result, user's position information, presence/absence of user's utterance, presence/absence of surrounding people, or altitude of the sound device.

(25) The sound device according to (20) above, in which the control device controls the earhole open/close state on the basis of a remaining amount of a battery used to drive the sound device.

REFERENCE SIGNS LIST

100 Sound device
110 Main body
111 UI operation unit
112 Fingerprint authentication unit
113 Proximity sensor
120 Sound guide portion
121 Sound output hole
122 Internal microphone
123 External microphone
130 Holding portion
140 Pressure pipe
141 Output hole (for inside the balloon portion)
142 Output hole (for outside the balloon portion)

150 Sound conduit
160 Voltage supply line
801 Balloon portion
802 Ring frame
1102-*i* Non-coupling portion (inside the balloon portion)
1102-*e* Non-coupling portion (outside the balloon portion)
1301 Pressure pipe (for the inside of the ring)
1302 Pressure pipe (for the outside of the ring)
1701 Thin tube
2100 Throttle mechanism
2101 Fixing ring
2102 Rotating ring
2103 Elastic member
2400 Control system
2410 Earhole opening unit
2411 Micropump
2412 Exhaust valve
2413 Barometric pressure sensor
2414 Relief valve
2420 Control unit
2430 Storage unit
2500 Control system
2501 Attachment detection unit
2502 User position/posture detection unit
2503 Micro-speaker
2504 User authentication unit
2505 Speech processing unit
2506 Behavior recognition unit
2507 Communication unit
2510 Cloud-based information processing device
2511 Communication unit (for sound device 100)
2512 Communication unit (for information terminal 2520)
2513, 2514 Personal agent
2520 Information terminal
2521 Communication unit
2522 User authentication unit
2523 Storage unit
2524 UI unit
3000 Sound device
3010 Sound generation portion
3011 Sound output hole
3012 Internal microphone
3013 External microphone
3020 Holding portion
3030 Main body
3040 Duct
3041 Exhaust hole
3050 Signal line (Pressure pipe)
3401 Magnet
3402 Voice coil
3403 Diaphragm
3404 Diaphragm front-face space
3405 Diaphragm back-face space
3801 Wire
3810 Audio reproduction device
3820 Controller

The invention claimed is:

1. A sound device, comprising:

a main body installed on a medial surface of an auricle;

a holding portion having an annular hollow structure, wherein the holding portion is arranged to be coupled to an intertragic notch of an ear near an entrance of an ear canal;

a sound guide portion that has a pipe structure, wherein the sound guide portion includes a first end communicating with the main body and a second end communicating with the holding portion;

an open/close operation unit configured to one of open or close an earhole, wherein the open/close operation unit includes a balloon portion that is one of expandable or contractable, the open/close operation unit is arranged inside and outside the annular hollow structure of the holding portion, and the balloon portion is configured to one of expand or contract by application of an action of pressure from a micropump housed in the main body to the balloon portion via the sound guide portion; and a control unit configured to control driving of the open/close operation unit.

2. The sound device according to claim 1, wherein the sound guide portion is configured to propagate a regenerated sound wave generated by a sound generation portion housed in the main body to a sound output hole near the entrance of the ear canal.

3. The sound device according to claim 1, wherein the sound guide portion has a bent shape folded back by an earlobe from the main body to achieve propagation to a sound output hole near the entrance of the ear canal.

4. The sound device according to claim 2, wherein the holding portion is configured to perform positioning so that the sound output hole of the sound guide portion emits the regenerated sound wave to an interior of the ear canal of the earhole by fixing the sound output hole of the sound guide portion to a vicinity of the entrance of the ear canal, and the holding portion has a structure that picks up ambient sound from an opening portion of the annular hollow structure to the entrance of the ear canal.

5. The sound device according to claim 1, wherein the open/close operation unit is further configured to open and close the earhole by expansion and contraction of the annular hollow structure of the holding portion inward and outward, respectively.

6. The sound device according to claim 1, wherein the balloon portion inside the annular hollow structure and the balloon portion outside the annular hollow structure are operated independently by being individually applied with the action of pressure from the micropump housed in the main body.

7. The sound device according to claim 1, wherein the open/close operation unit includes a porous membrane having an elastomer layer and a plurality of electrode layers, the elastomer layer is inside the annular hollow structure of the holding portion, the plurality of electrode layers is stacked individually on a front surface and a back surface of the elastomer layer, the porous membrane having a large number of small pores penetrating the elastomer layer and the plurality of electrode layers, and the large number of small pores one of open or close by application of a voltage from a power supply unit housed in the main body to each of the plurality of electrode layers.

8. The sound device according to claim 1, wherein the open/close operation unit includes a throttle mechanism inside the annular hollow structure of the holding portion, and the earhole is one of opened or closed based on a throttle amount of the throttle mechanism.

9. The sound device according to claim 1, further comprising a static pressure adjusting portion configured to keep a static pressure in the ear canal and an outside barometric pressure identical in a case where the earhole is hermetic by the open/close operation unit.

10. The sound device according to claim 9, wherein the static pressure adjusting portion includes a thin tube bored in the holding portion to penetrate through the ear canal and an exterior.

11. The sound device according to claim 10, wherein the thin tube has a transfer function that attenuates a low-frequency range.

12. The sound device according to claim 1, wherein the control unit is further configured to control the driving of the open/close operation unit based on an open/close state of the earhole set for each user.

13. The sound device according to claim 2, wherein the control unit is further configured to control the driving of the open/close operation unit based on at least one of a setting of an application that supplies a reproduced sound or details of content being played.

14. The sound device according to claim 1, wherein the control unit is further configured to control the driving of the open/close operation unit based on a noise level around a user.

15. The sound device according to claim 1, wherein the control unit is further configured to control the driving of the open/close operation unit based on at least one of a user's behavior recognition result, position information, one of presence or absence of a user's utterance, one of presence or absence of surrounding people, or an altitude of the sound device.

16. The sound device according to claim 2, further comprising a speech processing unit configured to perform speech processing of at least one of noise cancellation processing, noise reduction processing, external sound pickup, sound collecting processing, volume control, speech enhancement, or frequency response adjustment on a reproduced sound generated by the sound generation portion.

17. The sound device according to claim 16, wherein the speech processing unit is configured to adjust the speech processing depending on an earhole open state.

18. A sound system, comprising:

a sound device configured to one of open or close an earhole of a user; and a control device configured to control an open/close state of the earhole in the sound device, wherein the sound device includes:

a main body installed on a medial surface of an auricle;

a holding portion having an annular hollow structure, wherein the holding portion is arranged to be coupled to an intertragic notch of an ear near an entrance of an ear canal;

a sound guide portion being that has a pipe structure, wherein the sound guide portion includes a first end communicating with the main body and a second end communicating with the holding portion; and an open/close operation unit configured to one of open or close the earhole, wherein the open/close operation unit includes a balloon portion that is one of expandable or contractable, the open/close operation unit is arranged inside and outside the annular hollow structure of the holding portion, and the balloon portion is configured to one of expand or contract by application of an action of pressure from a micropump housed in the main body to the balloon portion via the sound guide portion.

19. A sound device, comprising:

a main body installed on a medial surface of an auricle;

a holding portion having an annular hollow structure, wherein the holding portion is arranged to be coupled to an intertragic notch of an ear near an entrance of an ear canal;

a sound guide portion that has a pipe structure, wherein the sound guide portion includes a first end communicating with the main body and a second end communicating with the holding portion;

an open/close operation unit configured to one of open or close an earhole; and a control unit configured to control driving of the open/close operation unit based on a remaining amount of a battery used to drive the sound device.

20. A sound device, comprising:

a main body installed on a medial surface of an auricle;

a holding portion having an annular hollow structure, wherein the holding portion is arranged to be coupled to an intertragic notch of an ear near an entrance of an ear canal;

a sound guide portion that has a pipe structure, wherein the sound guide portion includes a first end communicating with the main body and a second end communicating with the holding portion, wherein the sound guide portion is configured to propagate a regenerated sound wave generated by a sound generation portion housed in the main body to a sound output hole near the entrance of the ear canal;

an open/close operation unit configured to one of open or close an earhole;

a control unit configured to control driving of the open/close operation unit; and a speech processing unit configured to perform speech processing of at least one of noise cancellation processing, noise reduction processing, external sound pickup, sound collecting processing, volume control, speech enhancement, or frequency response adjustment on a reproduced sound generated by the sound generation portion, wherein the speech processing unit is configured to adjust the speech processing depending on an open/close state of the earhole.

* * * * *